US005577560A

United States Patent [19]

Coronado et al.

[11] Patent Number: 5,577,560

[45] **Date of Patent: *Nov. 26, 1996**

[54] FLUID-ACTUATED WELLBORE TOOL SYSTEM

[75] Inventors: Martin P. Coronado; Michael J. Loughlin; Luis E. Mendez; Rustom K. Mody, all of Houston, Tex.

[73] Assignee: Baker Hughes Incorporated, Houston, Tex.

[ * ] Notice: The portion of the term of this patent subsequent to Jun. 14, 2011, has been disclaimed.

[21] Appl. No.: 90,379

[22] Filed: Jul. 12, 1993

Related U.S. Application Data

[63] Continuation-in-part of Ser. No. 926,139, Aug. 5, 1992, Pat. No. 5,320,182, and Ser. No. 851,099, Mar. 13, 1992, Pat. No. 5,265,679, and Ser. No. 797,220, Nov. 25, 1991, Pat. No. 5,228,519, and Ser. No. 41,123, Mar. 30, 1993, Pat. No. 5,297,634.

[51] Int. Cl.[6] ..... E21B 33/127

[52] U.S. Cl. ..... 166/387; 166/66.4; 166/106; 166/187

[58] Field of Search ..... 166/387, 187, 166/66.4, 65.1, 106, 68, 105, 102, 103

[56] References Cited

U.S. PATENT DOCUMENTS

| | | |
|---|---|---|
| 1,906,771 | 5/1933 | Sandstone . |
| 1,923,015 | 8/1933 | Sandstone . |
| 1,925,015 | 8/1933 | Wells . |
| 2,441,894 | 5/1948 | Mennecier . |
| 2,455,022 | 11/1948 | Schmidt . |
| 2,552,433 | 5/1951 | Kirby, II . |
| 2,681,706 | 6/1954 | Pottorf . |
| 2,828,823 | 4/1958 | Mounce . |
| 2,839,142 | 6/1958 | Huber . |
| 2,930,957 | 3/1960 | Cronberger . |
| 3,036,645 | 5/1962 | Rowley . |
| 3,066,739 | 12/1962 | Saurenman et al. . |
| 3,083,774 | 4/1963 | Peters et al. . |
| 3,115,840 | 12/1963 | Feltus . |
| 3,209,835 | 10/1965 | Bourne, Jr. et al. . |
| 3,291,230 | 12/1966 | Cullen et al. . |
| 3,422,673 | 1/1969 | LeBourg . |
| 3,460,618 | 8/1969 | Blagg . |
| 3,460,625 | 8/1969 | Hart et al. . |
| 3,575,238 | 4/1971 | Shillander . |
| 3,690,375 | 9/1972 | Shillander . |
| 3,856,085 | 12/1974 | Holden et al. . |
| 3,887,158 | 6/1975 | Polk . |
| 4,113,012 | 9/1978 | Evans et al. . |
| 4,188,998 | 2/1980 | Upton . |
| 4,197,879 | 4/1980 | Young . |
| 4,249,601 | 2/1981 | White . |
| 4,422,506 | 12/1983 | Beck . |
| 4,440,230 | 4/1984 | McGill . |
| 4,477,235 | 10/1984 | Gilmer et al. . |
| 4,526,233 | 7/1985 | Stout . |
| 4,535,843 | 8/1985 | Jageler . |
| 4,565,247 | 1/1986 | Tapp et al. . |
| 4,624,311 | 11/1986 | Goad . |
| 4,658,189 | 4/1987 | Trusock . |
| 4,748,361 | 5/1988 | Ohnishi et al. . |
| 4,749,037 | 6/1988 | Christensen . |
| 4,756,363 | 7/1988 | Lanmon, II et al. . |
| 4,776,396 | 10/1988 | Studholme . |
| 4,796,699 | 1/1989 | Upchurch . |
| 4,796,707 | 1/1989 | Halbardier . |
| 4,823,037 | 4/1989 | Abukawa et al. . |
| 4,823,881 | 4/1989 | Streich . |
| 4,873,463 | 10/1989 | Jones . |
| 4,880,061 | 11/1989 | Ahlstone . |

*Primary Examiner*—Hoang C. Dang
*Attorney, Agent, or Firm*—Melvin A. Hunn; Felsman, Bradley, Gunter & Dillon

[57] ABSTRACT

A wireline tool string is provided which includes a wireline conveyable fluid-pressurization device, an equalizing apparatus, a pressure extending device, a pull-release apparatus, and a fluid-pressure actuable wellbore tool. The wireline tool string may be utilized to lower the fluid-pressure actuable wellbore tool, such as a bridge plug, through tubing string to be actuated in the wellbore below the tubing string.

27 Claims, 49 Drawing Sheets

U.S. PATENT DOCUMENTS 4,886,115 12/1989 Leggett et al. .
4,909,321 3/1990 Petree .
4,923,007 5/1990 Sanford et al. .
4,934,460 6/1990 Coronado .
4,949,793 8/1990 Rubbo et al. .
4,953,617 9/1990 Ross et al. .
4,979,567 12/1990 Rubbo .
5,040,600 8/1991 Bailey et al. .
5,228,519 7/1993 Coronado et al. .
5,265,679 11/1993 Coronado et al. ..... 166/324
5,297,634 3/1994 Loughlin ..... 166/387
5,320,182 6/1994 Mendez ..... 166/387

T1

T2 = T1 + 1.5 hrs.

T3 = T2 + 30 sec.

T4 = T2 + 30 sec.

T5 = T4 + 5 sec.

T1

T2 = T1 + 1.5 hr.

T3 = T2 + 5 min.

T4 = T3 + 30 sec.

T5 = T4 + 5 sec.

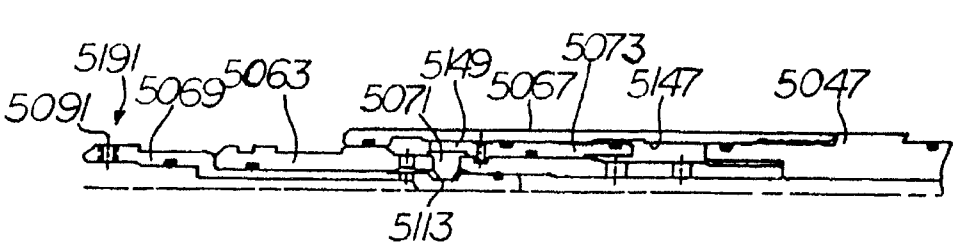
FIG. 19
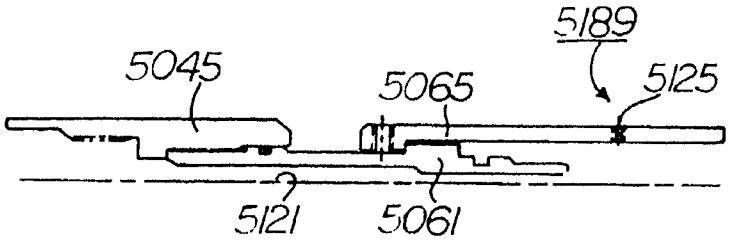
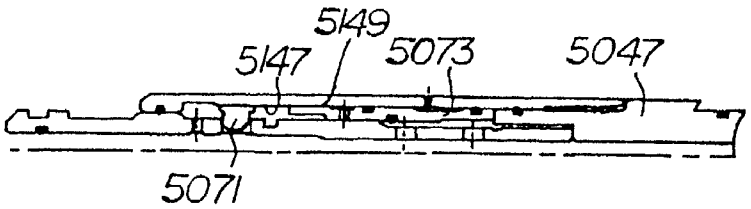
FIG. 18
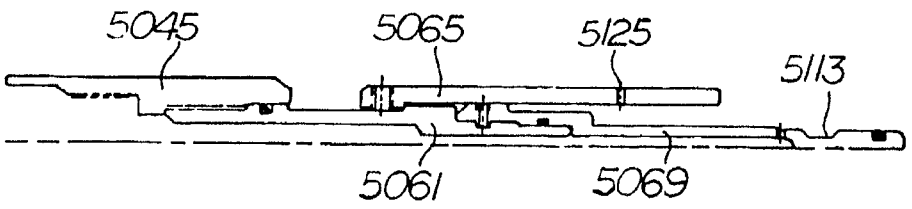

FLUID-ACTUATED WELLBORE TOOL SYSTEM

BACKGROUND OF THE INVENTION

1. Cross-Reference to Related Applications

This application is a continuation-in-part of the following earlier field U.S. patent applications including:

(1) U.S. Pat. No. 5,320,182 application Ser. No. 07/926, 139, filed Aug. 5, 1992, entitled Downhole Pump;

(2) U.S. Pat. No. 5,265,679 application Ser. No. 07/851, 099, filed Mar. 13, 1992, entitled Equalizing Apparatus For Use With Wireline-Conveyable Pumps;

(3) U.S. Pat. No. 5,228,519 application Ser. No. 07/797, 220, filed Nov. 25, 1991, entitled Method and Apparatus for Extending Pressurization of Fluid-Actuated Wellbore Tools;

(4) U.S. Pat. No. 5,297,634 [application Ser. No. 08/041, 123, filed Mar. 30, 1993,] entitled Method and Apparatus for Reducing Pressure Differential Forces on a Settable Wellbore-Fluid Tool in a Flowing Well The applications are incorporated herein by reference as if fully set forth herein.

2. Field of the Invention

This invention relates in general to fluid-actuated wellbore tools, and in particular to fluid-actuated wellbore tools which are carried into wellbores on either wirelines, coiled-tubing strings, or other tubular work strings.

3. Description of the Prior Art

Recent advances in the technology relating to the work-over of producing oil and gas wells have greatly enhanced the efficiency and economy of work-over operations. Through the use of either a coiled-tubing string, or a wireline assembly, work-over operations can now be performed through a production tubing string of a flowing oil and gas well. Two extremely significant advantages have been obtained by the through-tubing technology advances. First, the production tubing string does not need to be removed from the oil and gas well in order to perform work-over operations. This is a significant economic advantage, since work-over rigs are expensive, and the process of pulling a production tubing string is complicated and time consuming. The second advantage is that work-over operations can be performed without "killing" the well. As is known by those in the industry, the "killing" of a producing oil and gas well is a risky operation, and can frequently cause irreparable damage to the worked-over well. Until the recent advances in the through-tubing work-over technology, work-over operations usually required that the well be killed.

Fluid-actuated wellbore tools are widely known and used in oil and gas operations, in all phases of drilling, completion, and production. For example, in well completions and work-overs a variety of fluid-actuated packing devices are used, including inflatable packers and bridge plugs. In a work-over operation, a fluid-actuated wellbore tool may be lowered into a desired location within the oil and gas well, downward through the internal bore of wellbore tubular strings such as tubing and casing strings.

Coiled-tubing workstrings may be used to lower fluid-actuated wellbore tools to a setting depth within a wellbore. Coiled-tubing workstrings are usually coupled to a pumping unit disposed at the ground surface of the well. The surface pumping unit provides pressure to an actuating fluid which is usually, but not necessarily, a wellbore fluid. The pumping unit at the surface of the wellbore usually has sufficiently high levels of pressure to completely, and reliably, actuate the fluid-actuated wellbore tool.

A number of fluid-actuable wellbore tools may be used with wireline-suspended pumps. For example, fluid-actuated inflatable packing devices, such as inflatable packers and bridge plugs, which include substantial elastomeric components, such as annular elastomeric sleeves, can be run into a wellbore in a deflated condition and be urged by pressurized wellbore fluids between a deflated running position and an inflated setting position. In the inflated setting position, the elastomeric components of wellbore packers and bridge plugs are essential in maintaining the wellbore tool in gripping engagement with wellbore surfaces.

It is frequently necessary or desirable to pressure test portions of wellbore tools, well head assemblies, or portions of the wellbore, with high but transient pressure levels. This is especially true when the use of wireline-conveyable wellbore tool strings, which are typically lowered into a wellbore through a lubricator apparatus which is coupled to the uppermost portion of a wellhead or blowout preventer. Before running the wireline-conveyed wellbore tool into a wellbore under pressure, often it is desirable to perform a high pressure test of the lubricator by closing off a well head valve and pressurizing the lubricator up to test pressures as high as ten thousand (10,000) pounds per square inch. This pressure test of the wireline lubricator is typically performed with the entire wellbore tool string disposed within the lubricator. Therefore, high pressure gas may be urged into interior regions of the wellbore tool string, in communication with a pressure-actuable wellbore tool, such as an inflatable packer or bridge plug.

A problem in prior art operating systems, both coiled tubing and wireline, may arise when the pressure test of lubricator is discontinued and pressure is bled off from the lubricator. Gas which is disposed or trapped within portions of the wellbore tool string may expand, causing an unintentional and problematic actuation of the fluid-actuable wellbore tool. Typically, fluid-actuable wellbore tools are difficult or impossible to move from a radially-enlarged set position to a radially-reduced running position. Therefore, inadvertent setting of a fluid-actuated wellbore tool while it is disposed within the lubricator assembly will require that the lubricator assembly be dismantled or destroyed in order to remove the wellbore tool from within it. This is an extremely undesirable result, since it impedes the work-over operation, results in damage to, or destruction of, the lubricator, and may require that replacement of fluid-actuated wellbore tools and lubricator assemblies be procured before the job can be continued.

A problem with prior art wireline operating systems, is pressurizing fluid-actuated wellbore tools. Inflatable packers which are operable by well fluids pressurized by a downhole motor driven pump have been previously disclosed. See, for example, U.S. Pat. No. 2,681,706 to Pottorf, and U.S. Pat. No. 2,839,142 to Huber. While each of these patents disclose a motor and pump unit which is insertable into a well through a previously installed casing and operates to pump well fluids to expand an inflatable packer, these prior art references furnish no information as to the electrical and mechanical characteristics of the motor that are required to effect an efficient operation of the downhole pump.

Conventional motors available in the market place are not designed to withstand the high temperature - high pressure environment encountered in subterranean wells at depths sometimes in excess of 10,000 ft. Such motors must be able to drive pumps to supply well fluids as the activating fluid for a down hole well tool, such as an inflatable packer. Such motors must be able to generate sufficient power to drive the pump means to produce a desired flow rate and overcome pressure differentials encountered in such well operations.

Another problem with running fluid-actuated wellbore tools with wireline operating systems is maintaining high pump operating pressure. In contrast, to coiled tubing operations, wireline-suspended pumps which are lowered into the wellbore are subject to stringent geometric constraints, particularly when intended for through-tubing operations, and are thus low-power devices, which are rather delicate in comparison with pumps found in surface pumping units. At peak operating loads which are reached when operating at high pressures, the wireline-suspended pumps are subject to risk of failure, so it is one important objective to minimize the amount of time wireline-suspended pumps are operating at peak loads. However, it is equally important that wellbore tools are fully actuated to prevent expensive and catastrophic mechanical failures in the wellbore, such as can occur when packers and bridge plugs become unset.

Fluid-actuated wellbore tools which include elastomeric components are particularly susceptible to mechanical failure if not fully inflated. For example, fluid-actuated inflatable packing devices, such as inflatable packers and bridge plugs, include substantial elastomeric components, such as annular elastomeric sleeves, which are urged by pressurized wellbore fluids between deflated running positions and inflated setting positions. Of course, in the inflated setting position, the elastomeric components of wellbore packers and bridge plugs are essential in maintaining the wellbore tool in gripping and sealing engagement with wellbore surfaces.

Unfortunately, deformable elements, such as elastomeric sleeves, have some mechanical characteristics which can present operating problems. Specifically, deformable elements require some not-insignificant amount of time to make complete transitions between deflated running positions and inflated setting positions.

It has been discovered that wellbore deformable elements require several minutes at high inflation pressures to completely conform in shape to the wellbore surface against which it is urged. This process of setting the shape of the elastomeric sleeve is known as "squaring-off" of the elastomeric element. To allow for the beneficial squaring-off of the elastomeric element, a high inflation pressure must be maintained for an interval of time once the packer or bridge plug is fully inflated. If the high inflation pressure is not maintained while the packer or bridge plug squares off, squaring off may occur after the inflating pressure is locked into an element and inflation means released, and results in a diminished gripping and sealing engagement with the casing.

When a wireline-suspended pump is employed, the operating objective of minimizing peak load operation of the pump is in direct opposition to the operating objective of maintaining a high setting pressure for a sufficient length of time to allow full and complete actuation and squaring off of the fluid-actuated wellbore tool. This conflict presents a serious operating consideration, which requires considerable judgment which is often only found in very experienced operators.

Prior art wireline operating systems include still another problem which causes concern. To determine when a wireline-suspended pump is supplying a sufficiently high pressure to a subsurface fluid-actuable wellbore tool, and operating at peak loads, electric power which is supplied to the wireline-suspended pump is monitored by the operator at the surface of the oil and gas well. These electric power readings indicate when the subsurface fluid-actuated wellbore tool is in a desired operating condition. However, the data provided by the electric power monitoring unit is difficult to interpret, and includes a fleeting, but essential, indication of changes in operating conditions of the fluid-actuated wellbore tool, which can be misinterpreted or missed altogether by a distracted, unobservant, or inexperienced operator.

Yet another problem with fluid-actuated wellbore tools, for both coiled tubing and wireline operating systems, is that pressure differentials created within the wellbore by flowing wellbore fluids can cause unintended displacement of settable wellbore tools, such as bridge plugs and packers. Flow in either direction can exist in a wellbore if a producing zone is in hydraulic communication through the wellbore with a consuming zone. Such interzonal "cross-flow" may exist in a well irrespective of whether it is flowing to the surface.

Some settable wellbore tools are operable in a plurality of operating modes including running in the hole modes of operation, expansion modes of operation, and setting modes of operation. The settable wellbore tool is maintained in a running condition during a running in the hole mode of operation, with a reduced radial dimension so that the settable wellbore tool may be passed downward into the oil and gas well through the production tubing. Once the settable wellbore tool is passed beyond the lower end of the production tubing string, and placed in a desired location, force is applied to the settable wellbore tool to urge it into an expansion mode of operation in which the wellbore tool is urged radially outward from a reduced radial dimension to an intermediate radial dimension, which at least in-part obstructs the flow of wellbore fluid within the wellbore in the region of the settable wellbore tool.

The obstruction created by the settable wellbore tool frequently creates a pressure differential across the settable wellbore tool. Most commonly, this occurs when a packer or bridge plug is set above a producing zone. Wellbore fluids, such as oil and water, will continue flowing into the well due to the pressure differential between the wellbore fluids in the earth's formation and the wellbore itself, as well as the pressure differential between different zones. Consequently, the wellbore fluids tend to flow within the well. However, the settable wellbore tool at least in-part obstructs the flow of wellbore fluids, and, consequently, a pressure differential is created across the wellbore tool.

The cross flow of fluids may urge the settable wellbore tool upward within the wellbore, away from the desired setting location. This unintended, and harmful displacement of the settable wellbore tool can occur because the new through-tubing, work-over technologies do not provide suspension means which are as "stiff" as those found in the more conventional work-over technologies. For example, a wireline-suspended, through-tubing work-over tool offers little resistance to pressure differentials which operate to lift the settable wellbore tool in position within the wellbore. Also, a coiled tubing suspension means may not provide sufficient "stiffness" to prevent upward movement of the settable wellbore tool.

Additionally, if a pressure differential is developed across the settable wellbore tool with a higher pressure level above the settable wellbore tool, the pressure differential may act to disconnect the settable wellbore tool from the suspension means. In a wireline suspended, through-tubing wellbore tool a sufficiently large pressure differential could snap the wellbore tool loose from the wireline cable. Alternately, a high pressure differential could serve to accidentally actuate pressure-sensitive, or tension sensitive disconnect devices which are used in both wireline-suspended tools and coiled-tubing suspended tools.

Further, another problem with prior art operating systems, including wireline, coiled tubing, and other types of work-strings, arises since either a work string, coiled tubing, or wireline tool string may frequently includes subassemblies which are intended for temporary or permanent placement within the wellbore, as well as subassemblies which are intended for retrieval from the wellbore for subsequent use. For example, many inflatable packers, bridge plugs, and liner hangers are adapted for permanent placement within a wellbore. However, the tools which cooperate in the placement and actuation of such permanently-placed wellbore devices are frequently not suited for permanent placement in the wellbore. For example, means of pressurizing fluid, such as retrievable wellbore pumps, have great economic value, and are not intended for a single, irretrievable use in a wellbore. Therefore, disconnect devices exist which serve to separate an upper retrievable portion of a work string or wireline tool from a lower "delivered" portion which is intended for permanent or temporary placement in the wellbore.

One such device is a hydraulically actuated disconnect for disconnecting the upper retrievable portion from the lower delivered portion. Since the hydraulic disconnect is susceptible to failure, it is prudent to provide other, alternative disconnect mechanisms. The present invention is also directed to a pull-release apparatus which is adapted for use in a wellbore when coupled between a fluid-actuated wellbore tool and a retrievable means of pressurizing fluid. The pull-release apparatus of the present invention may operate alone or in combination with other disconnect devices to ensure that valuable retrievable tools are not irretrievably placed or positioned within the wellbore.

This avoids the unintended loss of rather expensive and useful wireline and work string tools.

SUMMARY OF THE INVENTION

It is one objective of the present invention to provide an electric motor driven pumping unit which is capable of being inserted through a previously installed tubing string and efficiently pressurizing well fluids for the operation of a downhole tool, such as an inflatable packer.

It is another objective of the present invention to provide an equalizing apparatus for use in a wellbore tool string which includes an equalizing port for establishing fluid communication between an interior portion of the fluid-pressure actuable wellbore tool and the wellbore during a selected mode of operation, for maintaining the fluid-pressure actuable wellbore tool in a running condition and insensitive to unintentional or transient pressure differentials between an interior portion of the fluid-pressure actuable wellbore tool and the wellbore.

More particularly, it is another objective of the present invention to provide an equalizing port for establishing fluid communication between an interior portion of a fluid-pressure actuable wellbore tool and the interior region of a wireline lubricator assembly during a pressure testing mode of operation to maintain the fluid-pressure actuable wellbore tool in a running condition and insensitive to unintentional and transient pressure differentials between the interior portion of the fluid-pressure actuable wellbore tool and the wireline lubricator assembly.

It is another objective of the present invention to provide an equalizing apparatus for maintaining an interior portion of a fluid-pressure actuable wellbore tool in fluid communication with regions exterior of the tool, and which further includes a closure member which is responsive to pressurized fluid from a wireline-conveyed means of pressurizing fluid for obstructing the equalizing port of the equalizing apparatus to discontinue fluid communication between the interior portion of the fluid-pressure actuable wellbore tool and the exterior region to allow build-up of pressure within the fluid-pressure actuable wellbore tool.

It is another objective of the present invention to provide an apparatus which automatically and reliably extends the application of an actuating force to a fluid-actuated wellbore tool for a preselected time interval, and which maintains the actuating force at a preselected force level.

It is another objective of the present invention to provide a pressurization extending device for use between a means of pressurizing fluid, such as a wireline pump, and a fluid-actuated wellbore tool which includes an elastomeric element, such as an inflatable packer or bridge plug, which is movable between a deflated running position and an inflated setting position, wherein the pressurization-extending device operates to automatically maintain the pressurized fluid at a preselected pressure level for a preselected time interval to ensure full and complete inflation and squaring-off of the fluid-actuated wellbore tool for avoiding slippage due to squaring-off of the elastomeric element after the preselected pressure level is released.

It is another objective of the present invention to provide a pressurization-extending device which operates in combination with a means of pressurizing fluid, such as a wireline wellbore pump, to actuate a fluid-actuated wellbore tool, and provides the operator with a positive indication that a pressurization-extending mode of operation has occurred, thus improving the reliability of wellbore service operations and eliminating uncertainties associated with actuation of the wellbore tool.

It is another objective of the present invention to provide an apparatus for use in wellbores which reduces the pressure differential forces caused by wellbore fluid flowing into the wellbore, which act on settable wellbore tools which are suspended in the wellbore on suspension members.

It is another objective of the present invention to provide an apparatus for use in a wellbore which reduces the pressure differential forces acting on a suspended, settable wellbore tool, which includes a bypass fluid flow path extending through the settable wellbore tool for directing wellbore fluid through the settable wellbore tool in response to the pressure differential developed across the settable wellbore tool when it partially obstructs the wellbore and fluid flow exists.

It is another objective of the present invention to provide an apparatus for use in a wellbore for reducing the pressure differential forces caused by wellbore fluids flowing into the wellbore, which act on settable wellbore tools suspended in the wellbore, wherein the apparatus includes a bypass fluid flow path extending thorough the settable tool for directing wellbore fluid through the settable wellbore tool in response to the pressure differential developed across it, a means for maintaining the bypass fluid flow path in an open condition during at least an expansion mode of operation to diminish the pressure differential developed across the wellbore tool, and a means for closing the bypass fluid flow path once the setting mode of operation is obtained to prevent the flow of fluid through the settable wellbore tool.

It is another objective of the present invention to provide a pull-release device for use in conjunction with a setting tool which allows for mechanical decoupling of a retrievable portion of the setting tool.

It is another objective of the present invention to provide a pull-release device for use in conjunction with a setting tool which allows for multiple modes of decoupling a retrievable portion of the setting tool.

It is another objective of the present invention to provide a pull-release device which, during a running in the hole mode of operation, vents wellbore fluid from the interior of said pull-release device to said wellbore to prevent inadvertent inflation of a connected inflatable packing device, or actuation of other fluid-actuated wellbore tools.

A wireline tool string is provided which includes a wireline conveyable fluid-pressurization means, an equalizing apparatus, a pressure extending device, a pull-release apparatus, and a fluid-pressure actuable wellbore tool. In addition, the disclosed equalizing apparatus, pressure extending device, pull-release apparatus, and fluid-pressure actuable wellbore tool may be utilized in coiled tubing operations, as well as operations involving other types of workstrings.

In the preferred embodiment of the present invention, the equalizing apparatus is provided as a pressure equalizing valve for use in a wellbore tool string which includes a wireline-conveyable means of pressurizing fluid which selectively discharges fluid, a wireline-conveyable fluid-pressure actuable wellbore tool which is operable in a plurality of modes of operation including at least a running in the hole mode of operation with said wireline-conveyable fluid-pressure actuable wellbore tool in a running condition and an actuated mode of operation with said wireline-conveyable fluid-pressure actuable wellbore tool in an actuated condition, means for communicating fluid from the wireline-conveyable means of pressurizing fluid and the wireline-conveyable fluid-pressure actuable wellbore tool, and a wireline assembly which is coupled thereto for delivery of the wireline-conveyable means of pressurizing fluid and the wireline-conveyable fluid-pressure actuable wellbore tool to a selected location within a wellbore.

The equalizing apparatus includes a housing, and a means for coupling the housing to a selected portion of the wellbore tool string in fluid communication with the wireline-conveyable fluid-pressure actuable wellbore tool. An equalizing port is provided for establishing fluid communication between an interior portion of the wireline-conveyable fluid-pressure actuable wellbore tool and the region surrounding the wireline-conveyable fluid-pressure actuable wellbore tool during testing and running in the hole modes of operation, for maintaining the wireline-conveyable fluid-pressure actuable wellbore tool in a running condition and insensitive to unintentional and transient pressure differentials between an interior portion of the wireline-conveyable fluid-pressure actuable wellbore tool and the surrounding region.

In the equalizing apparatus a closure member is preferably also provided, which is responsive to pressurized fluid from the wireline-conveyable means of pressurizing fluid for obstructing the equalizing port to discontinue fluid communication between the interior portion of the wireline-conveyable fluid-pressure actuable wellbore tool and the region surrounding the wireline-conveyable fluid-pressure actuable wellbore tool, to allow build-up of the pressure within the wireline-conveyable fluid-pressure actuable wellbore tool.

In the equalizing apparatus of the preferred embodiment of the present invention, a latch member is further provided for maintaining the closure member in a fixed and non-obstructing position relative to the equalizing port until the wireline-conveyable means of pressurizing fluid is actuated to initiate switching of the wireline-conveyable fluid-pressure actuable wellbore tool between the running condition and the actuating condition. Also, in the preferred embodiment of the present invention, a tool volume expander member is provided which provides an additional volume which must be filled before overriding of a latch member is allowed, to prevent unintentional closure of the equalizing port.

In the preferred embodiment of the present invention, the wireline conveyable fluid-pressurization means is provided as a through-tubing wireline pump having a motor means which includes a plurality electric motors which are both mechanically and electrically connected in series. The energy requirements of a pump means, which in the preferred embodiment of the wireline fluid-pressurization means includes at least one wobble-plate pump, in terms of both torque and speed, are matched by the mechanical output of the motor means yet at the same time, the motor means are freely insertable through the well, hence are of substantially smaller size than that which could be expected to produce the total torque required by the pump. Furthermore, the total current drawn through the electric wireline is minimized by the electrical series connection.

Additionally, the motors used in the fluid-pressurization means are sealably mounted in axially stacked relationship within a housing containing both the pump means and the motor means. The motors are surrounded by a clean fluid, such as kerosene or water, which is applied at the surface and which is maintained at well hydrostatic pressure by a compensating piston arrangement. A single mounting bracket supports the lowermost motor or the lower end of the motor, if only one is used, within the housing and the stators of the motors are keyed to each other to prevent stator rotation. A heavy spring secures the stack in assembly.

In the preferred embodiment of the present invention, the pressurization-extending device is provided as a pressure extender for coupling between a means of pressurizing fluid and a fluid-actuated wellbore tool. The pressurization-extending device includes a number of components which cooperate together. An input means is provided for receiving a pressurized fluid from the means of pressurizing fluid. An output means is provided for directing the pressurized fluid to the fluid-actuated wellbore tool to supply an actuating force to the fluid-actuated wellbore tool. A timer means is provided, and is responsive to the actuating force of the pressurized fluid. The timer means automatically maintains the actuating force of the pressurized fluid within the fluid-actuated wellbore tool at a preselected pressure level for a preselected time interval.

In the pressure extending device of the preferred embodiment, the timer means includes a fluid cavity which communicates with the input means through a bypass channel, and which is adapted in volume to receive a predetermined amount of fluid over a preselected time interval. Also, in the preferred embodiment, the timer means includes at least one movable piece and at least one stationary piece. The movable piece is advanced relative to the stationary piece by pressurized fluid from an initial position to a final position. Passage of the movable piece from the initial position to the final position defines the preselected time interval of the timer means.

In the preferred embodiment, the pressurization-extending device is especially suited for use with fluid-actuated wellbore tools which include an elastomeric element which is urged between a deflated running position and an inflated setting position, wherein the timer means provides a preselected time interval in which the preselected force is applied to the fluid-actuated wellbore tool, and wherein the preselected time interval is sufficiently long in duration to fully inflate the elastomeric component of the fluid-actuated wellbore tool and to allow squaring-off of the elastomeric element.

In the pressure extending device of the preferred embodiment, a monitoring means is provided which supplies a signal indicative of the operation of the timer means. Preferably, the monitoring means comprises a visual indicator which provides a signal corresponding to the amplitude and duration of the actuation force of the pressurized fluid within the fluid-actuated wellbore tool.

The pressurization extending device of the present invention may also be characterized as a method of actuating a fluid-actuated wellbore tool, which includes a number of method steps. A means of pressurizing fluid and a pressurization-extending device are provided, and coupled together. Pressurized fluid is directed to the fluid-actuated wellbore tool until a preselected pressure threshold is obtained in the pressurized fluid. Operation of the pressurization-extending device is initiated once the preselected pressure threshold is obtained. The pressurization-extending device automatically maintains the pressurized fluid within the fluid-actuated wellbore tool at a preselected pressure level for a preselected time interval. Finally, the operation of the pressurization-extending device is terminated upon expiration of the preselected time interval.

In the preferred embodiment of the present invention, the fluid-pressure actuable wellbore tool is provided as a cross-flow bridge plug which includes a settable wellbore tool. The settable wellbore tool is operable in a plurality of operating modes including a running in the hole mode of operation, an expansion mode of operation, and a setting mode of operation. During a running in the hole mode of operation, the settable wellbore tool is maintained in a reduced radial dimension for passage through wellbore tubular conduits such as production tubing. In an expansion mode of operation, the settable wellbore tool is urged radially outward from the reduced radial dimension to an intermediate radial dimension, and may at least in-part obstructs the flow of wellbore fluid within the wellbore in the region of the settable wellbore tool, and may create a pressure differential across the settable wellbore tool. In a setting mode of operation, the settable wellbore tool is further radially expanded into a setting radial dimension, and is urged into a fixed position within the wellbore, in gripping engagement with the wellbore surface.

In the fluid-pressure actuable wellbore tool of the present invention, a bypass fluid flow path is provided, which extends through the settable wellbore tool, and operates to direct wellbore fluid through the settable wellbore tool in response to the pressure differential developed across the settable wellbore tool during at least the expansion mode of operation. The present invention further provides for a means for maintaining the bypass fluid flow path in an open condition, during at least the expansion mode of operation to diminish the pressure differential developed across the settable wellbore tool. Finally, the present invention provides a means for closing the bypass fluid flow path once the setting mode of operation is obtained to prevent the passage of fluid therethrough.

In the preferred embodiment of the present invention, the pull-release apparatus is provided embodied as a pull-release disconnect for use in a wellbore tool string between a fluid-actuated wellbore tool and a retrievable means of pressurizing fluid. The pull-release, fluid-actuated tool, and means of pressurizing fluid are positioned in the wellbore by a positioning means, such as a wireline, or coiled tubing string, or a work string. The pull-release includes a number of components. A central fluid conduit is defined within the pull-release device, and is adapted for receiving pressurized fluid from the means of pressurizing fluid, and for directing the pressurized fluid to the fluid-actuated wellbore tool. A first latch means is provided, which is operable in latched and unlatched positions. The first latch means mechanically links the means of pressurizing fluid to the fluid-actuated wellbore tool and unlatches the means of pressurizing fluid from the fluid-actuated wellbore tool in response to axial force (either upward or downward, but preferably upward) of a first preselected magnitude, which is applied through the positioning means.

The pull-release apparatus is further provided with a lock means which is operable in locked and unlocked positions. When in the locked position, the lock means prevents the first latch means from unlatching until pressurized fluid is supplied from the means of pressurizing fluid to the central fluid conduit at a preselected pressure level. A second latch means is provided, and is operable in latched and unlatched positions. The second latch means also operates to mechanically link the means of pressurizing fluid to the fluid-actuated wellbore tool. The second latch means unlatches the means of pressurizing fluid from the fluid-actuated wellbore tool in response to axial force of a second preselected magnitude, greater than the first preselected magnitude, which is also applied through the positioning means.

The pull-release apparatus is operable in alternative release modes, including a first release mode, and a second release mode. In the first release mode, the lock means is placed in an unlocked position in response to pressurized fluid directed between the means of pressurizing fluid to the fluid-actuated wellbore tool. Also, in the first release mode, the first latch means is moved from a latched position to an unlatched position by application of axial force of a first preselected magnitude which is applied through the first positioning means to unlatch the means of pressurizing fluid from the fluid-actuated wellbore tool.

In a second release mode of the pull-release apparatus, the lock means remains in a locked position preventing the first latch means from unlatching in response to axial force of the first preselected magnitude. Therefore, the second latch means is moved from a latched to an unlatched position by application of axial force of a second preselected magnitude, which is greater than the first preselected magnitude, which is applied through the positioning means to unlatch the means of pressurizing fluid from the fluid-actuated wellbore tool.

The pull-release apparatus of the preferred embodiment further includes a vent means for equalizing pressure between the fluid-actuated tool and the wellbore, and a valve means operable in open and closed positions, responsive to pressurized fluid from the means of pressurizing fluid, for closing the vent means.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 18 is a partial longitudinal section view of the preferred pull-release disconnect of the present invention in an ordinary pull-release mode of operation; and FIG. 19 is a partial longitudinal section view of the preferred pull-release disconnect of the present invention in an emergency pull-release mode of operation.

DETAILED DESCRIPTION OF THE INVENTION

Figure 1:
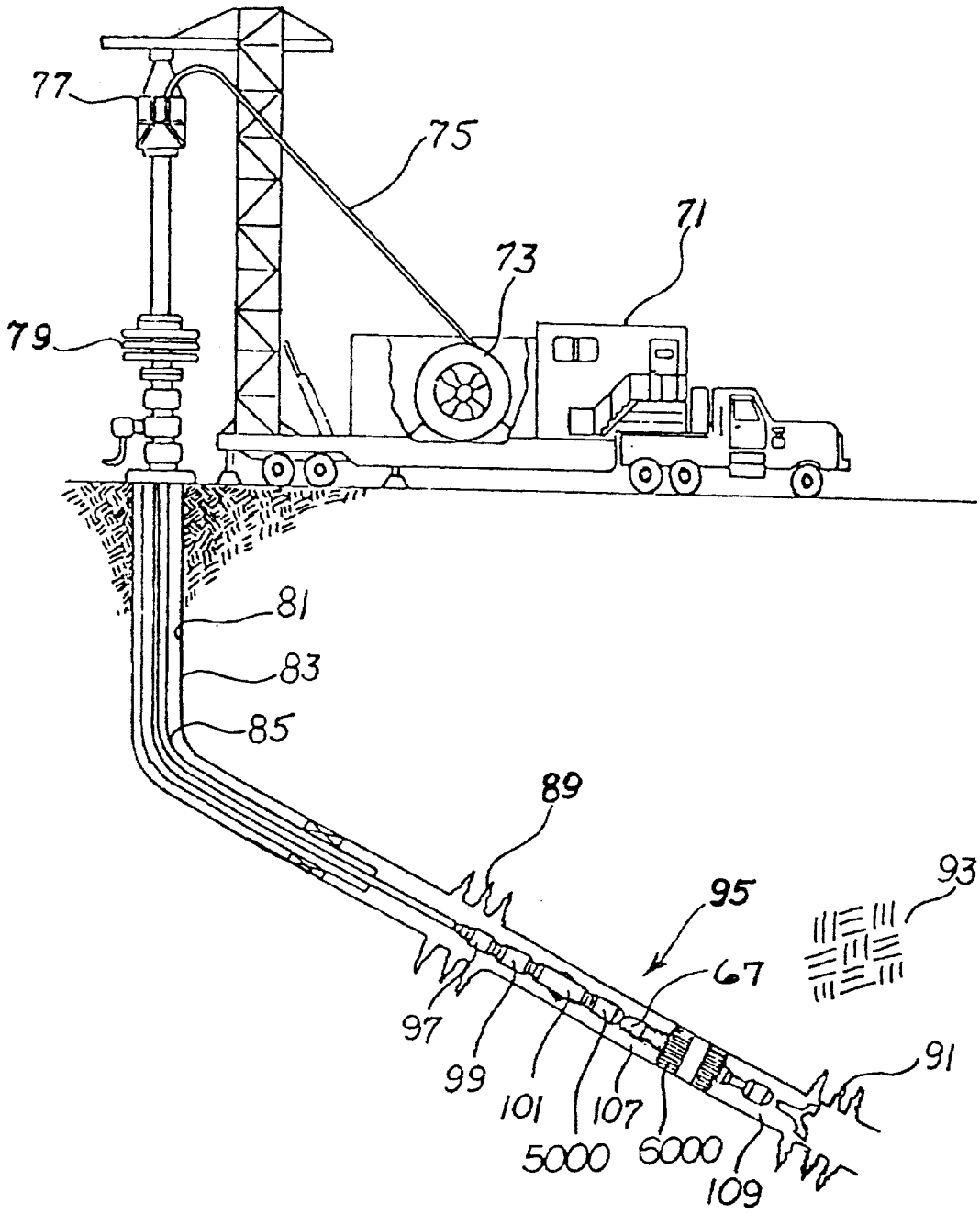
FIG. 1 is a simplified perspective and partial longitudinal section view of a portion of the preferred embodiment of the fluid-actuable wellbore tool string of the present invention, shown disposed within a wellbore as part of a coiled tubing tool string.
Figure 2:
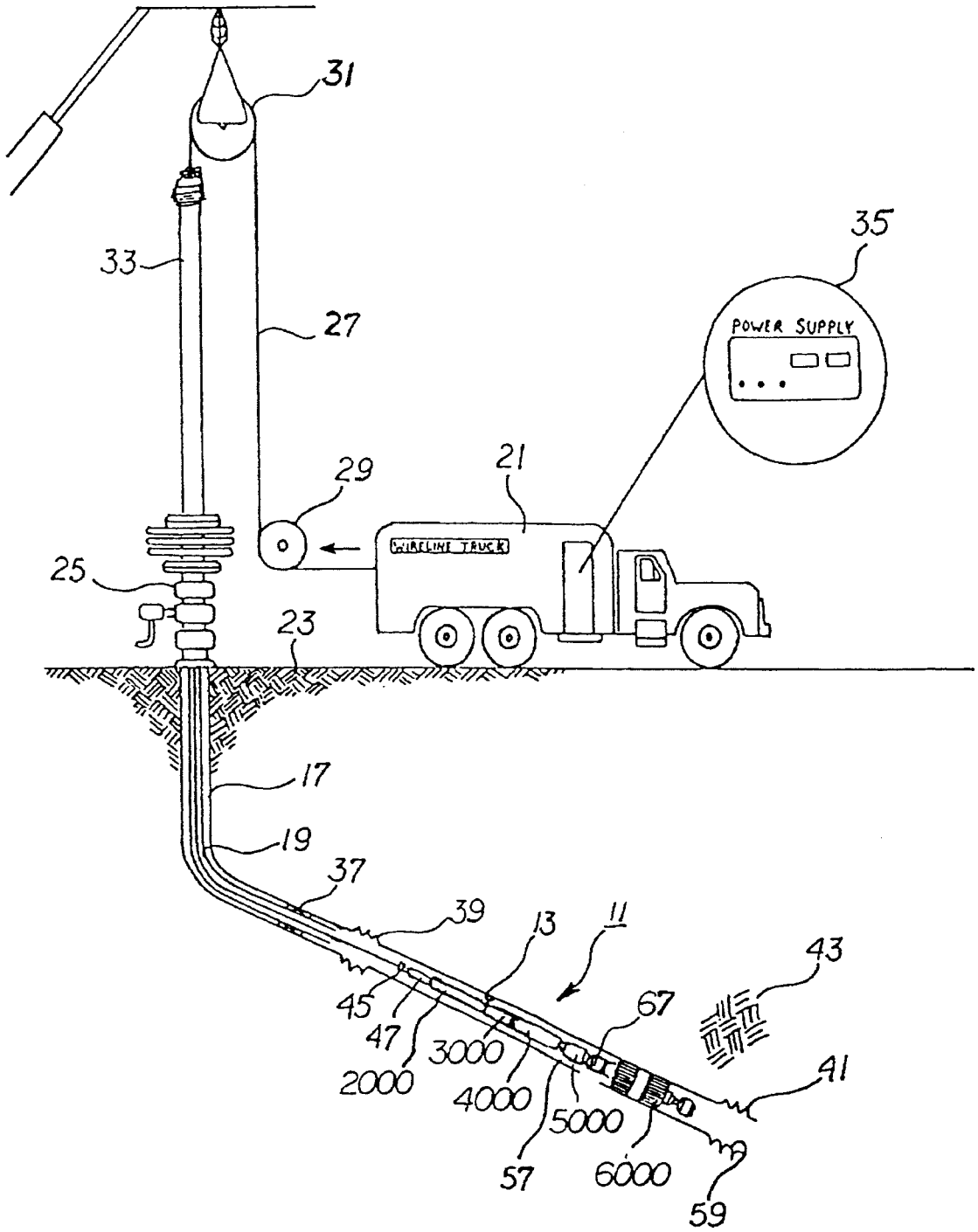
FIG. 2 is a simplified perspective and partial longitudinal section view of the preferred embodiment of the fluid-actuable wireline tool string of the present invention, shown disposed within a wellbore on a wireline.

With reference to FIGS. 1 and 2, schematic views are shown of two types of through tubing work-over operating systems which are utilized to set fluid actuable wellbore tools, such as through tubing bridge plugs. FIG. 1 shows a coiled tubing operating system which includes wellbore tool string 95, and FIG. 2 shows a wireline operating system which includes wellbore tool string 11.

In FIGS. 1, and 2, a fluid actuable wellbore tool, bridge plug 6000, is shown in an inflated setting condition in gripping and sealing engagement with casings 83, 17, respectively. Typically, fluid-pressure actuable wellbore tool 6000 includes one or more elastomeric elements which are expandable radially outward in response to pressurized fluid which is directed downward from wireline pump 2000, through equalizing valve 3000, pressure extender 4000, pull-release disconnect 5000, hydraulic disconnect 67, and to a fluid receiving cavity within fluid-pressure actuable wellbore tool 6000. While the fluid-pressure actuable wellbore tool 6000 which is shown in FIGS. 1 and 2 is a bridge plug, this invention is not contemplated to be limited for use with bridge plugs, and can be used with other fluid-actuable wellbore tools including inflatable packer elements, valves, perforating guns, or other conventional fluid-actuable wellbore tools which are conveyable into a selected position within a wellbore on a wireline assembly.

Although the preferred embodiment of the present invention is primarily depicted as a wireline operating system which includes some advances over coiled tubing operating systems, some components of the present invention may also be utilized in work-over operations with coiled tubing operating systems, as well as other types of work strings. Further, the present invention may also be utilized in operations which are neither workover operations, nor through tubing operations. The present invention provides advancements in through tubing workover operating systems, as well as tubingless initial completion operations, and thus its operational applications are not limited to through tubing wireline operating systems.

COILED TUBING OPERATING SYSTEM

Referring to FIG. 1, the coiled tubing operating system includes a coiled tubing truck 71 having a spool 73 for delivering coiled-tubing 75 to wellbore 81. Coiled-tubing 75 is directed downward through injection head 77 and blowout preventer 79. Coiled-tubing 75 is directed into wellbore 81 through production tubing string 85, which is concentrically disposed within casing 83. As is conventional, production tubing string 85 is packed-off against casing 83 at its lower end. Also, perforations 89, 91 are provided for delivering wellbore fluids, such as oil and water, from formation 93 into wellbore 81 in response to the pressure differential between formation 93 and wellbore 81. Coiled-tubing string 75 is coupled at the surface to a conventional pump (not shown), which operates to pump pressurized fluid downward through coiled tubing 75 and into wellbore tool string 95.

Figure 3:
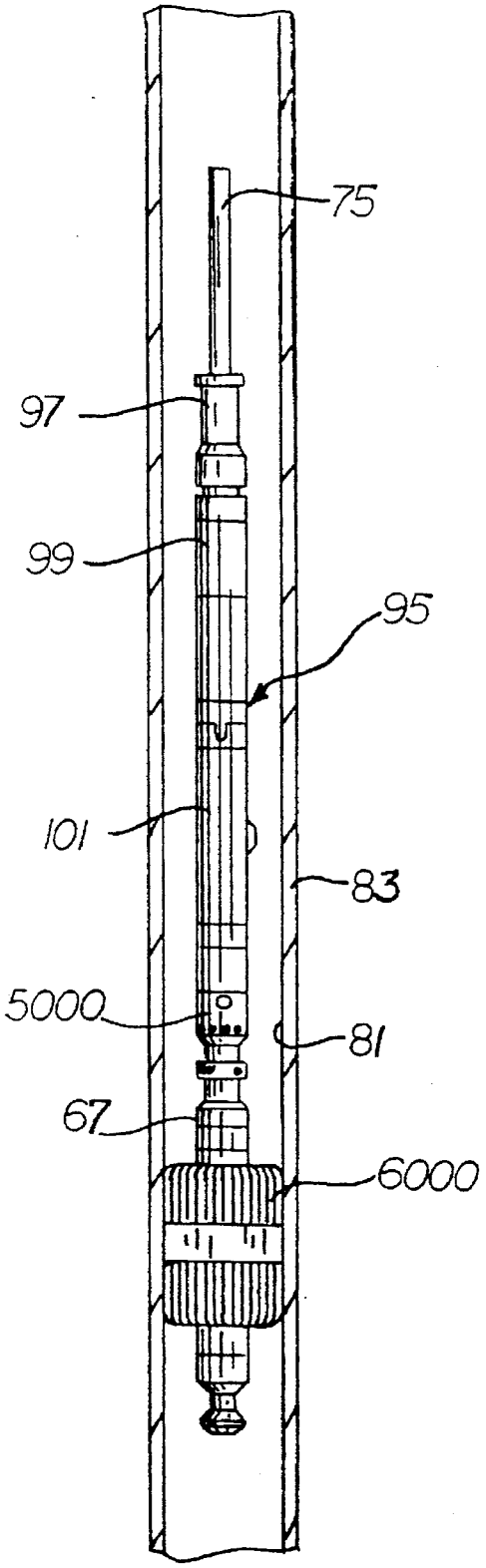
FIG. 3 is an enlarged view of the coiled tubing tool string of FIG. 1 disposed within the wellbore, with a bridge plug carried at the lowermost end of the coiled tubing tool string set against the wellbore casing.

With reference to FIG. 3, wellbore tool string 95 is shown suspended within wellbore 81 on coiled-tubing 75. Wellbore tool string 95 includes coiled-tubing connector 97, back-pressure valve 99, tubing end locator 101, pull-release disconnect 5000, hydraulic disconnect 67, and bridge plug 6000. Although not shown in FIG. 3, equalizing valve 3000 and pressure extender 4000 may be utilized in wellbore tool string 95 in other embodiments of the present invention.

Coiled-tubing connector 97 operates to connect wellbore tool string 95 to coiled-tubing 75. High pressure fluid is directed downward into wellbore 81 through coiled-tubing 75 and is received by wellbore tool string 95.

Back-pressure valve 99 is connected to the lowermost end of coiled-tubing connector 97, and operates to receive pressurized fluid from coiled tubing string 75. Essentially, back-pressure valve 99 operates as a check valve to prevent the backflow of pressurized fluid upward into coiled tubing string 75.

Tubing end locator 101 is coupled to check valve 99, and includes dogs which are movable between open and closed positions, which, when expanded, are larger in radial dimension than the inner diameter production tubing string 85 (shown in FIG. 1). Once inflatable wellbore tool string 95 is passed through production tubing string 85, the dogs may be moved into a radially expanded position, and coiled-tubing string 75 may be withdrawn from wellbore 13, until removable dogs engage the end of production tubing string 85. An increase in the weight carried by coiled tubing string 75 indicates that the dogs are in engagement with the lowermost end of production tubing string 85.

Pull-release disconnect 5000 is coupled to tubing end locator 101, and operates as a backup device in case primary disconnect device, hydraulic disconnect 67, fails to release bridge plug 6000 from the rest of inflatable wellbore tool 95. Pull-release disconnect 5000 separates to disconnect bridge plug 6000 from the rest of inflatable wellbore tool 95 by application of force above a either of two predetermined threshold levels, which are determined by whether fluid pressure has been applied to pull-release disconnect 5000.

Hydraulic disconnect 67 is coupled to the lower end of pull-release disconnect 5000, and operates to release bridge plug 6000 from the rest of wellbore tool string 95 when a preselected pressure threshold is exceeded by the fluid directed downward through coiled-tubing string 75.

Once wellbore tool 95 is disposed in a desired location, pressurized fluid is directed downward from the surface through coiled tubing string 75, and into wellbore tool 95. Back-pressure valve 99 operates to prevent the backwashing of fluid into coiled tubing string 75. Wellbore tool 95 directs pressurized fluid into bridge plug 6000 to expand it radially outward from a deflated running position to an inflated setting position.

Once bridge plug 6000 is set, a pressure increase is applied to the fluid in coiled tubing string 75, which operates hydraulic disconnect 67 to separate wellbore tool string 95 into two portions, one of which is retrievable from wellbore 81, and the other which remains within wellbore 81, held in a fixed position within wellbore 81 by operation of bridge plug 6000. If hydraulic disconnect 67 fails to separate bridge plug 6000 from wellbore tool string 95, upwards force may be applied by pulling on coiled tubing string 75 to disconnect bridge plug 6000 from wellbore tool string 95 by actuating pull-release disconnect 5000.

WIRELINE OPERATING SYSTEM

Referring to FIG. 2, a schematic view is shown of wellbore tool string 11 suspended within wellbore 13 on wireline 27. Wellbore 13 includes production tubing string 19 concentrically disposed within casing 17. At the earth's surface 23, a conventional blowout preventer 25 is provided. Wireline truck 21 which carries a spool of wireline cable 27, and an electric power supply 35, which supplies electric energy through wireline cable 27 to selectively actuate an inflatable wellbore tool 6000 which is disposed at the lowermost end of wellbore tool string 11. Electric wireline cable 27 is directed downward into wellbore 13 through guide wheel 29, pulley 31, lubricator 33, and blowout preventer 25. Wireline 27 is used to raise and lower wellbore tool string 11 within wellbore 13. As is conventional, production tubing string 19 is packed-off at its lower end with production packer 37. Perforations 39, 41 are provided in casing 17 to allow wellbore fluids to pass from formation 43 into wellbore 13.

Figure 4:
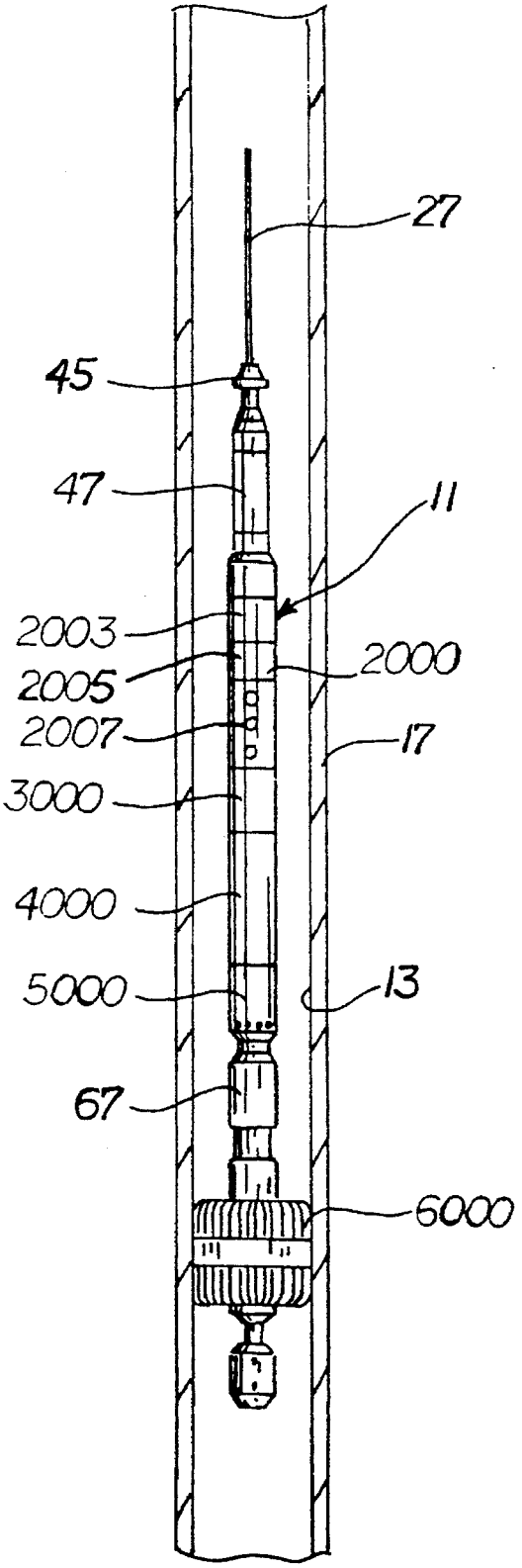
FIG. 4 is an enlarged view of the wireline tool string of FIG. 2 disposed within the wellbore, with a bridge plug carried at the lowermost end of the wireline tool string set against the wellbore casing.

With reference now to FIG. 4, an enlarged view of the preferred embodiment of the present invention depicts wellbore tool string 11 suspended by electric wireline cable 27 within casing 17 of wellbore 13. Rope socket connector 45 is disposed at the uppermost end of wellbore tool string 11 for providing a coupling with electric wireline cable 27. Collar locator 47 is provided directly below rope socket connector 45, and is a conventional device which is used for locating wellbore tool string 11 relative to production tubing string 19 (shown in FIG. 2) and casing 17. Typically, collar locator 47 is an electrical device which detects variation in magnetic flux due to the presence of tubing and casing collars. As shown in FIG. 5N, collar locator 47 is connected in series with wireline pump 2000, rather than in the conventional parallel electrical connection.

Wireline conveyed pump 2000 is connected to the lower end of collar locator 47. Wireline-conveyed pump 2000 serves as a means of pressurizing fluid, and includes three subassemblies including: motor subassembly 2003; pump subassembly 2005; and filter subassembly 2007. Motor subassembly 2003 includes a number of electrical motors which are energized by electricity provided from power supply 35 (shown in FIG. 2) via electric wireline cable 27 to wellbore tool string 11.

Electric motor subassembly 2003 provides mechanical power to pump subassembly 2005, which is connected thereto. Pump subassembly 2005 is adapted to receive wellbore fluid, and exhausts pressurized wellbore fluid, in small quantities. Typically, pump subassembly 2005 requires in excess of one hour to completely fill, and set, a standard through-tubing bridge plug, or a cross-flow bridge plug such as bridge plug 6000, in a seven (7) inch casing. Filter subassembly 2007 is connected to the lower end of pump subassembly 2005, and is adapted to both filter debris from wellbore fluids drawn into the intake of pump subassembly 2005, and to transmit pressurized fluid exhausted from the discharge of pump subassembly 2005 to the portion of tool string 11 therebelow.

By use of the phrase "well fluids" herein it is intended to refer to those fluids, both liquid and gas, which surround the wellbore, either as naturally occurring fluids, and/or as components of drilling, completion or workover fluids introduced into the well for drilling, completion and/or workover applications. Their various contents and applications are well known to those skilled in the art. Although wellbore fluids are used as an actuation fluid in the preferred embodiment of the present invention, other embodiments of this invention may use liquid and/or gaseous actuation fluids other than wellbore fluids, such as an actuation fluid or fluid source carried within wireline tool string Pressure equalizing valve 3000, which includes the equalizing apparatus of the present invention, is coupled to the lowermost end of filter subassembly 2007, and is in fluid communication with the central bore of filter subassembly 2007, for receiving pressurized fluid from wireline pump 2000. Pressure equalizing valve 3000 prevents fluid-actuable wellbore tool 6000 from being prematurely actuated, by preventing fluid or gas pressure from being inadvertently trapped within the portions of wellbore tool string 11 that are in fluid communication with the interior of bridge plug 6000.

Prior to being actuated, equalizing valve 3000 seals the fluid flow-path between wireline pump 2000 and bridge plug 6000, and provides a pressure equalization flow-path between wellbore 13 and the interior portion of tool string 11 in fluid communication with the interior of bridge plug 6000. Pressurized fluid from wireline pump 2000 actuates equalizing valve 3000 to both open a fluid flow-path between pump 2000 and bridge plug 6000, and to close the equalization flowpath between wellbore 13 and the interior of wireline tool 11.

Pressurization extending device 4000 is connected to the lower end of pressure equalizing valve 3000. When viewed broadly, pressurization-extending device 4000 of the present invention is adapted for coupling between a means of pressurizing fluid, such as the wellbore pump 2000, and a fluid-actuated wellbore tool, such as bridge plug 6000. Pressurization-extending device 4000 includes an input means for receiving pressurized fluid from the means of pressurizing fluid. It also includes an output means for directing pressurized fluid to the fluid-actuated wellbore tool, bridge plug 6000, to supply an actuating force to fluid-actuated wellbore tool.

The preferred pressurization-extending device of the present invention, pressure extender 4000, also includes a timer means, which is responsive to the actuating force of the pressurized fluid, for automatically maintaining the actuation force of the pressurized fluid within the fluid-actuated wellbore tool at a preselected force level for preselected time interval.

The output of pump subassembly 2005 is directed through filter subassembly 2007, through equalization valve assembly 3000, through pressure extending device 4000, and to pull-release disconnect 5000. Pull-release disconnect 5000 is an emergency device which backs up the operation of hydraulic disconnect 67. Emergency pull disconnect 5000 operates to release wellbore pump 2000, equalizing valve 3000, and pressure extender 4000 from bridge plug 6000 and hydraulic disconnect 67 when a preselected force threshold is obtained by application of upward force which pulls on wireline 27. This preselected force threshold can be either of 2 values, a lower force threshold if a specific level of fluid pressure has been applied to pull-release 5000, and a higher force threshold if the specific level of fluid pressure has not been applied to pull-release disconnect 5000.

Hydraulic disconnect 67 is connected between bridge plug 6000 and pull-release disconnect 5000. Preferably, hydraulic disconnect 67 is adapted to disconnect from bridge plug 6000 from the upper portion of wireline tool string 11 when a predetermined pressure level is exceeded within wireline tool string 11, which is in excess of the pressure level required for setting of bridge plug 6000.

Bridge plug 6000 is a cross-flow through-tubing bridge plug manufactured by Baker Hughes Incorporated. Bridge plug 6000 includes an annular inflatable wall which is composed of an inner elastomeric sleeve, an array of flexible overlapping slats, and an outer elastomeric sleeve. The annular inflatable wall is disposed over an inflation chamber. Fluid is directed into the inflation chamber through valving (which prevents back flow of fluid) to expand to the annular inflatable wall between a deflated running position and an inflated setting position. Typically, bridge plug 6000 is set at internal pressures between approximately 1200 to 3200 pounds per square inch. In FIG. 4, bridge plug 6000 is shown in an inflated position, in gripping and sealing engagement with casing 17.

THROUGH-TUBING WIRELINE PUMP 2000

Referring to FIGS. 5A through 5M, a downhole pump apparatus of the preferred embodiment of this invention, through-tubing wireline pump 2000, comprises a housing assemblage 2010 which is connected at its lower end to other assemblies which are connected to a well tool requiring pressured fluid, such as cross-flow bridge plug 6000.

Housing assemblage 2010 comprises an upper sub 2012 having wireline connectable means 2012*a* formed on its upper end and defining a relatively small internal bore 2012*b*. Upper sub 2012 is secured by threads 2012*c* to a counterbored portion 2014*a* of an upper sleeve element 2014. The threaded connection is sealed by O-rings 2012*d* and 2012*e*.

A medial portion 2014*b* of upper sleeve element 2014 includes external threads 2014*e* which are connected to the top end of a coupling sleeve 2016. Coupling sleeve 2016 is provided with internal threads 2016*a* at its lower end which threadably engage the upper end of an intermediate sleeve element 2018 of housing 2010 and these threads are sealed by an O-ring 2018*a*. The lower end of the intermediate sleeve element 2018 of the housing 2010 is provided with internal threads 2018*b* which are engaged with external threads provided on a coupling sub 2020. Threads 2018*b* are sealed by an O-ring 2020*a*. The lower end of coupling sub 2020 is provided with internal threads 2020*g* which are secured to a bottom sleeve element 2022 of the housing 2010. External threads 2022*a* on the bottom of the lower housing sleeve 2022 provide a connection to lower assemblies which are in turn connected to a well tool requiring pressured fluid, such as the inflatable wellbore tool 6000 (not shown in FIGS. 5A through 5M).

Near the upper end of the intermediate housing sleeve 2018, internal threads 2018*d* are provided which mount an annular seal and motor mounting bracket 2042. Bracket 2042 has an internally projecting ledge portion 2042*a* on which a conventional thrust bearing unit 2043 and face seal unit 2044 is supported. The face seal 2046 engages the top end of a ring 2048 which is sealably mounted in the bore 2042*b* of the bracket 2042 by an O-ring 2044*a*. The face seal 2046 thus functions as a bottom end seal for a chamber 2050 which extends upwardly through the remaining portions of connecting sleeve 2016 and upper housing sleeve portion 2014 to terminate by a conventional electric wireline connector plug 2052 sold under the trademark "KEMLON". Connector plug 2052 is sealably inserted in the upper end of the reduced diameter bore portion 2014*d* of the upper housing portion 2014. Plug 2052 is secured by internal threads 2014*g* and sealed by an O-ring 2052*a*. An insulated rod assembly 2006 electrically connects between connector plug 2052, which is in turn electrically connected to wireline 27 (not shown in FIGS. 5A through 5M), and uppermost pump motor 2060*d*.

Chamber 2050 is filled with a clean lubricious fluid, such as kerosene, through the fill port 2014*c* which is sealed by conventional check valve 2015. The medial portion 2014*b* of the upper sleeve element 2014 is provided with a radial port 2014*c* which functions as a filling opening and is in fluid communication with the bore 2014*d* of the upper sleeve portion 2014 through check valve 2015.

It is, however, highly desirable that the chamber 2050 containing the kerosene be maintained at a pressure substantially equal to the hydrostatic pressure of the well fluids surrounding the pump 2000, so as to reduce the pressure differential across face seal unit 2044 so that the energization pressure to effect a seal may be minimized. A reduction in the seal energization pressure acting on face seal unit 2044 reduces the friction forces acting on motor driven shaft 2040 to improve the mechanical efficiency of through-tubing wireline pump 2000.

To provide this reduced seal energization pressure feature, a reduced diameter, downwardly depending portion 2014*k* is formed on the upper housing sleeve 2014. This depending portion 2014*k* cooperates with the inner wall 2016*c* of the connecting sleeve 2016 to define an annular fluid pressure chamber 2055 within which an annular piston 2057 is sealably mounted by seals 2057*a* and 2057*b*. A radial port 2016*d* is provided in the wall of the upper portion of the chamber 2055 to expose the upper end of the piston 2057 to the hydrostatic pressure of well fluids surrounding tool 2000. The lower face of piston 2057 is in communication with the chamber 2050 by virtue of axially extending fluid passages 2017*b* provided in the spring anchor 2017. The piston 2057 thus comprises a compensating piston and its position in the chamber 2050 will vary with the external hydrostatic well pressure, effectively transmitting such well pressure to the trapped kerosene contained within chamber 2050.

In addition, a bias spring 2059 is disposed in annular chamber 2055 and presses against annular piston 2057 so that the hydrostatic pressure in chamber 2055 is larger than the hydrostatic pressure of well fluids surrounding wireline pump 2000 by a predetermined pressure bias. This predetermined pressure bias is applied across face seal unit 2044, which seals between annular chamber 2055 and wellbore fluids in the intake of pump 2000, which are essentially at wellbore hydrostatic pressure. Bias spring 2059 is sized to provide a pressure bias across face seal unit 2044 which is balanced between providing a minimum pressure bias to supply an adequate seal energization to prevent loss of fluids in chamber 2055, and providing a minimized pressure bias to prevent creating additional frictional forces between face seal unit 2044 and motor driven shaft 2040.

Within the chamber 2050, a plurality of substantially identical D.C. motors are mounted in axially stacked relationship and respectively designated in the illustrated embodiment as motors 2060*a*, 2060*b*, 2060*c* and 2060*d*. The driveshaft of lowermost motor 2060*a* is connected to the top end of the pump driving shaft 2040 by gear reduction unit 2047, which is only shown schematically. The drive shaft of bottom motor 2060*a* is connected to drive shaft of the next upper motor 2060*b* by a conventional coupling 2070 which is of the type that effects a mechanical connection. C-clamp connector 2066*d* effects a mechanical coupling between adjacent motor housings, and provides a conduit pathway through which wiring passes for providing a series connection of the electrical power supplied to the various motors. Similarly, mechanical couplings 2070 are connected between the drive shafts of motors 2060*b* and 2060*c*, and between the drive shafts of motors 2060*c* and 2060*d*.

It is, of course, necessary that the stator elements, or outer housings 2062*a*, 2062*b*, 2062*c* and 2062*d* of the respective motors, be secured against counter-rotating forces when the respective motor is energized. To effect such securement, the lowermost motor 2062*a* is connected to a support ring c-clamp 2064 which in turn is secured against rotation by frictional forces arising from bellville spring washers 2068 pressing downwards. A stack of Bellville spring washers 2068 are provided to urge a force transmitting ring 2069 downwardly against the stator portion 2062*d* of the uppermost motor 2060*d*. The Bellville springs 2068 are upwardly abutted by a spring anchor 2017 which, is secured to external threads 2014*h* provided on the extreme lower portion 2014*k* of the upper housing sleeve 2014.

Similar anti-rotation and supporting ring c-clamp 2066*d* are respectively provided between motor starors 2062*a*, 2062*b*, 2062*c* and 2062*d*. Those skilled in the art will understand that the aforedescribed mounting arrangement for a plurality of D.C. motors within the limited confines of the bore of the housing 2010 provides a minimum of supporting structure for the stack of motors, yet insures that the stack is maintained in intimate mechanical contact.

The selection of the plurality of motors depends, of course, upon the input speed and torque requirements of the wobble plate pump unit 2030. The motors 2060*a*, 2060*b*, 2060*c* and 2060*d* which may have D.C. voltage characteristics, must be of restricted diameter in order to fit within the bore of the housing assemblage 2010 which, in turn, must be capable of ready passage through previously installed production tubing (not shown in FIGS. 5A through 5M) in the well, or through casing 17 (not shown in FIGS. 5A through 5M). This diameter restriction means that conventional motors may have a limited torque output. For this reason, a plurality of such motors may be mechanically connected in series to multiply the torque outputs by a factor representing the total number of motors employed.

In addition, in the preferred embodiment of the present invention the motors are electrically connected in series so that the applied voltage is distributed substantially equally across each of the plurality of motors. This reduction in voltage effects a substantial reduction in speed of the output shaft of the motors, and may be utilized to eliminate the need for speed reduction gearing which has heretofore been necessary for the successful utilization of the motors in restricted diameter, downhole applications. In the preferred embodiment, however, gear reduction unit 2047 is utilized to couple wobble plate pump 2030 to motors 2060*a*, 2060*b*, 2060*c* and 2060*d*.

In a preferred example of this invention, each of the D.C. motors have a normal applied D.C. voltage of 0–120 volts and at such voltage have a rated speed of rpm and develop a torque of 25 in. lbs. In the utilization of such motors in a pump of a character heretofore described, and assuming the four of such motors are employed, the applied voltage across each motor is on the order of 0–120 volts, the output speed is 2,000 rpm and the total torque developed is 100 in. lbs. These characteristics closely match the desired torque and speed input for the wobble type pump 2030.

The motors may incorporate either a samarium cobalt magnet or a neodymium magnet. The use of such magnets is believed to contribute substantially to the energy available to drive the motors, defined as high inch pounds torque at a given rpm.

Referring still to FIGS. 5A through 5M, a wobble plate pump 2030 is mounted within the interior of housing 2010 by a support ring 2021 which is mounted on the upper end of an internally projecting shoulder of the connecting sub 2020. The wobble plate pump 2030 comprises a plurality of peripherally spaced, plunger type pumping units 2032 which are successively activated by an inclined wobble plate 2040*a* carried on the bottom end of a motor driven shaft 2040 which extends upwardly in the housing 2010 for connection to reduction gear unit 2047 and the driving motors. Rotation of shaft 2040 effects the operation of the pumping plungers 2032. Check valve 2072 prevents backflow of fluids pressurized by pumping plungers 2032.

A radial port 2020*c* provided in the lower end cf the connecting sub 2020. A cylindrical filtering sleeve or screen 2036 has an upper end mounted in a counterbore 2020*b* formed in the bottom end of connecting sub 2020 and sealed thereto by an O-ring 2020*e*. A bottom end 2036*b* of filter sleeve 2036 is sealably mounted in a counterbore 2022*b* in the top end of sleeve element 2022 and sealed by O-ring 2022*c*. The medial portion 2036*c* is perforated or formed of a screen. An annular passage 2025 is defined between the exterior of a downwardly projecting mandrel 2024 and an internal bore surface 2020*f* of connecting sub 2020. Mandrel 2024 is provided at its upper end with external threads 2024*b* for securement to the bottom end of the pump 2030. A plurality of peripherally spaced, fluid passages 2018*c* are provided in the medial portion of the intermediate housing sleeve element 2018 to provide a fluid communication pathway between annular passage 2025 and the intake of pump 2030. A longitudinal bore 2024*a* through mandrel 2024 provides a passageway for fluids to flow from the discharge of pump 2030 and onward to the inlet end of fluid-actuated well tool 6000 for which pressured fluid is required. O-rings 2024*c* and 2024*d* prevent fluid leakage from the bore 2024*a* of mandrel 2024.

FIG. 5N is a schematic diagram of casing collar locator 47, which is used for selectively positioning wellbore tool 11 within wellbore 13, and passing current to pump 2000 to power pump motors 2060*a*, 2060*b*, 2060*c*, and 2060*d*. It should be noted that the collar locator coil 47*c* is connected in series with the pump motors 2060*a*, 2060*b*, 2060*c*, and 2060*d*, as opposed to the conventional collar locator parallel connection. This enables passage of more current to pump 2000 for a specific voltage applied at collar locator 47 by power supply 35.

Figure 6A:
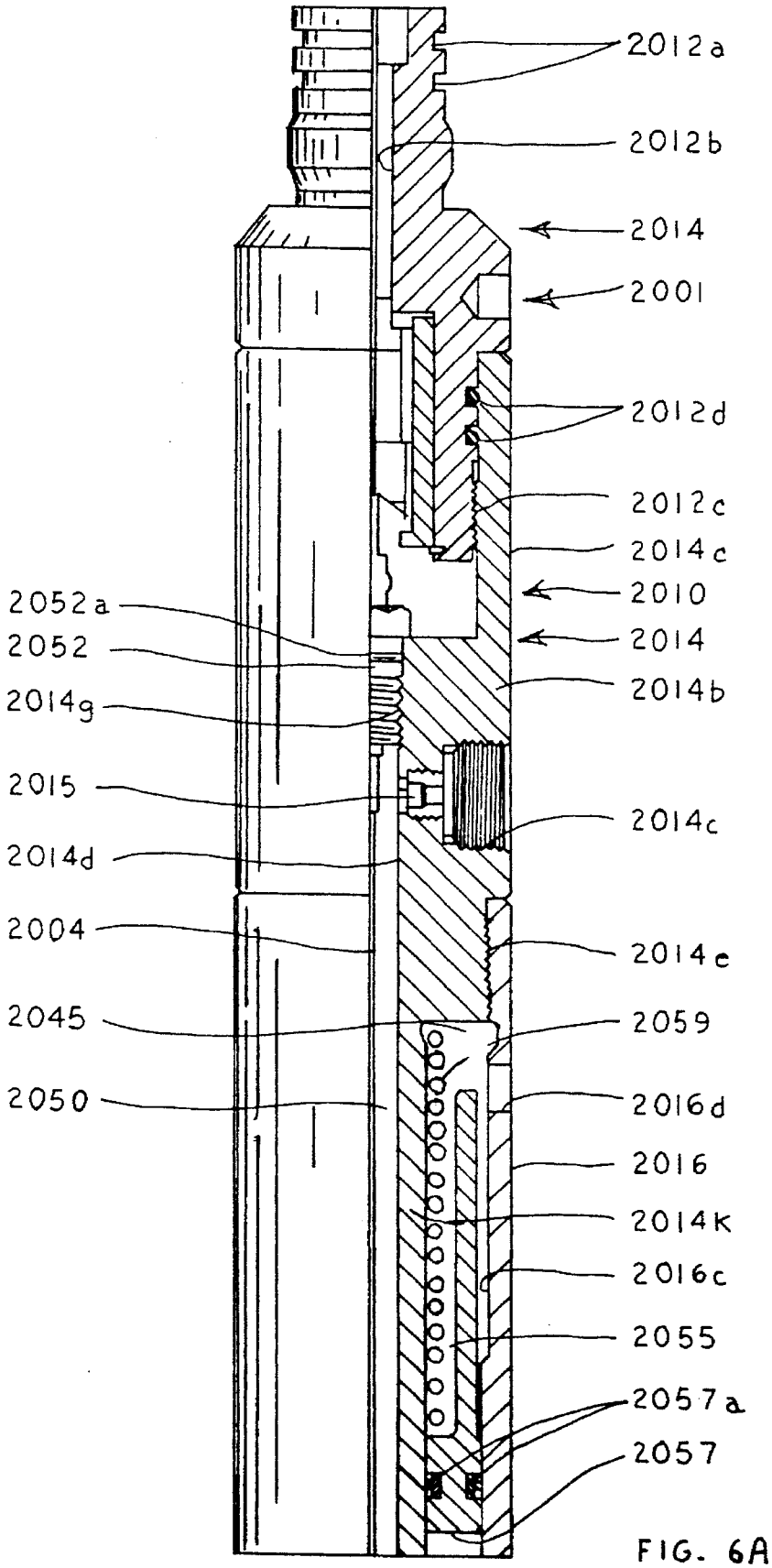
FIGS. 6A through 6D are one-quarter longitudinal section views, which when read together, depict an earlier alternative embodiment of the wireline conveyable fluid pressurization means.
Figure 6B:
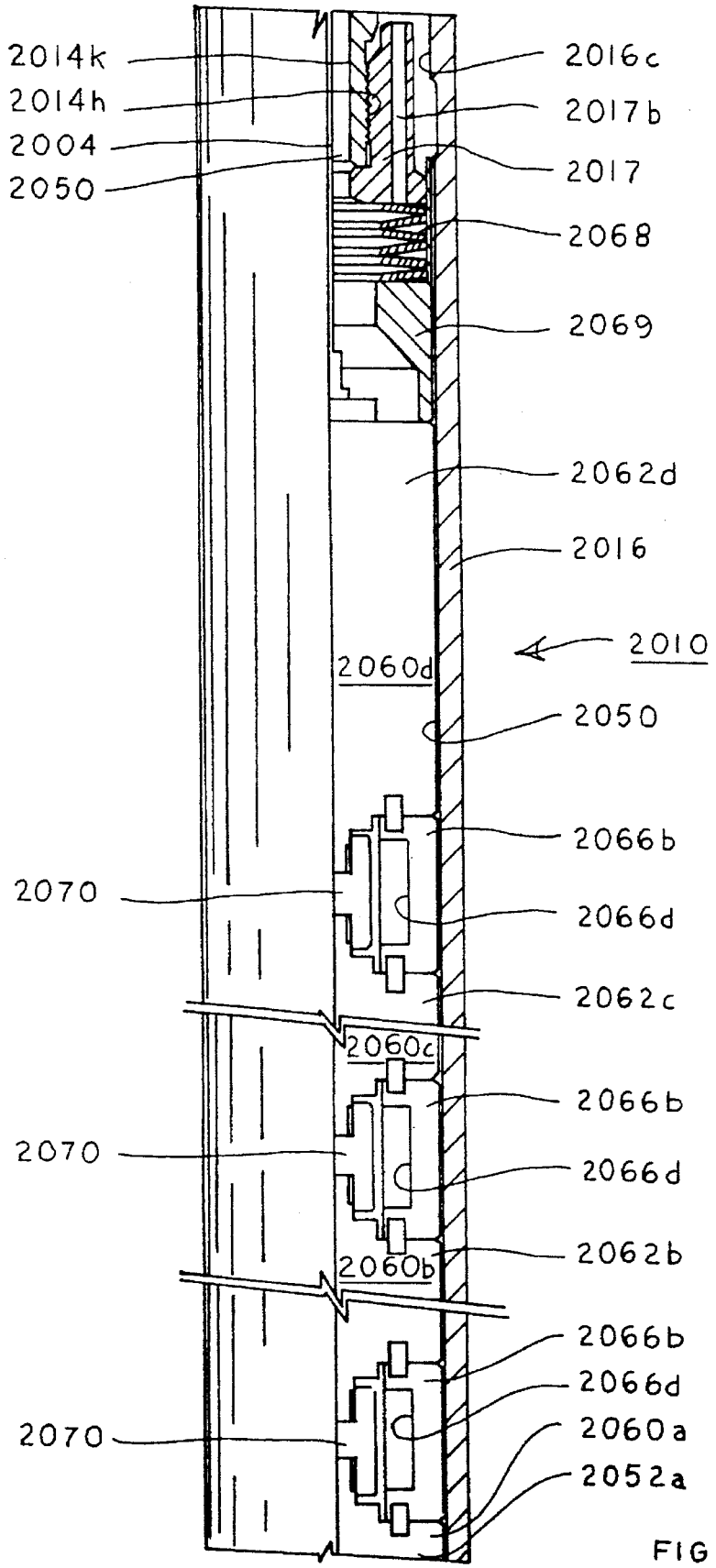
Figure 6C:
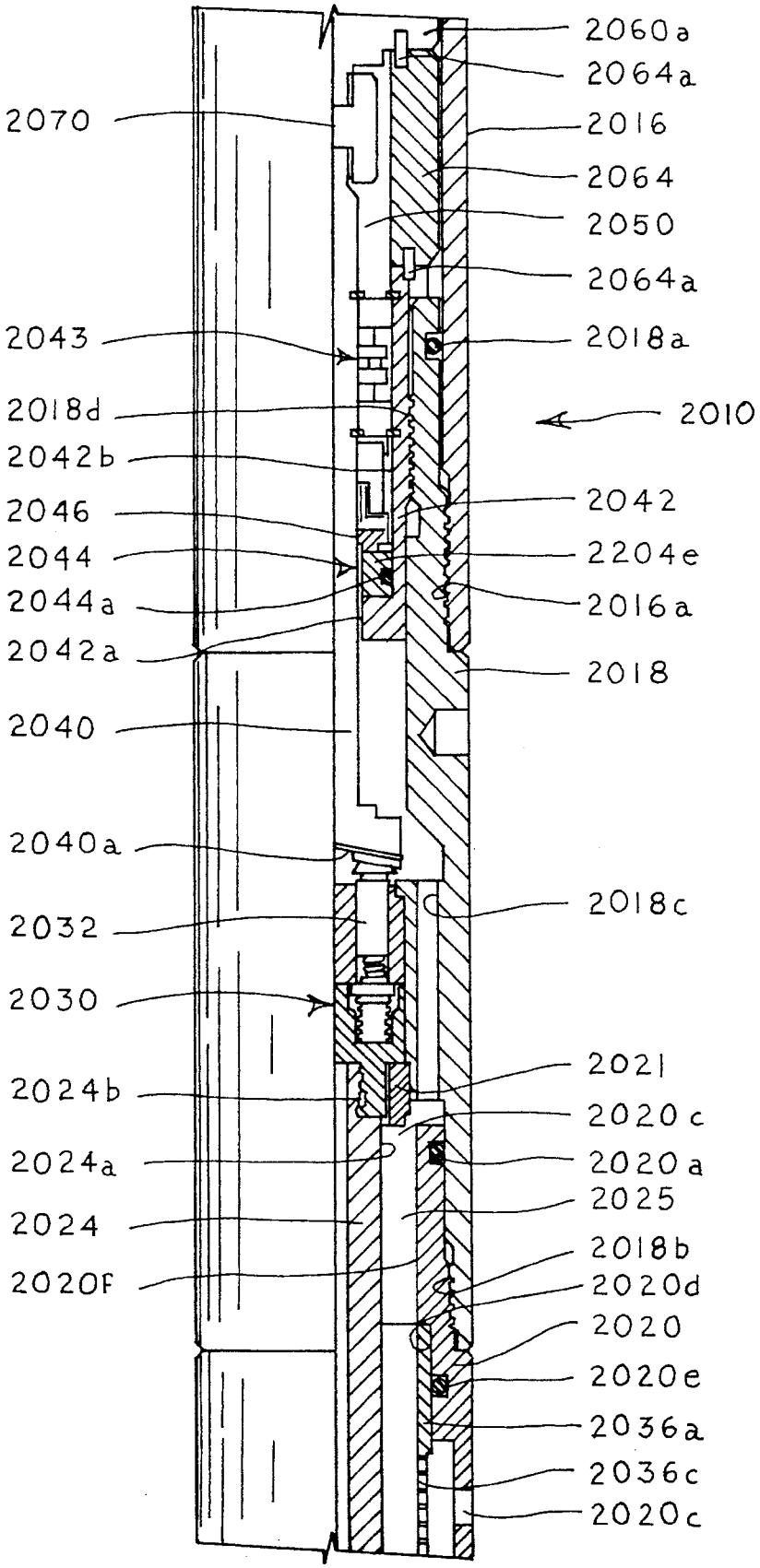
Figure 6D:
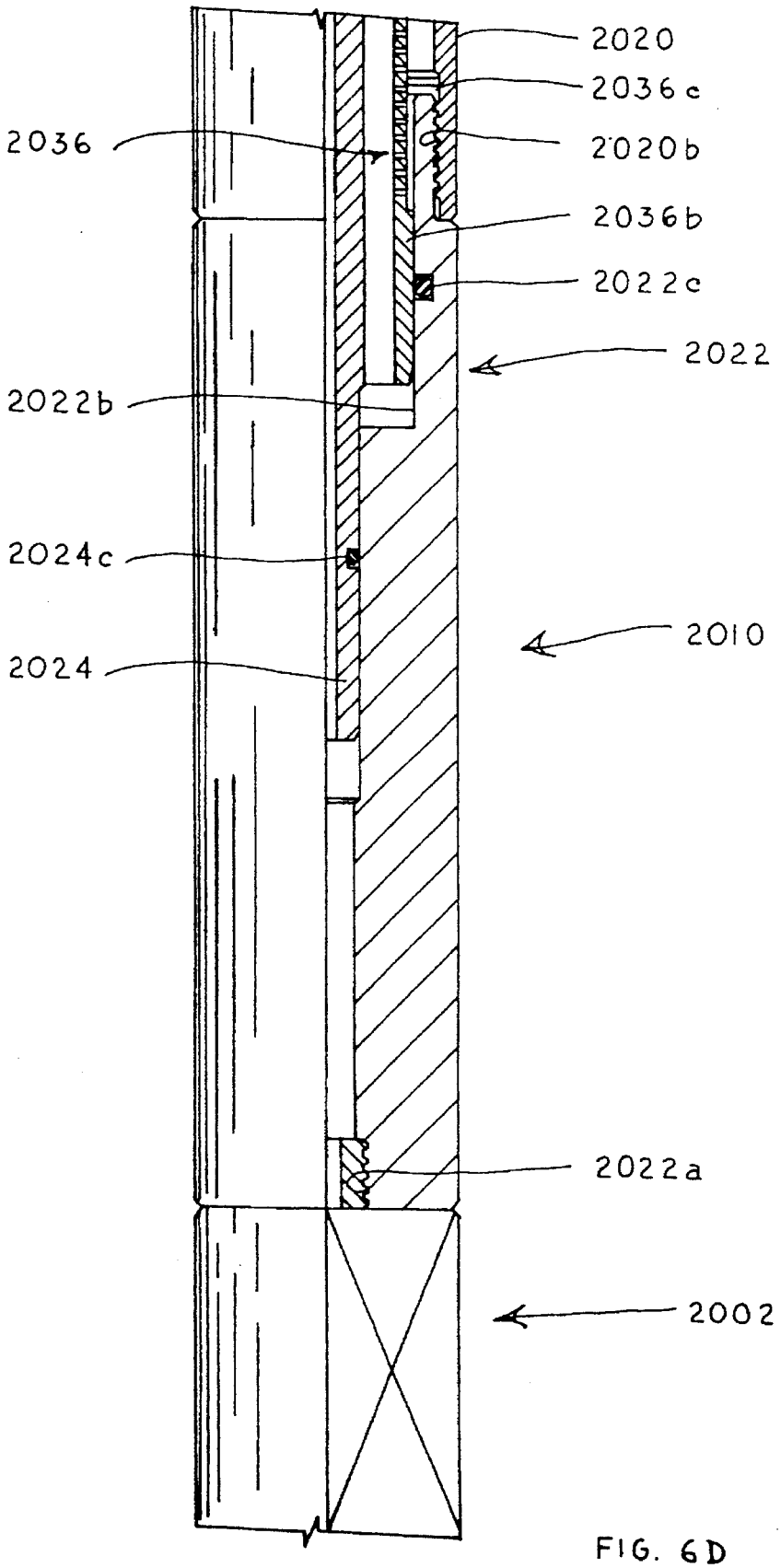

FIGS. 6A through 6C are one quarter longitudinal section views of wireline pump 2001, which is an earlier alternative embodiment of the preferred embodiment of wireline pump 2000 of the present invention. A few differences between this earlier alternative embodiment include that wireline pump 2001 does not include gear reduction 2047 a length of wire 2004 is used to electrically connect wireline 27 to pump motors 2060*d*, 2060*c*, 2060*b* and 2060*a*, and a different mechanical coupling arrangement is used between pump housings 2062*d*, 2062*c*, 2062*b* and 2062*a*.

PRESSURE EQUALIZING VALVE 3000

Figure 7:
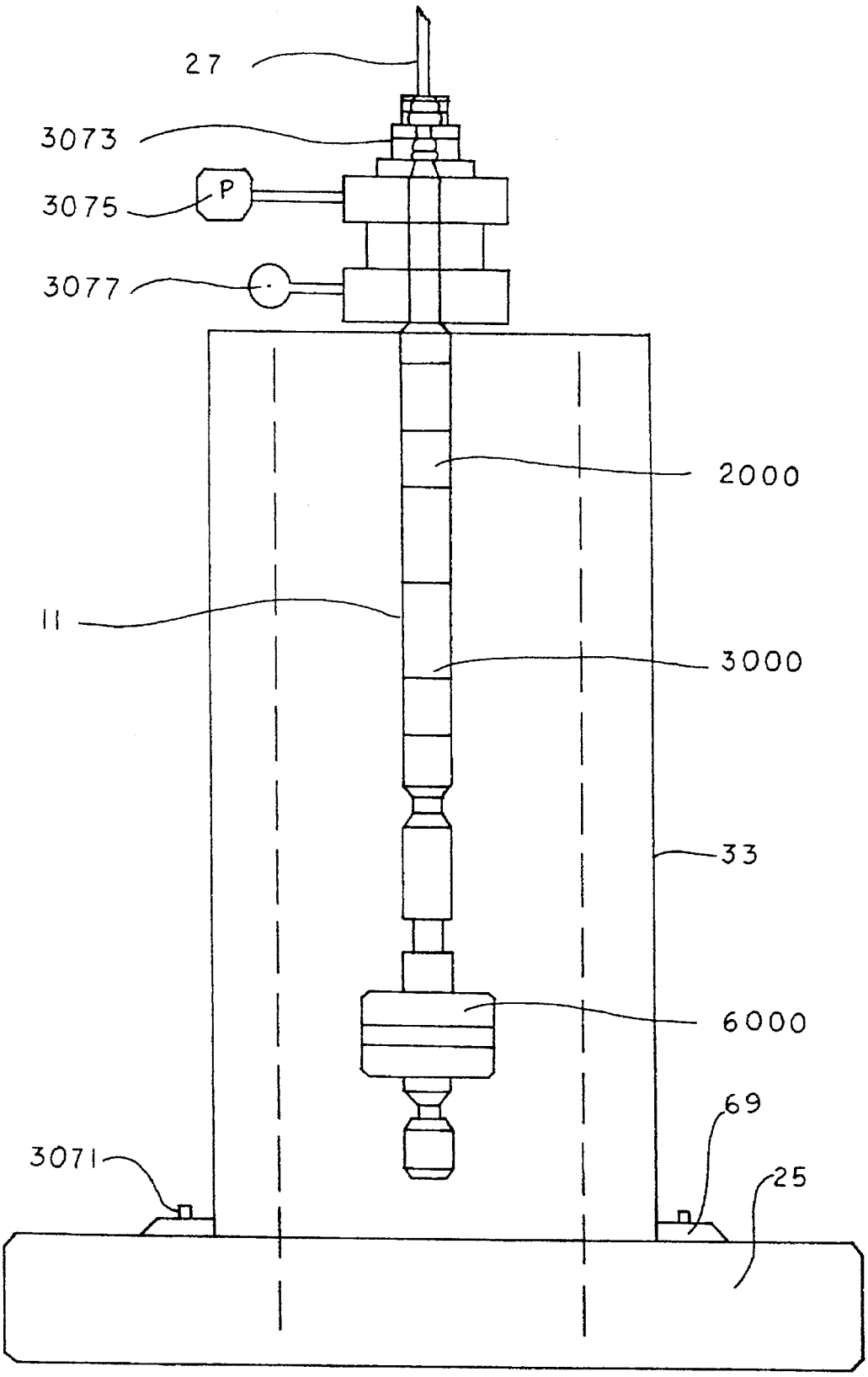
FIG. 7 is a simplified schematic view of a wireline lubricator during a pressure test mode of operation.

FIG. 7 is a simplified schematic view of lubricator 33 of FIG. 2 with wellbore tool string 11 (shown in simplified form) suspended by electric wireline cable 27 therein. Referring to FIG. 7, lubricator 33 is coupled at its lowermost end to blowout preventer 25, which is also shown in simplified form. Lubricator 33 is coupled by flange 69 to blowout preventer 25, with the interface being sealed by flange seal 3071. Blowout preventer 25 includes a well-head valve 25*v* (not shown) which allows for manual closure of blowout preventer 25. At the uppermost end of lubricator 33, wireline stripper 3073 provides a dynamic sealing engagement with electric wireline cable 27. Ports are also provided on lubricator 33 for selective coupling of pressurization means 3075 and gage 3077. Pressurization means 3075 may be coupled to lubricator 33 to allow for pressure testing of lubricator 33.

Figure 8A:
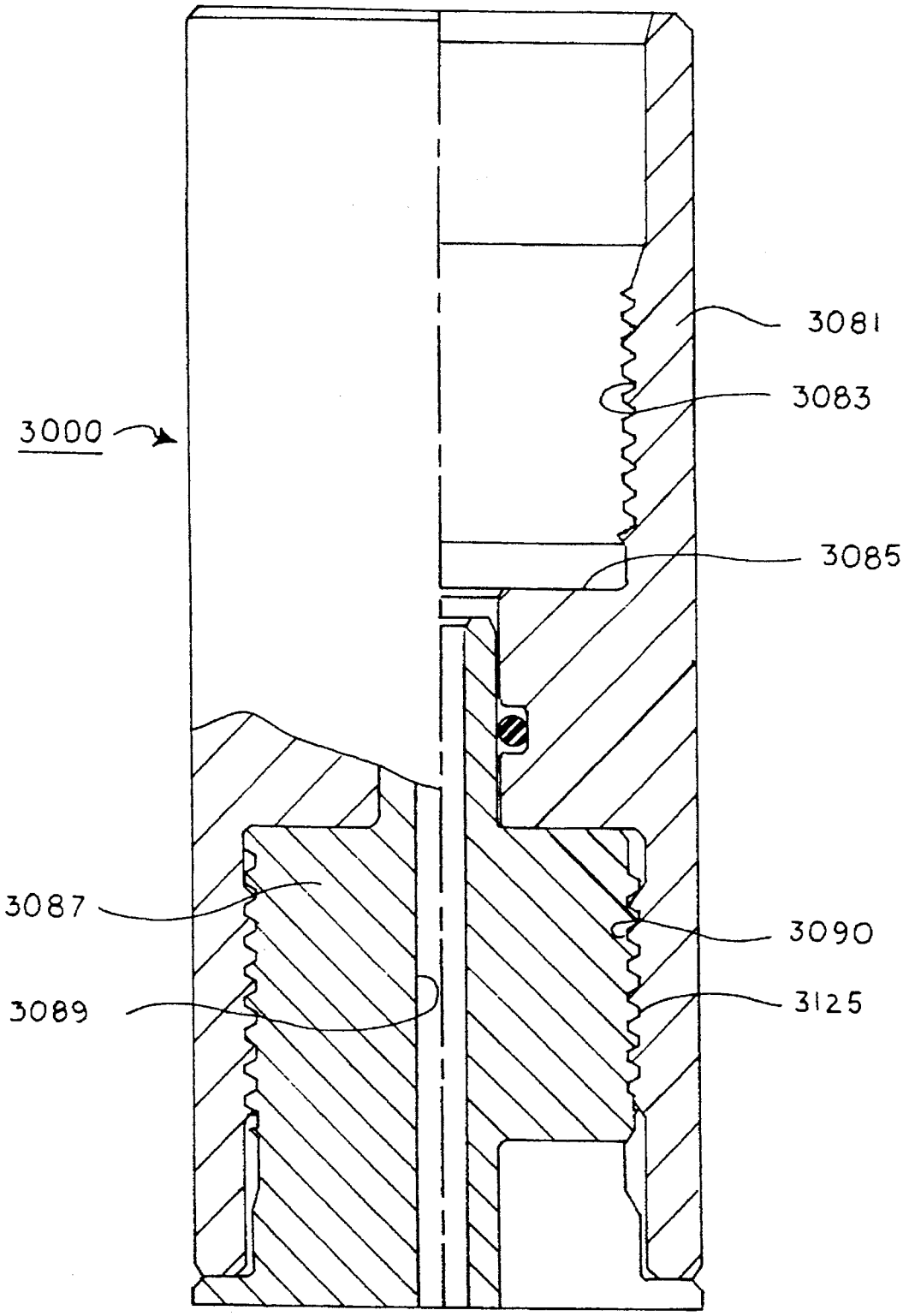
FIGS. 8A through 8E are fragmentary and one-quarter longitudinal section views of the preferred equalizing apparatus of the present invention.
Figure 8B:
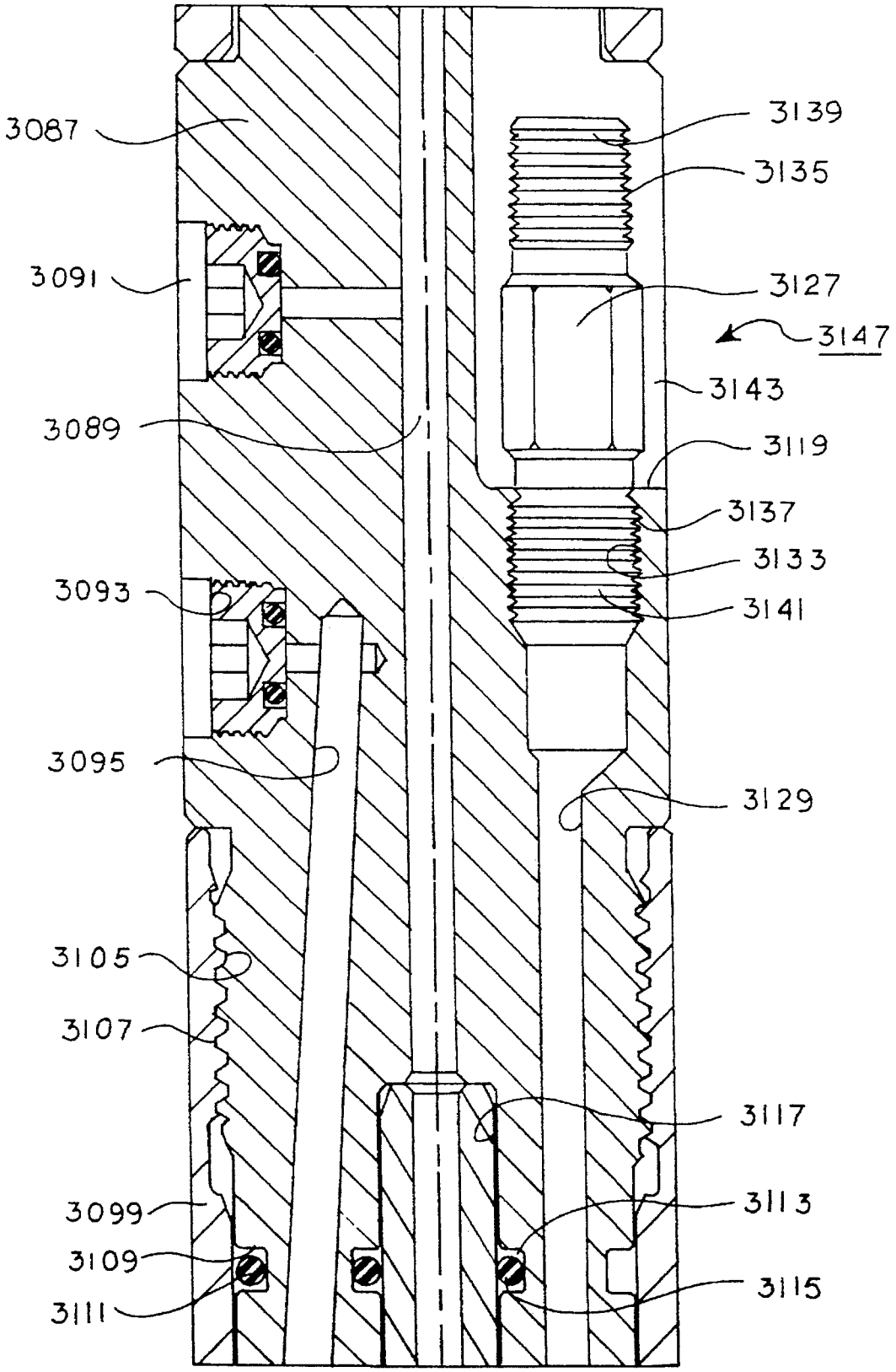
Figure 8C:
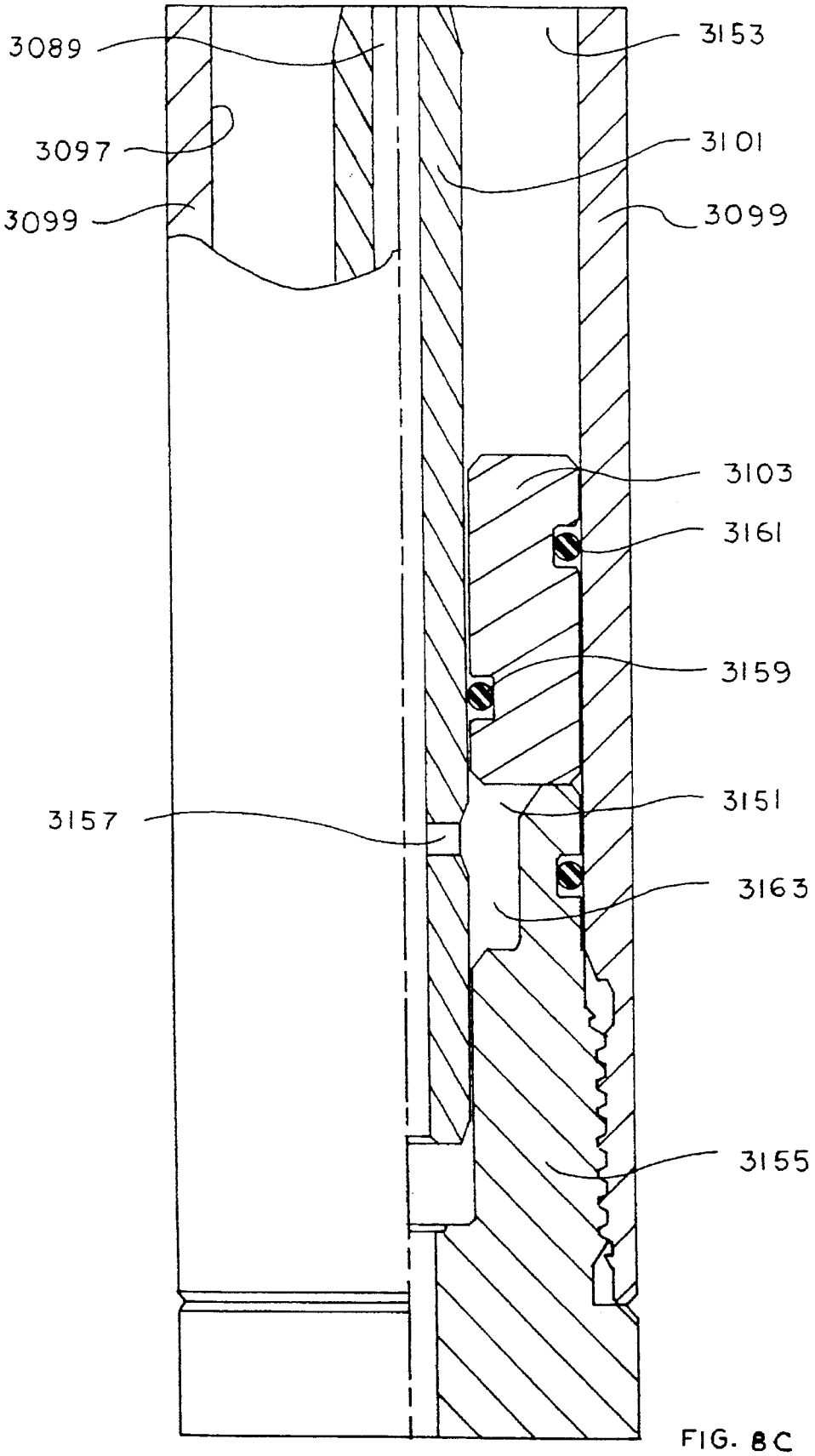
Figure 8D:
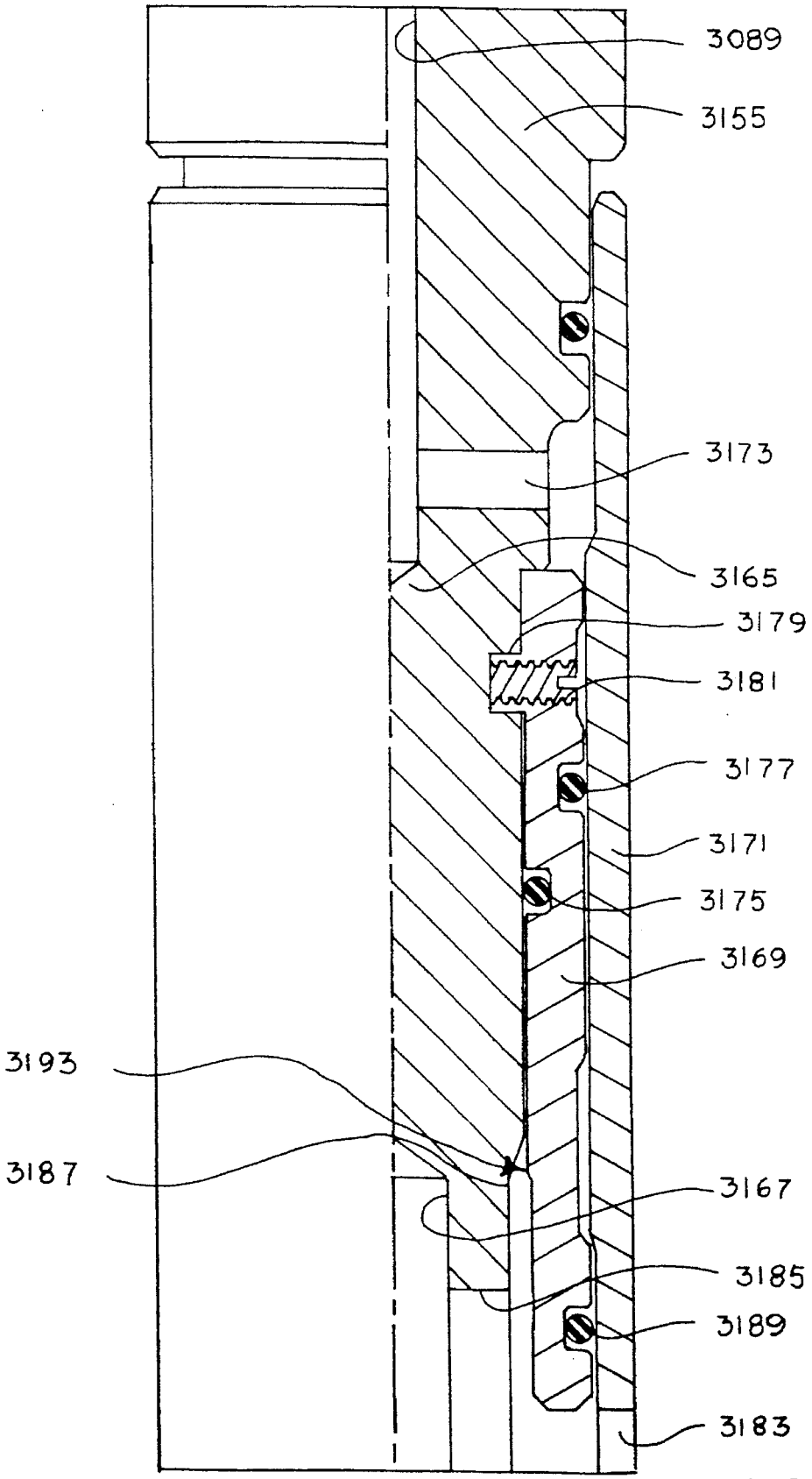
Figure 8E:
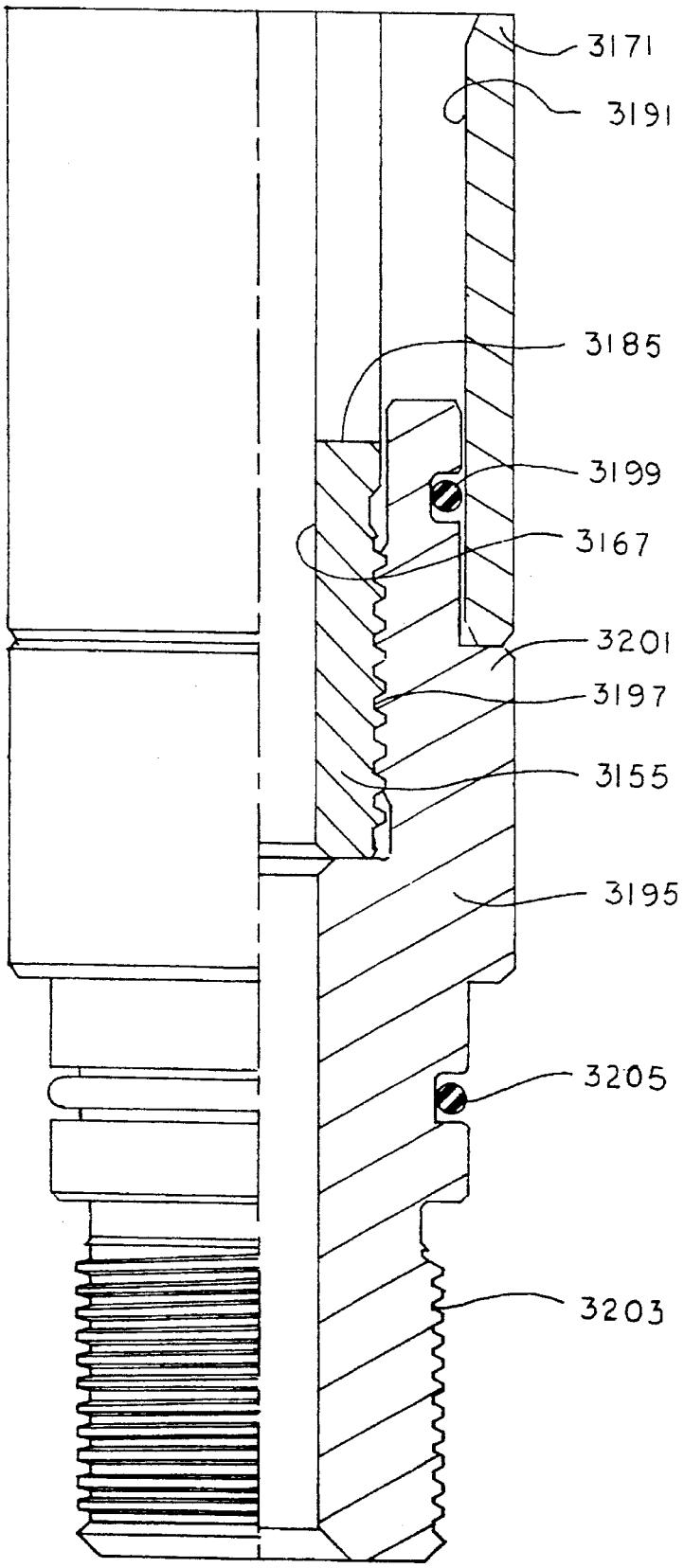

FIGS. 8A through 8E provide fragmentary and one-quarter longitudinal section views of portions of the preferred embodiment of pressure equalizing valve 3000 of the present invention, with FIG. 8A providing a view of the uppermost portion of equalizing valve 3000, and FIG. 8E providing a view of the lowermost portion of equalizing valve 3000, and with FIGS. 8B, 8C, and 8D providing intermediate views of equalizing valve 3000. FIGS. 8A through 8E can be read together from top to bottom to provide a complete view of the preferred equalizing subassembly 3000 of the present invention.

With reference first to FIG. 8A, upper collar 3081 includes internal threads 3083 and internal shoulder 3085, and defines a box-type connector for releasably coupling with the lowermost end of pump filter subassembly 2007. The lowermost end of upper collar 3081 includes internal threads 3090 which are adapted for releasably engaging external threads 3125 of central body 3087 which has a longitudinally extending central bore 3089 for communicating fluid between the output of wireline conveyed pump 2000 (not shown in FIG. 8A) and fluid-pressure actuable wellbore tool 6000 (not shown in FIG. 8A) disposed at the lowermost end of wellbore string 11 (not shown in FIG. 8A).

As is shown in FIG. 8B, central body 3087 includes a pressure relief port 3091, which allows the operator to bleed off the pressure within central bore 3089 of central body 3087 after the tool is retrieved from the wellbore. Central body 3087 further includes filling port 3093, which is a conventional valve which allows for selective access to fill conduit 3095, which allows the user to fill cavity 3097, shown in FIG. 8C, with a substantially incompressible fluid.

Preferably, cavity 3097 is annular shaped, and is defined in the region depicted in FIG. 8C between outer sleeve 3099 and inner sleeve 3101. Inner sleeve 3101 has central bore 3089 extending longitudinally therethrough. Referring to FIG. 8B, at the uppermost end of outer sleeve 3099, internal threads 3105 are provided for coupling with external threads 3107 at the lowermost end of central body 3087. Fill conduit 3095 extends downward from fill port 3093 substantially parallel with central bore 3089. O-ring cavity 3109 is provided at the lowermost portion of central body 3087 and is adapted for receiving O-ring seal 3111 which seals the interface of outer sleeve 3099 and central body 3087. The lowermost end of central body 3087 is also equipped with interior O-ring seal cavity 3113 which is adapted for receiving O-ring seal 3115, for providing a seal tight engagement between inner sleeve 3101 and central body 3087 at mating recess 3117 of central body 3087.

It should be noted that equalizing valve 3000 is not axially symmetrical in the portions depicted in FIGS. 8A and 8B. As shown in FIG. 8B, the right hand portion of equalizing valve 3000 includes valve cavity 3119 which is adapted for receiving pressure relief valve 3127. Valve cavity 3119 is semi-circular in cross-section view and is adapted for receiving pressure relief valve 3127 which includes upper and lower pin ends 3139, 3141, with external threads 3135, 3137. Lower end 3141 of pressure relief valve 3127 extends into the upper end of flow passage 3129 and mates with threaded cavity portion 3133. Pressure relief valve 3127 is adapted for remaining simultaneous fluid communication with flow passage 3129 and an exterior region 3147. Pressure relief valve 3127 is preferably set to move between a normally-closed operating position to an open position upon sensing pressure in the region of flow passage 3129 which exceeds one hundred and fifty (150) pounds per square inch. Of course, differing pressure relief valves can be selected to provide a pressure relief threshold which suits particular operating needs.

As is shown in FIG. 8C, piston member 3103 is disposed in the annular region of cavity 3097 at lower end 3151, in abutment with plug member 3155. Substantially incompressible fluid is disposed between piston member 3103 and upper end 3153 of cavity 3097. Piston member 3103 includes interior and exterior O-ring seals 3159, 3161 for respective engagement with the interior surface of outer sleeve 3099 and the exterior surface of inner sleeve 3101. In the running in the hole mode of operation, piston member 3103 is disposed at lower end 3151 of cavity 3097.

During the testing of lubricator 33, central bore 3089 is not in fluid communication with the interior of bridge plug 6000. As can be seen from FIG. 80, the central bore 3089 terminates at plug portion 3165 of plug member 3155. Central bore 3089 communicates with closure port 3173, which extends radially outward, and allows application of fluid pressure to the uppermost end of closure member 3169, which is disposed in the annular region between the lowermost portion of plug member 3155 and equalizing port sleeve 3171, and is an annular shaped sleeve. Interior and exterior O-ring seals 3175, 3177 are provided respectively on the interior and exterior surfaces of closure member 3169, and are adapted for dynamically and sealingly engaging respectively the exterior surface of plug member 3155 and the interior surface of equalizing port sleeve 3171.

Shear pin cavity 3179 is disposed on the exterior surface of plug member 3155, and is adapted for receiving threaded shear pin 3181. Preferably, threaded shear pin 3181 is adapted for shearing upon application of one thousand-five hundred (1,500) pounds per square inch of force upon the uppermost end of closure member 3169. During a running in the hole mode of operation, closure member 3169 is maintained in a fixed position relative to plug member 3155 by operation of threaded shear pin 3181. In this condition, passage of fluid is allowed between tool conduit 3167, which communicates with fluid-pressure-actuated wellbore tool 2000 (not shown in FIG. 8D), tool port 3185, and equalizing port 3183. While closure member 3169 is maintained in this position, no pressure differential will exist between the interior of fluid-pressure-actuated wellbore tool 2000 (not shown in FIG. 8D) and a region exterior of the tool.

The ideal volume for cavity 3097 can be determined by routine calculations using the ideal gas law which interrelates pressure and volume ($P_1V_1=P_2V_2$, at a constant temperature). More specifically, the maximum volume available for entrapment of gas is known, as is the maximum possible pressure level for the gas during testing of the lubricator 33 (as stated above, testing pressures extend up to ten thousand (10,000) pounds per square inch of pressure). The maximum permissible force level is also known, and corresponds to the force needed to shear threaded shear pin 3181 (which is preferably one thousand-five hundred (1,500) pounds of force) and the area of contact of closure member 3169 with the trapped gas. Simple calculations will yield the total volume needed for cavity 3097 to ensure that trapped gas never exerts a force on closure member 3169 which would cause an unintended shearing of threaded shear pin 3181. Access to cavity 3097 is triggered by application of a force from the gas which exceeds one hundred and fifty (150) pounds per square inch to the lowermost end of piston member 3103 and allows evacuation of incompressible fluid from cavity 3097 as gas fills cavity 3097.

FIG. 8E depicts lower collar 3195, and the threaded coupling 3197 between the lowermost end of plug member 3155, and lower collar 3195. FIG. 8E also depicts the sealing engagement between the uppermost end of lower collar 3195 and equalizing port sleeve 3171. As shown, lower collar 3195 forms external shoulder 3201 for receiving the lowermost end of equalizing port sleeve 3171. Furthermore, lower collar 3195 includes external threads 3203 and O-ring seal 3205 which are adapted for providing a threaded and sealing coupling with the uppermost end of pressure extender 4000 (not shown in FIG. 8E).

PRESSURE EXTENDER 4000

Figure 11A:
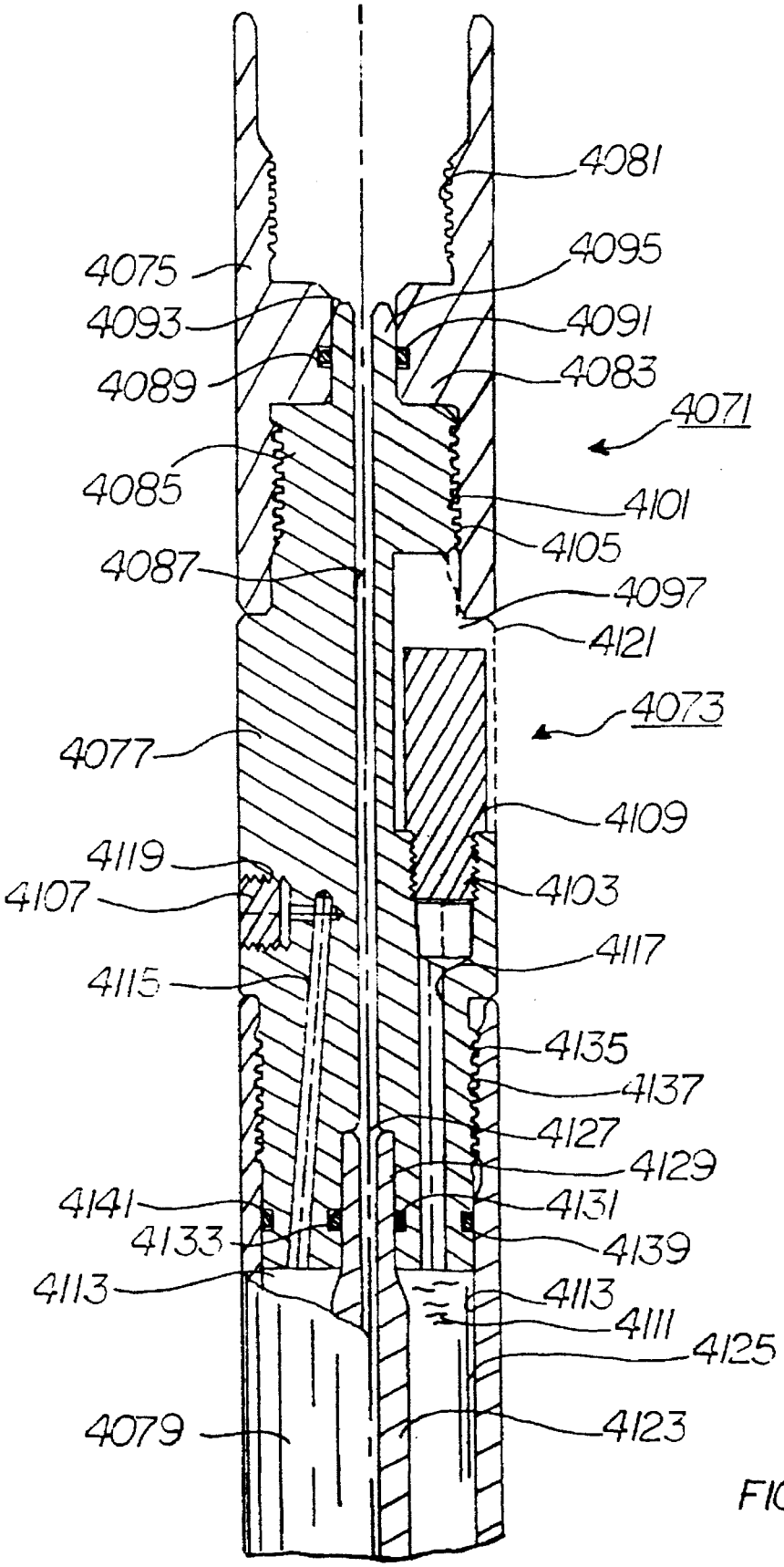
FIG. 11A is a fragmentary longitudinal section view of an upper region of the preferred pressurization-extending apparatus of the present invention, in an initial operating condition.
Figure 11B:
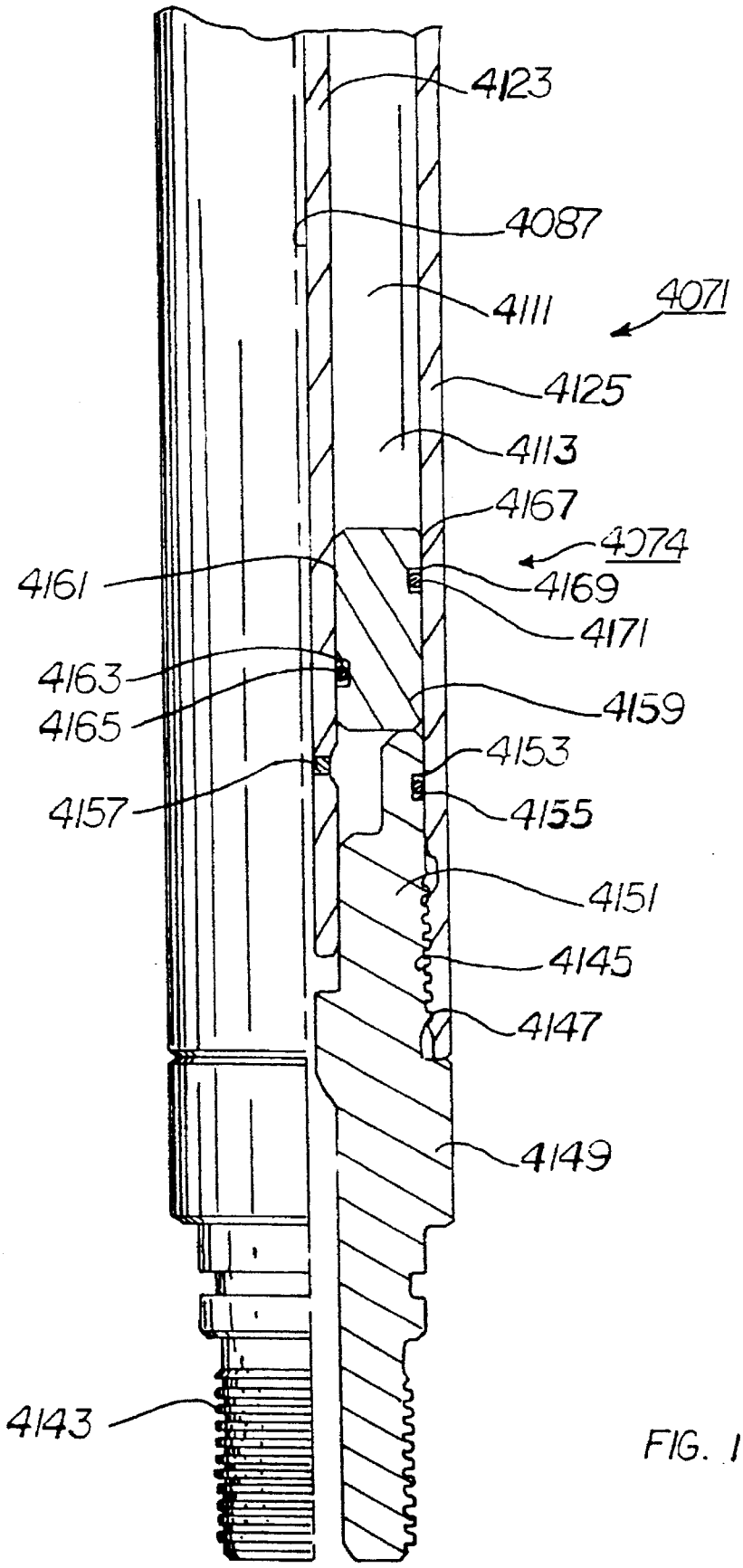
FIG. 11B is a one-quarter longitudinal section view of a lower region of the preferred pressurization-extending apparatus of the present invention, in an initial operating condition.
Figure 11C:
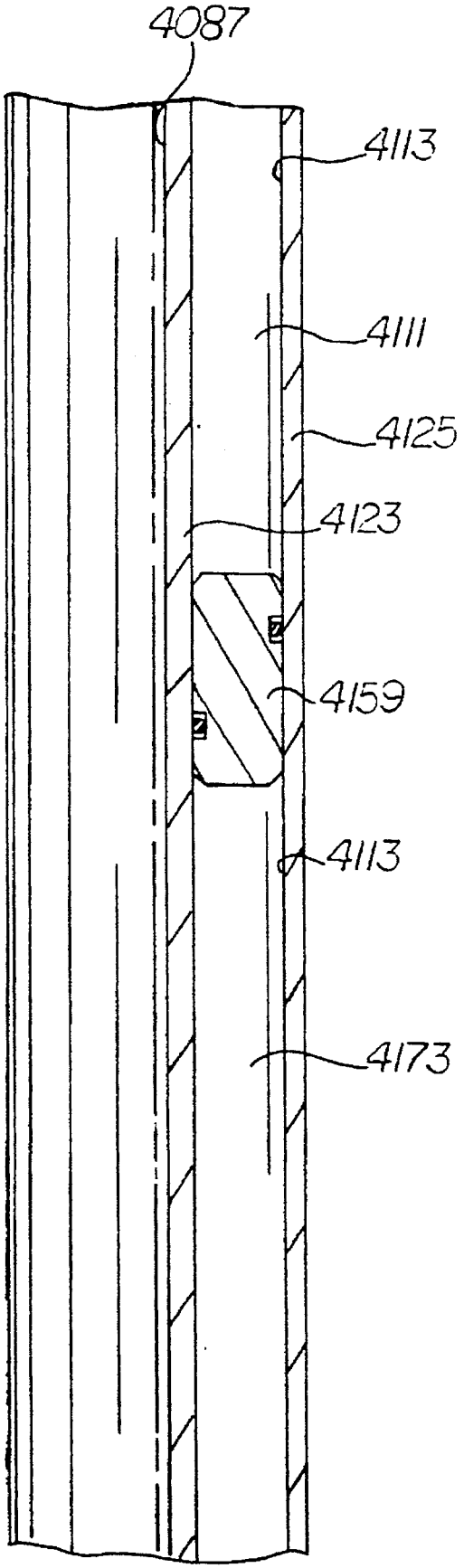
FIG. 11C is a one-quarter longitudinal section view of a middle-region of the preferred pressurization-extending device of the present invention, in an intermediate operating condition.
Figure 11D:
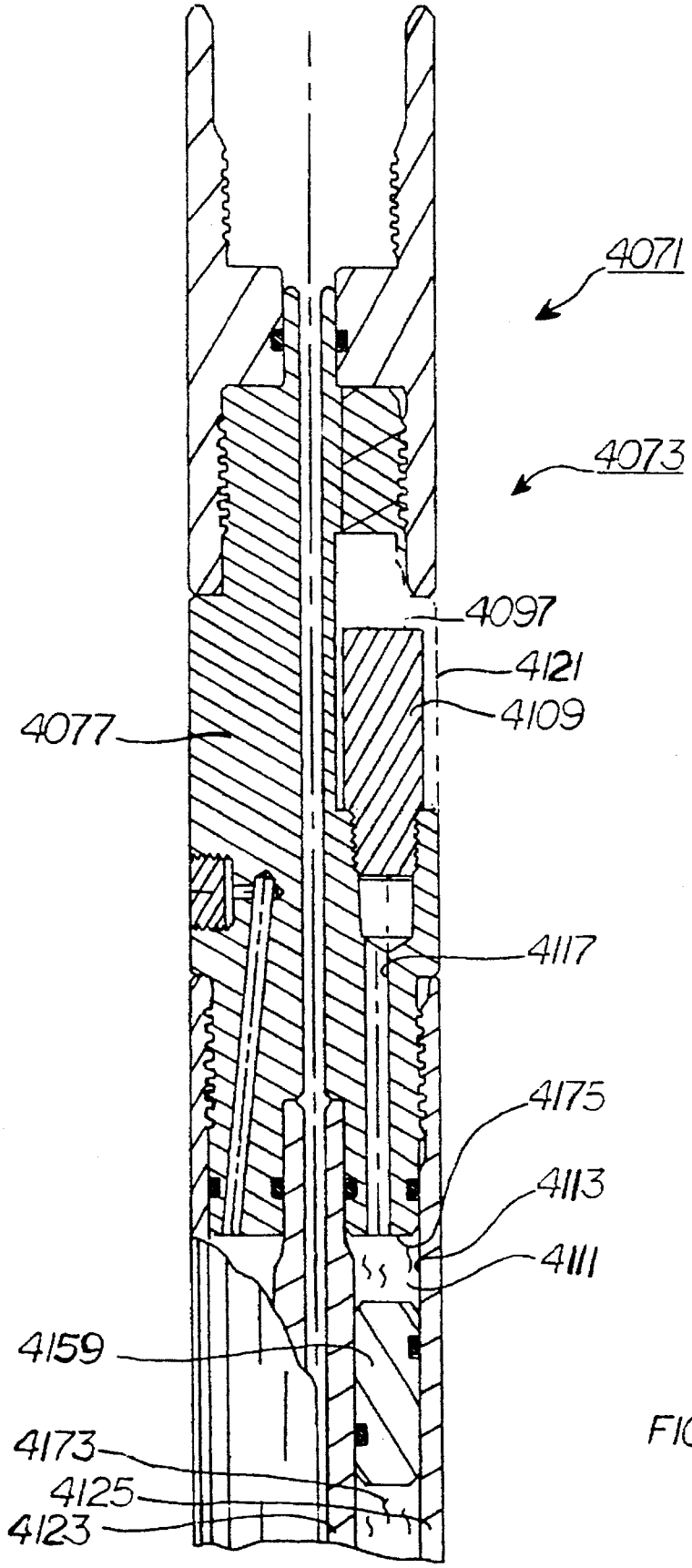
FIG. 11D is a fragmentary longitudinal section view of an upper region of the preferred pressurization-extending device of the present invention, in an intermediate operation condition.

The preferred embodiment of the pressurization-extending device of the present invention, pressure extender 4000, is depicted in FIGS. 11A through 11D. FIG. 11A is a fragmentary longitudinal section view of upper region 4073 of the pressurization-extending apparatus 4000 in an initial operating condition. FIG. 11B is a one-quarter longitudinal section of lower region of the preferred pressure extender 4000 in an initial operating condition. FIG. 11C is a one-quarter longitudinal section view cf the middle region of pressure extender 4000 in an intermediate operating condition. FIG. 11D is a full longitudinal section view of upper region 4073 of pressure extender 4000 in an intermediate operating condition.

FIG. 11A is a fragmentary longitudinal section view of upper region 4073 of the preferred embodiment of pressure extender 4000 of the present invention. At upper region 4073, pressure extender 4000 includes connector member 4075, valve member 4077, and central housing 4079 which are mated together. Connector member 4075 serves to couple pressure extender 4000 to pressure equalization valve 3000 (not shown in FIG. 11A), and includes internal threads 4081 for mating with external threads carried by equalization valve 3000 (not shown in FIG. 11A). Connector member 4075 also includes shoulder 4083, which is annular in shape, and which includes O-ring seal cavity 4089 which carries C-ring seal 4091. A central bore 4093 is defined by shoulder 4083, and is adapted to receive male end piece 4095 of valve member 4077. O-ring seal 4091 mates against the exterior surface of male end piece 4095. Shoulder 4083 serves to abut shoulder 4085 which is also carried by valve member 4077. Central bore 4087 is provided in valve member 4077, and is adapted to receive fluid from equalization valve 3000 (not shown in FIG. 11A) and direct it downward within pressure extender 4000.

The exterior surface of the upper portion of valve member 4077 has external threads which threadingly engage internal threads 4105 of connector member 4075. The central region of valve member 4077 has a horizontal slot 4097 milled into the side of valve member 4077, the exterior of slot 4097 being depicted by phantom line 4121. A pressure-actuated relief valve 4109 is carried in the horizontal slot 4097 of valve member 4077, and threadingly engages valve member 4077 at threads 4103. Valve member 4077 also has a fill port 4119 that is sealed by a fill port plug 4107. The fill port plug 4107 is exteriorly threaded, and engages internal threads in port 4119.

An annular cavity 4113 contains a "clean" filler fluid 4111, such as light oil kerosene. Fill port 4119 is in fluid communication with annular cavity 4113 by means of feed line 4115 through which filler fluid 4111 passes to fill annular cavity 4113 prior to running pressure extender 4000 into the wellbore.

Pressure-actuated release valve 4109 communicates with annular cavity 4113 through discharge line 4117. In the preferred embodiment, pressure-actuated release valve 4109 is comprised of a miniature pressure relief valve manufactured by Pneu-Hydro which is further identified by Model No. 404M4Q, and is available from Matfield Company an 11922 Cutten Road in Houston, Tex. Pressure-actuated release valve 4109 operates to vent fluid 4111 from annular cavity 4113 when a preselected pressure threshold is obtained within annular cavity 4113. The pressure relief valve 4109 vents the fluid 4111 to the exterior of the tool through ports which are not depicted in the figures.

Central housing 4079 includes inner annular member 4123 concentrically disposed within outer annular member 4125, defining annular cavity 4113 therebetween. Enlarged region 4127 of central bore 4087 of valve member 4077 operates to receive male end piece 4129 of inner annular member 4123, and includes O-ring seal cavity 4131 with O-ring seal 4133 disposed therein for mating against male end piece 4129.

Outer annular member 4125 is equipped with internal threads 4135, which engage external threads 4137 of the lower end of valve member 4077. O-ring cavity 4139 is provided on the exterior surface of valve member 4077 for receipt of O-ring seal 4141 which seals against the interior surface of outer annular member 4125.

FIG. 11B is a one-quarter longitudinal section view of lower region 4074 of pressurization-extending device, pressure extender 4000, of the present invention. As shown, lowermost end of pressure extender 4000 includes a collar member 4149 which has external threads 4143 for mating with pull-release disconnect 5000 (not shown in FIG. 11B). The lowermost end of pressurization-extending device 4000 is also equipped with external threads 4145 on collar member 4149 which mate with internal threads 4147 of outer annular member 4125. Collar member 4149 includes shoulder 4151 which is disposed between inner annular member 4123 and outer annular member 4125. O-ring seal cavity 4153 is provided in the exterior surface of collar member 4149, for receiving O-ring seal 4155, which seals against the interior surface of outer annular member 4125.

Port 4157 is provided through inner annular member 4123, and allows the communication of fluid from central bore 4087 into annular cavity 4113. Annular plug 4159 is provided in the space between inner annular member 4123 and outer annular member 4125. Inner surface 4161 of annular plug 4159 is adapted for interfacing with inner annular member 4123, and is equipped with O-ring seal cavity 4163, which carries O-ring seal 4165, which is adapted for sealingly engaging inner annular member 4123. Annular plug 4159 is also provided with outer surface 4167, which includes O-ring seal cavity 4169, which receives O-ring seal 4171, which serves to sealingly engage outer annular member 4125.

In other embodiments of the present invention, the pressurization-extending device 4000 can be adapted to provide a preselected and known time interval from the start of travel of annular plug 4159 to the finish of travel of annular plug 4159. The duration of the travel of annular plug 4159 is determined by the volume of annular cavity 4113, the surface area of annular plug 4159 which is exposed to the pressure differential, the capacity of the pump employed, the amount of frictional engagement between annular plug 4159 and inner and outer annular members 4123, 4125, the weight of annular plug 4159, and the length of inner and outer annular members 4123, 4125.

In the preferred embodiment cf the present Invention, inner annular member 4123 has an outer diameter of ⅝ inches, and outer annular member 4125 has an inner diameter of 1¾ inches. In the preferred embodiment, inner surface 4161, and outer surface 4167 of annular plug 4159 are 1½ inches long. Annular plug 4159 has a width which is sufficient to substantially occlude annular cavity 4113. The frictional engagement between annular plug 4159 and inner and outer annular members 4123, 4125 is minimal. The pump capacity of wireline pump 2000 is approximately 0.17 milliliters per minute. In the preferred embodiment, the distance traversed by annular plug 4159 is four feet. These values taken together establish a travel time of annular plug 4059 of approximately five minutes. Of course, using different geometries, and pumps, longer or shorter timer durations may be obtained.

PULL-RELEASE DISCONNECT 5000

Figure 13:
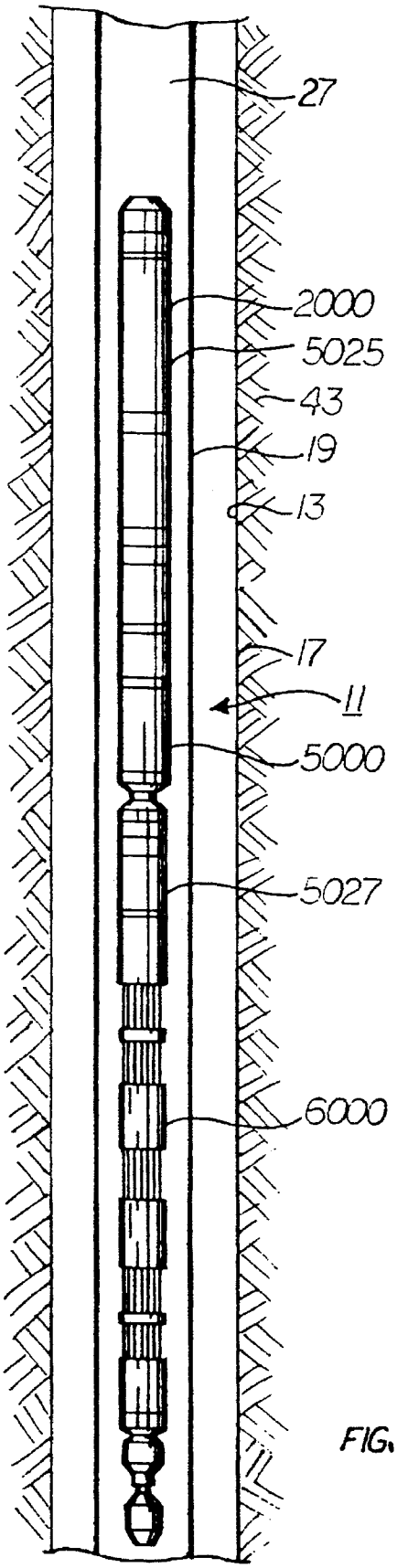
FIG. 13 is a view of the preferred pull-release disconnect of the present invention coupled in a setting tool string which includes a plurality of subassemblies, positioned within a string of tubular conduits disposed within a wellbore.

With reference to FIG. 13, the pull-release device of the present invention, pull-release disconnect 5000, is shown in a fragmentary view of wireline tool string 11. Pull-release disconnect 5000 selectively disconnects an upper retrievable portion 5025 of wireline setting tool string 11 from a lowered delivered portion 5027 of tool string 11. Pull-release to disconnect 5000 is especially adapted to serve as a back-up release device for a primary release device, hydraulic disconnect 67. In the event that hydraulic disconnect 67 fails to operate properly, pull-release disconnect 5000 may be actuated by alternative means to effectively separate upper retrievable portion 5025 from lower delivered portion 5027, allowing upper retrievable portion 5025 to be raised within wellbore 5017 D,, wireline 27.

Figure 14:
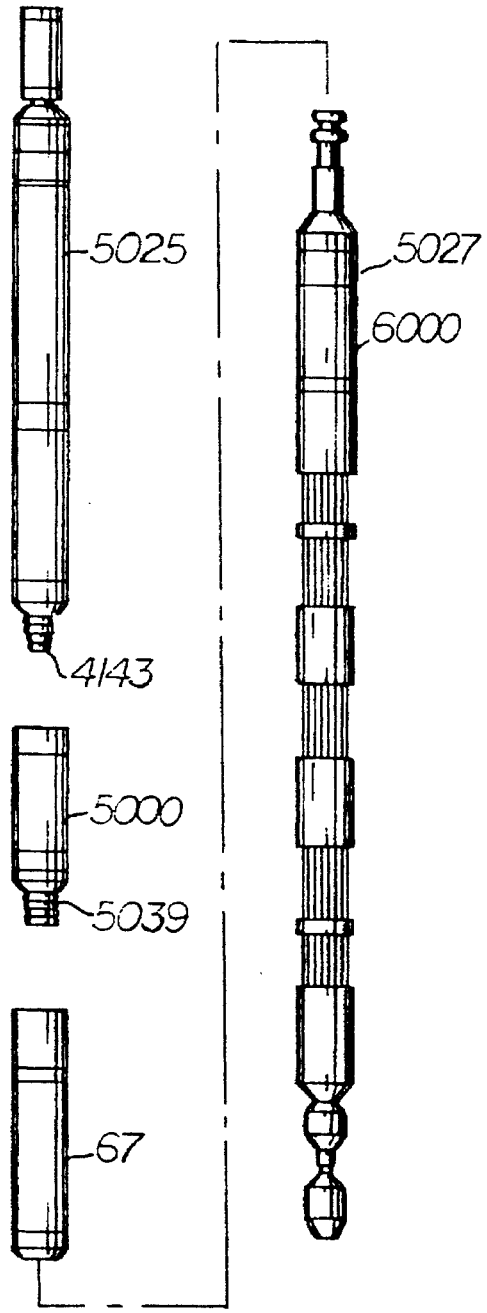
FIG. 14 is an exploded view of the setting tool string of FIG. 13; this figure facilitates discussion of the subassemblies which make up the setting tool string.

The view of FIG. 14 is an exploded view depicting a portion of setting tool string 11. The upper retrievable portion 5025 of setting tool string 1i comprises a through-tubing wellbore pump, wireline pump 2000. Preferably, the lower end of pull-release disconnect 5000 is externally threaded at external threads 5039 for coupling to the primary release device, hydraulic disconnect 67. Hydraulic disconnect 67 is, in turn, releasably coupled to lower delivered portion 5027 of tool string 11, which preferably comprises cross flow bridge plug 6000.

Figure 15:
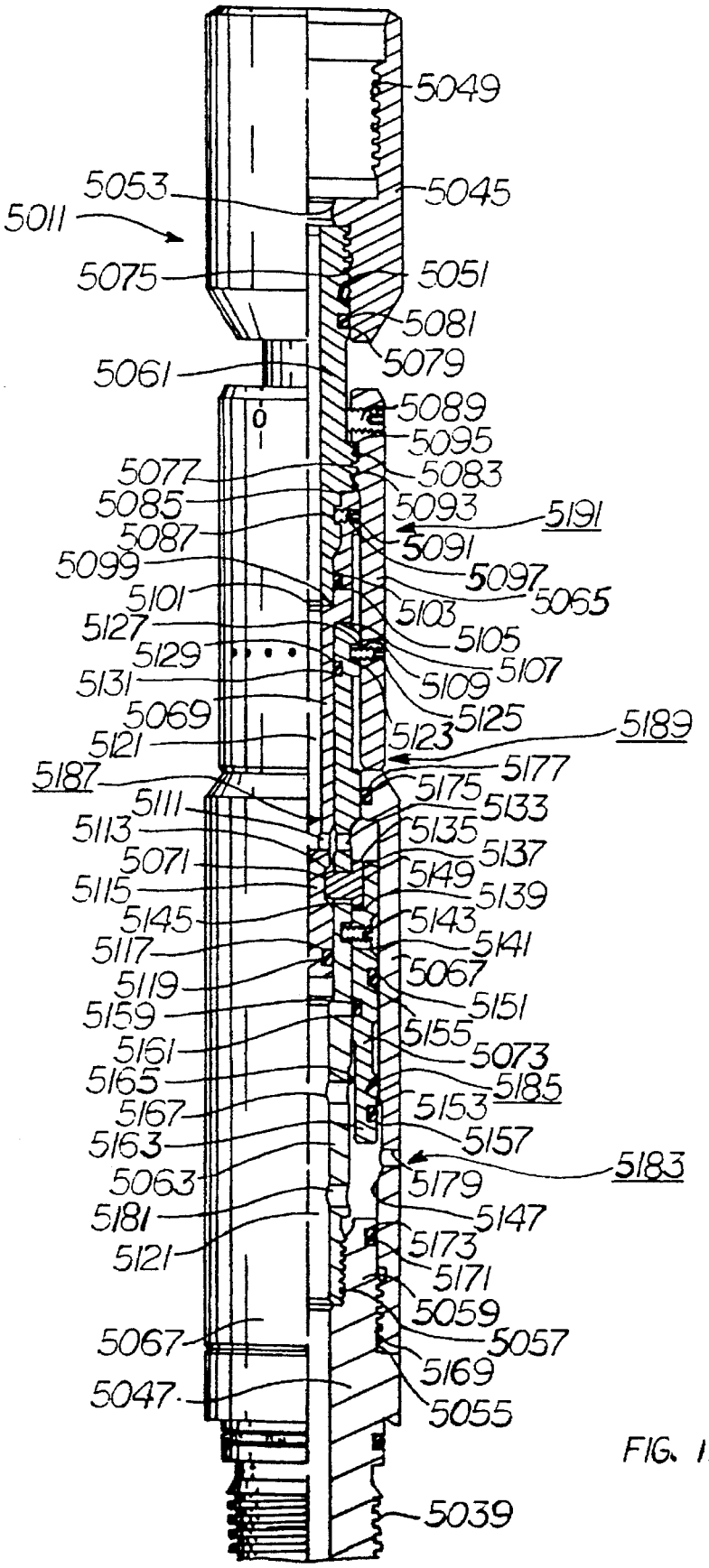
FIG. 15 is a one-quarter longitudinal section view of the preferred embodiment of the pull-release disconnect of the present invention.

FIG. 15 is a one-quarter longitudinal. section view of the preferred embodiment of pull-release release disconnect 5000 of the present invention. Full-release disconnect 5000 includes upper cylindrical collar 5045 for mating with external threads 4143 (shown in FIG. 14) on the lower end of the retrievable portion 5025 of wireline tool 11 (shown in FIG. 14), and lower cylindrical collar 5047 with external threads 5039 for mating with hydraulic disconnect 5067 (shown in FIG. 14).

Still referring to FIG. 14, upper cylindrical collar 5045 includes upper internal threads 5049 and lower internal threads 5051. Upper internal threads 5049 mate with external threads **2022*a* of through-tubing wireline pump 2000. Internal shoulder 5053 is disposed between lower internal threads 5051 and upper internal threads 5049. Lower cylindrical collar 5047 further includes external threads 5055 and internal threads 5057 disposed on opposite sides of shoulder 5059**.

The components which make-up pull-release disconnect 5000 are disposed between upper cylindrical collar 5045 and lower cylindrical collar 5047. Seven principal components cooperate together in the preferred embodiment of pull-release disconnect 5000 of the present invention, including: upper inner mandrel 5061, lower inner mandrel 5063, upper outer body piece 5065, lower outer body piece 5067, lock piece 5069, locking key 5071, and hydraulically-actuated slidable sleeve 5073. With the exception of locking key 5071, these principal components are cylindrical-shaped sleeves which are interconnected by threaded couplings, shearable connectors, set screws, shoulders, and seals, all of which will be described in detail below.

As shown in FIG. 15, upper inner mandrel 5061, and lower inner mandrel 5063 are disposed radially inward from upper outer body piece 5065, and lower outer body piece 5067. Lock piece 5069 is at least in-part disposed between upper and lower inner mandrels 5061, 5063 and upper and lower outer body pieces 5065, 5067. Lock piece 5069 is adapted for selectively engaging locking key 5071. Locking key 5071 is held in position by hydraulically-actuated slidable sleeve 5073 until pressurized wellbore fluid causes hydraulically-actuated slidable sleeve 5073 to move downward relative to lower inner mandrel 5063 and lower outer body piece 5067.

Upper inner mandrel 5061 includes external threads 5075, 5077 which are located at its upper end and mid region respectively. External threads 5075 serve to mate with internal threads 5051 of upper cylindrical collar 5045. External threads 5077 serve to mate with internal threads 5093 of upper outer body piece 5065. The exterior surface of upper inner mandrel 5061 is also equipped with seal cavity 5079 which retains O-ring seal 5081 at an interface with upper cylindrical collar 5045.

The outer surface of upper inner mandrel 5061 is also equipped with external shoulder 5083 and internal shoulder 5085. External shoulder 5083 is adapted for mating with internal shoulder 5095 of upper outer bcdy piece 5065 above the threaded coupling of external threads 5077 and internal threads 5093.

Set screw 5089 extends through, and is threadingly engaged with, the upper end of upper outer body piece 5065 directly above the threaded coupling of external threads 5077 and internal threads 5093. Set screw 5089 abuts the outer surface of upper inner mandrel 5061. Shear connector cavity 5087 is disposed directly below internal shoulder 5085 of upper inner mandrel 5061, and is adapted to receive a shearable connector 5091 which is carried by connector cavity 5097 which extends through the upper end of lock piece 5069. Shearable connector 5091 engages lock piece 5069, and secures it to upper inner mandrel 5061.

Accordingly, an upper portion of lock piece 5069 is disposed between upper inner mandrel 5061 and upper outer body piece 5065. Lock piece 5069 further includes internal shoulder 5099 which receives lower end 5101 of upper inner mandrel 5061. Lock piece 5069 further includes seal cavity 5103 which retains O-ring seal 5105 in sealing engagement with the outer surface of the lower end 5101 of upper inner mandrel 5061. Internal shoulder 5107 is disposed on the outer surface of lock piece 5069 in a position slightly below internal shoulder 5099 which is disposed on the interior surface of lock piece 5069. Internal shoulder 5107 is adapted to receive the upper end 5109 of lower inner mandrel 5063.

Lock piece 5069 terminates at its lower end in plug 5115, which is enlarged to obstruct the flow of fluid directly downward through pull-release disconnect 5000. Plug 5115 has an exterior surface which mates with the interior surface of lower inner mandrel 5063, and is sealed by O-ring 5119 which is carried in seal cavity 5117.

Bypass port 5111 is disposed directly above plug 5115, and is adapted for receiving fluid which is directed downward through central fluid conduit 5121 and directing it radially outward through lock piece 5069. Lock piece 5069 further includes lock groove 5113 which is adapted to receive locking key 5071.

Lower inner mandrel 5063 is disposed in-part at its upper end between lock piece 5069 radially inward and upper and lower outer body pieces 5065, 5067 radially outward. Lower inner mandrel 5063 includes shear connector cavity 5123 which is disposed on its outer surface at its upper end, which is adapted for receiving shearable connector 5125 which mates in connector cavity 5127 which extends radially through upper outer body piece 5065 and releasably couples upper outer body piece 5065 to lower inner mandrel 5063. Seal cavity 5129 is disposed on the inner surface of lower inner mandrel 5063, radially inward from shear connector cavity 5123. Seal cavity 5129 is adapted for receiving O-ring seal 5131, and sealingly engaging the outer surface of lock piece 5069.

Lower inner mandrel 5063 also includes bypass port 5133 which is in alignment with bypass port 5111 of lock piece 5069. Lower inner mandrel 5063 further includes key cavity 5135. Locking key 5071 extends radially inward through key cavity 5135 to seal in lock groove 5113 of lock piece 5069. Locking key 5071 includes stops 5137, 5139, which prevent locking key 5071 from passing completely through key cavity 5135, Lower inner mandrel 5063 further includes shearable connector cavity 5141 which is adapted for receiving shearable connector 5143 which extends through connector cavity 5145 to couple hydraulically-actuated shearable sleeve 5073 to lower inner mandrel 5063 in a fixed position between lower inner mandrel 5063 and lower outer body piece 5067, Hydraulically actuated slidable sleeve 5073 resides within bypass cavity 5147 which is a space defined by lower inner mandrel 5063 and lower outer body piece 5067. At its upper end, hydraulically-actuated slidable sleeve 5073 includes key retaining segment 5149 which is adapted to fit between locking key 5071 and lower outer body piece 5067, to hold .locking key 5071 in place.

Hydraulically-actuated slidable sleeve 5073 further includes upper and lower O-ring seals 5151, 5153 on its exterior surface, in upper and lower seal chambers 5155, 5157. O-ring seal 5159 is carried on the inner surface of hydraulically-actuated slidable sleeve 5073 in seal chamber 5161. The interfacing inner surface of hydraulically-actuated slidable sleeve 5073 and outer surface of lower inner mandrel 5063 are undercut at undercut regions 5163, 5165, respectively, ensuring that o-ring seal 5159 is not in a sealing engagement with the exterior surface of lower inner mandrel 5063 when hydraulically-actuated slidable sleeve 5073 is urged downward within bypass cavity 5147 in response to the passage of high pressure wellbore fluid through central fluid conduit 5121, bypass port 5111, and bypass port 5113. Accordingly, high pressure wellbore fluid will flow between the inner surface of hydraulically-actuated slidable sleeve 5073 and the outer surface of lower inner mandrel 5063. The high pressure fluid will reenter central fluid conduit 5121 through conduit port 5167, which serves to communicate fluid between bypass cavity 5147 and central fluid conduit 5121, when hydraulically-actuated slidable sleeve 5073 is moved downward.

Lower outer body piece 5067 is connected to external threads 5065 of lower cylindrical collar 5047 by internal threads 5169. Lower cylindrical collar 5047 sealingly engages lower outer body piece 5067 at O-ring seal 5171 which is carried in seal chamber 5173 on the outer surface of lower cylindrical collar 5047. At its upper end, lower outer body piece 5067 includes O-ring seal 5175 which is carried in seal chamber 5177 which is disposed on the interior surface of lower outer body piece 5067 and sealingly engages lower inner mandrel 5063.

Lower outer body piece 5067 abuts the lower end of upper outer body piece 5065. Together, upper and lower outer body pieces 5065, 5067 serve to provide an outer protective housing for pull-release disconnect 5000. Lower outer body piece 5067 is further equipped with pressure equalization port 5179 which serves to communicate fluid between bypass cavity 5147 and the exterior of pull-release disconnect 5000. When pull-release disconnect 5000 is disposed in a wellbore, pressure equalization port 5179 serves to communicate wellbore fluid between wellbore 5017 and bypass cavity 5147. A similar pressure equalization port 5181 is provided in lower inner mandrel 5063, in approximate alignment with pressure equalization port 5179. Pressure equalization port 5181 serves to communicate wellbore fluid between bypass cavity 5147 and central fluid conduit 5121. Wellbore fluid may only be communicated between wellbore 5017 and central fluid conduit 5121 when hydraulically-actuated slidable sleeve 5073 is in its upward position. When hydraulically-actuated slidable sleeve 5073 is urged downward by pressurized wellbore fluid, upper and lower O-ring seals 5151, 5153 serve to straddle pressure equalization port 5179 and prevent the passage of wellbore fluid between wellbore 5017 and central fluid conduit 5121.

Pull-release disconnect 5000 of FIG. 15 will now be described in more general, functional terms. For purposes cf exposition, it can be considered that a fluid conduit is defined by central fluid conduit 5121, bypass port 5111, bypass port 5133, bypass cavity 5147, and conduit port 5167. This fluid conduit serves to receive pressurized wellbore fluid from a means of pressurizing wellbore fluid, and direct the pressurized wellbore fluid to a fluid-actuated wellbore tool, such as an inflatable packing device.

Further, it can be considered that pressure equalization port 5179, bypass cavity 5147, and pressure equalization port 5181 cooperate to equalize pressure between the central fluid conduit during a running in the hole mode when hydraulically-actuated slidable sleeve 5073 is in an upward position.

Hydraulically-actuated slidable sleeve 5073 can be considered as a valve means 5185, operable in open and closed positions, which is responsive to pressurized wellbore fluid from a means of pressurizing fluid, for closing a vent means 5183 to prevent communication of wellbore fluid from a central fluid conduit to wellbore 13.

Shearable connector 5125, connector cavity 5127, and shear connector cavity 5123, which couple upper outer body piece 5065 to lock piece 5069, can be considered as a first latch means 5189, operable in latched and unlatched positions, for mechanically linking a means of pressurizing fluid to a fluid-actuated wellbore tool. First latch means 5189 unlatches the means of pressurizing fluid from the fluid-actuated wellbore tool in response to axial force, of a first preselected magnitude, applied through wireline 27 or similar suspension means. This is true because shearable connector 5125 is adapted to shear loose at a preselected axial force level. In the preferred embodiment, a plurality of shearable connectors are disposed between upper outer body piece 5065 and lock piece 5069. The magnitude of the upward force required to shear shearable connector 5125 may be determined in advance by selection cf the number, cross-sectional area, and material of shearable connector 5125, and similar connectors.

Likewise, shearable connector 5091, and cooperating shear connector cavity 5087, and connected lock piece 5069 and upper inner mandrel 5061 can be considered a second latch means 5191 which is operable in latched and unlatched positions, for mechanically linking a means of pressurizing fluid to a fluid-actuated wellbore tool. Second latch means 5191 unlatches the means of pressurizing fluid from the fluid-actuated wellbore tool in response to axial (upward) force, of a second preselected magnitude greater than the first preselected magnitude, which is applied through wireline 27 or similar suspension means. Once again, shearable connector 5091 may comprise a plurality of radially disposed shearable connectors of selected number, cross-sectional area, and material, to set the level of the upward force cf second preselected magnitude.

Lock piece 5069, locking key 5071, and related lock groove 5113, and key cavity 5135, as well as key retaining segment 5149 of hydraulically-actuated slidable sleeve 5073 can be considered as a lock means 5087 which is operable in locked and unlocked positions, for preventing, when in the locked position, the first latch means from unlatching until pressurized fluid is supplied from a means of pressurizing fluid to the central fluid conduit at a preselected pressure level.

Fluid-actuated slidable sleeve 5073 may be considered a valve means 5185. When the preselected pressure level is obtained, shearable connector 5143 shears, and fluid-actuated slidable sleeve 5073 is urged downward in bypass cavity 5147 to close vent means 5183 and allow passage of wellbore fluid around plug 5115, through bypass cavity 5147, and to simultaneously prevent the passage of pressurized wellbore fluid outward into wellbore 13 (shown in FIG. 13) through pressure equalization port 5179.

CROSS FLOW BRIDGE PLUG 6000

Figure 20:
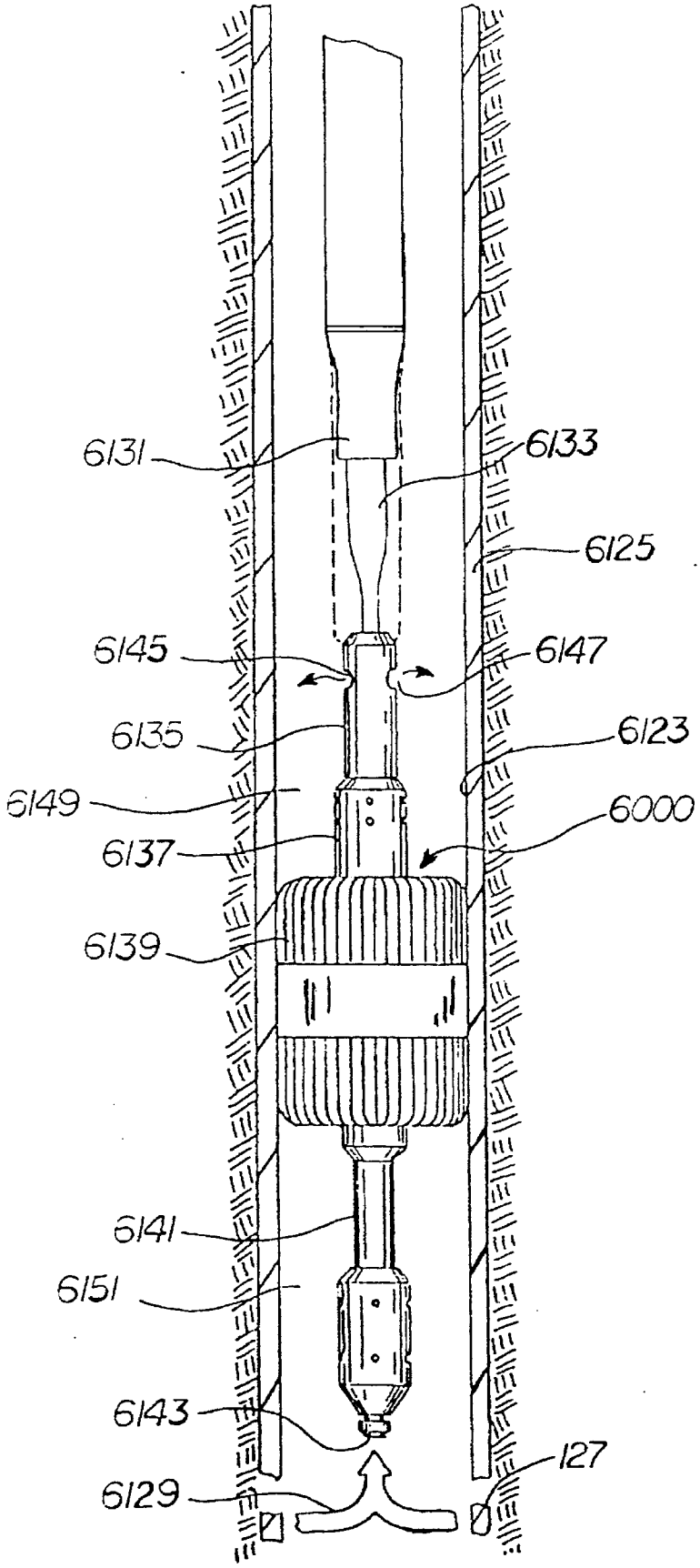
FIG. 20 is a perspective view of one embodiment of the improved settable wellbore tool of the present invention disposed in a cased wellbore.

Referring to FIG. 20, the preferred embodiment of the fluid-actuable, settable wellbore tool, cross flow bridge plug 6000, is releasably coupled to releasable connector 6131, which is shown in phantom and corresponds to disconnect 5000. Settable wellbore tool 6000 includes fishing neck 6131 which facilitates retrieval at a later date.

Cross flow bridge plus 6000 is a fluidactuated settable wellbore tool which includes a number of subassemblies which couple together and cooperate to achieve the purposes of the present invention. Of course, fishing neck assembly 6133 allows for selective coupling with other components. Fishing neck assembly 6133 is shown in longitudinal section view in FIG. 21A. With reference to FIG. 20, valving subassembly 6135 includes the preferred valving components of the present invention, and is coupled to the lower end of fishing neck assembly 6133. Valving subassembly 6135 is shown in longitudinal section view in FIG. 21B. Still referring to FIG. 20, poppet valve subassembly 6137 is coupled to the lowermost portion of valving subassembly 6135, and includes conventional valving which is used to direct high pressure fluid into fluid-inflatable packer 6139, which is a fluid-actuated wellbore tool that is included as a subassembly of bridge plug 6000. Popper valve assembly 6137 is shown in partial longitudinal section view in FIG. 21C.

In FIG. 20, the fluid-actuated wellbore tool 6000 of the present invention is shown to be a bridge plug, but could be any other type of wellbore tool which is actuated by fluid pressure. A bridge plug is depicted in FIG. 20 and discussed in this specification as being representative of other fluid-actuated settable wellbore tools, including actuated inflatable packers.

Guide subassembly 6141 is disposed beneath fluid-inflatable packer 6139. Guide assembly is shown in partial longitudinal section view in FIGS. 21D and 21E. Guide subassembly 6141 differs from other, prior art, guide subassemblies in that it includes port 6143 at its lowermost end which operates to receive and discharge wellbore fluids. Port 6143 is in communication with ports 6145, 6147 of valving subassembly 6135. Ports 6143, 6145, and 6147 are connected together to allow the passage of fluid between upper region 6149 and lower region 6151.

Therefore, if a pressure differential exists across fluid-inflatable packer 6139, fluid will pass between ports 6143, 6145, 6147 to lessen the differential. If upper region 6149 has a pressure which is lower than that found at lower region 6151, fluid will flow from port 6143 to ports 6145, 6147. Conversely, if pressure at upper region 6149 is higher than that found at lower region 6151, fluid will flow from ports 6145, 6147 to port 6143. Preferably, in the present invention, the communication of fluid between ports 6143, 6145, 6147 only occurs during specific operating intervals. In particular, communication between ports 6143, 6145, and 6147 is discontinued once fluid-inflatable packer 6139 has achieved a setting condition of operation, and is in gripping engagement with casing 6125 of wellbore 6123.

Figure 21A:
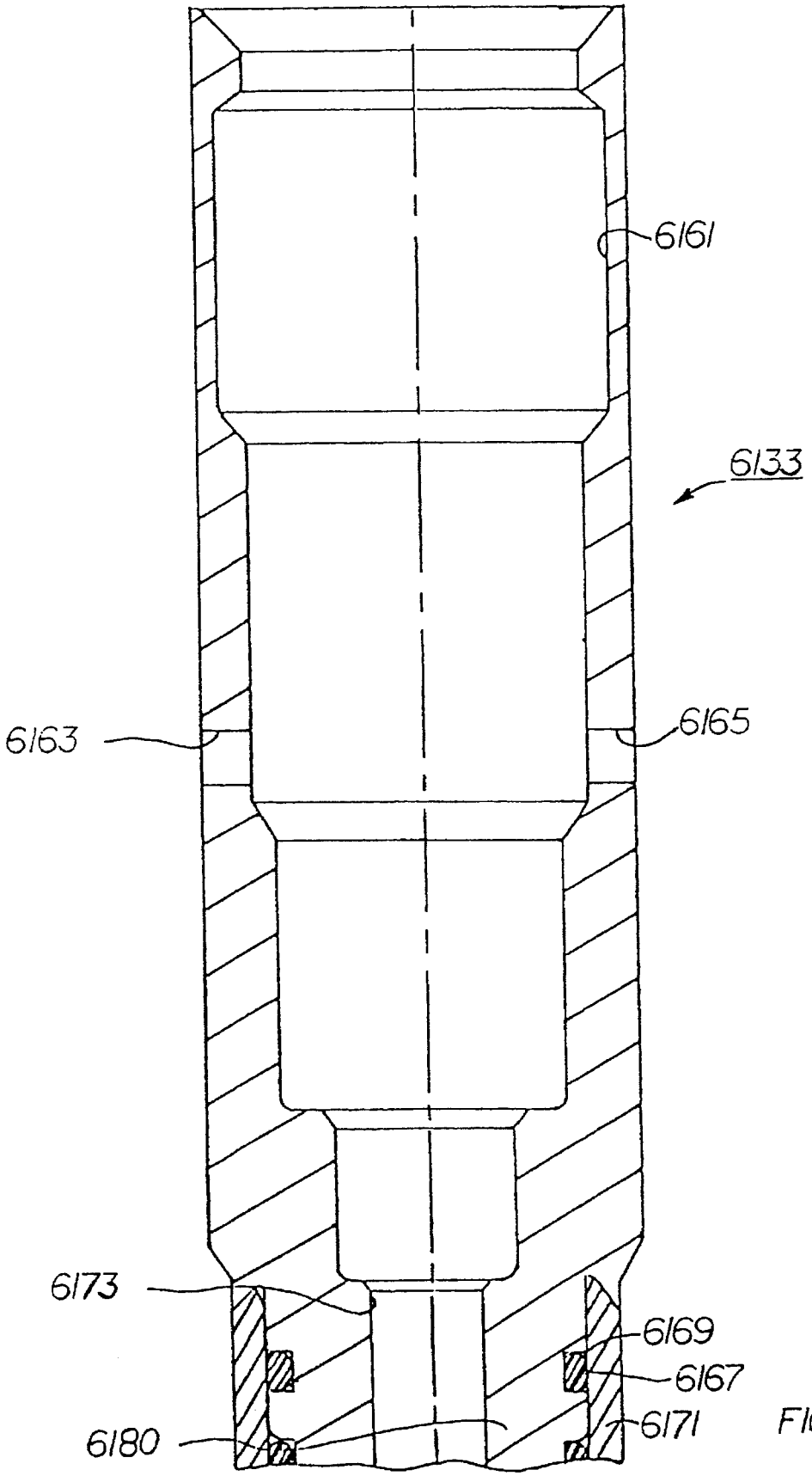
FIG. 21A is a longitudinal section view of an upper fishing-neck subassembly of the preferred settable wellbore tool of the present invention.

FIG. 21A is a longitudinal section view of fishing neck assembly 6133 of the preferred settable wellbore tool of the present invention. As shown, fishing neck assembly 6133 includes fishing neck profile 6161 which is adapted for receiving a fishing tool. Vent ports 6163, 6165 are provided in fishing neck assembly 6133 to facilitate connection of fishing neck assembly 6133 with a fishing tool. Preferably O-ring seal 6167 is provided in O-ring seal cavity 6169 at the lower end of fishing neck assembly 6133, at the interface of outer housing 6171 of valve subassembly 6135. Central bore 6173 is defined within fishing neck assembly 6133, and is adapted for directing pressurized fluid downward into valving subassembly 6135.

Figure 21B:
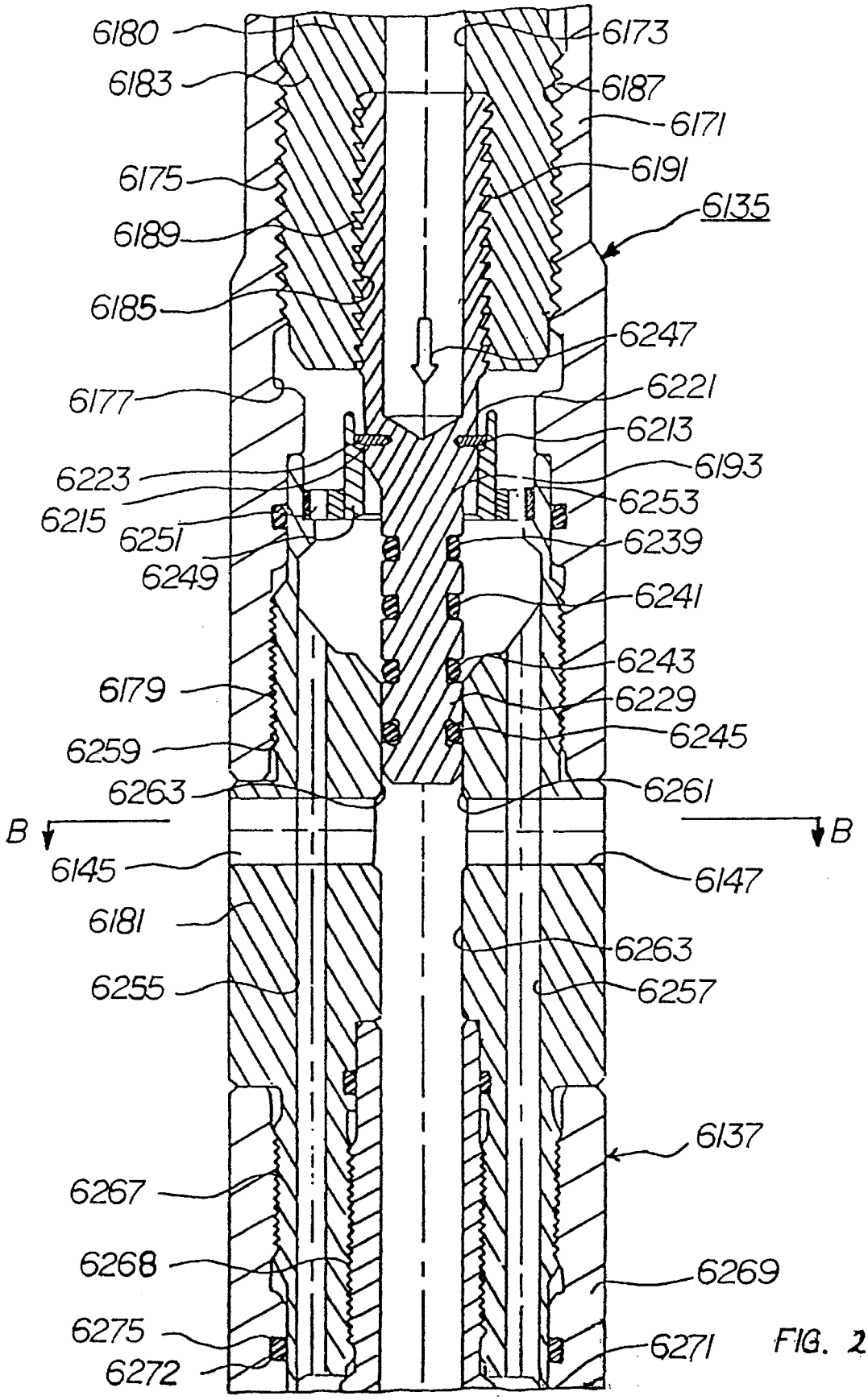
FIG. 21B is a longitudinal section view of the preferred valving subassembly of the preferred settable wellbore tool of the present invention.

Cross flow bridge plug 6000 continues on FIG. 2lB, which is a longitudinal section view of the preferred valving subassembly 6135. As shown in FIG. 21B, outer housing 6171 of valving subassembly 6135 includes upper internal threads 6175, and lower internal threads 6179. Central cavity 6177 is disposed within outer housing 6171. The material which forms fish neck assembly 6133 terminates at end piece 6180, which is disposed within central bore 6173 of valve subassembly 6135. End piece 6180 includes external threads 6187 which mate with upper internal threads 6175 of outer housing 6171. Of course, central bore 6173 extends through end piece 6180.

End piece 6180 serves as a stationary ratchet piece 6183, which receives movable ratchet piece 6185. Internal ratchet teeth 6189 are provided in a recessed region of central bore 6173, and are adapted for releasably engaging external ratchet teeth 6191 of movable valve stem 6193.

Figures 23A, 23B, 23C:
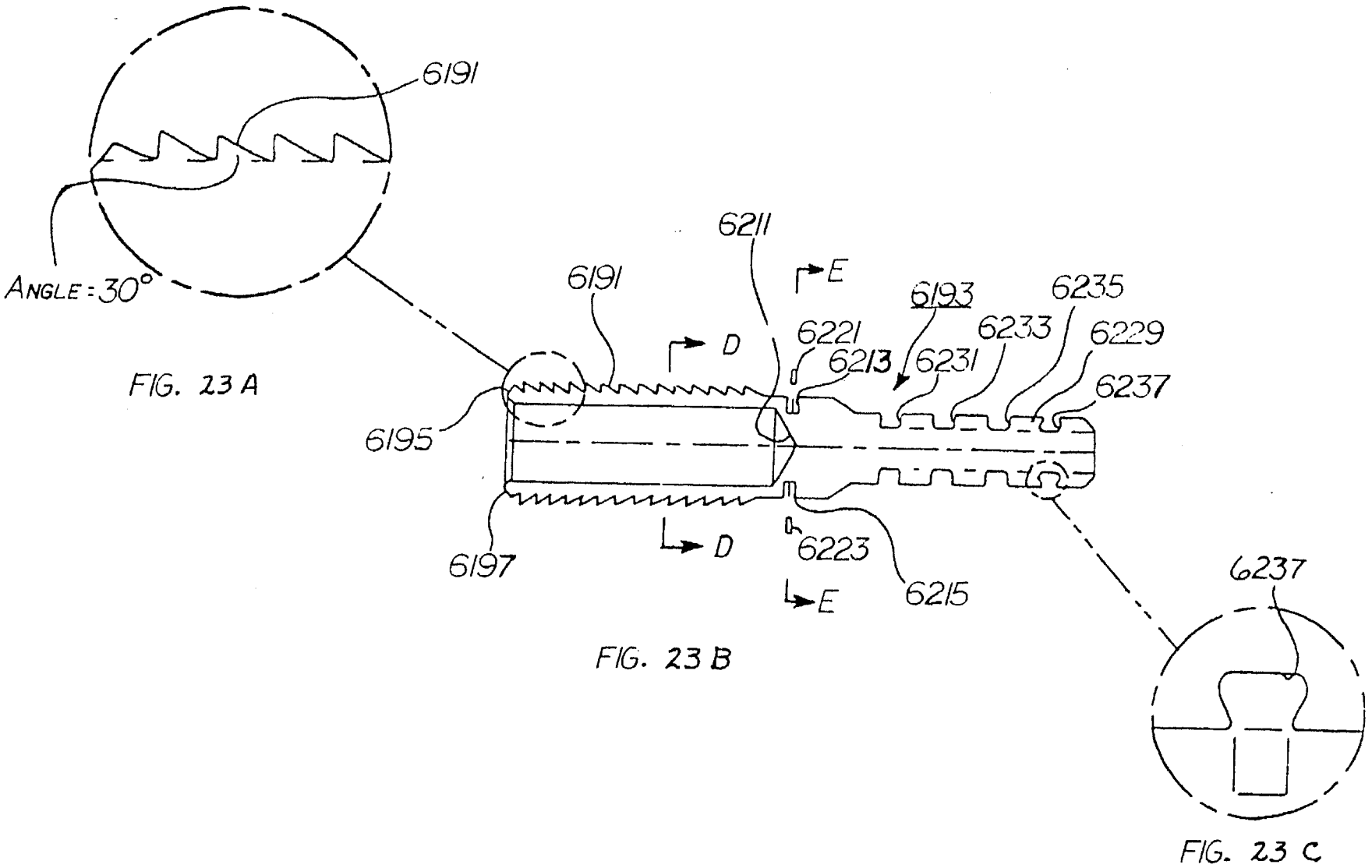
FIGS. 23A, 23B, and 23C depict, in cross-section, the preferred valve stem of the preferred settable wellbore tool of the present invention.
Figure 23D:
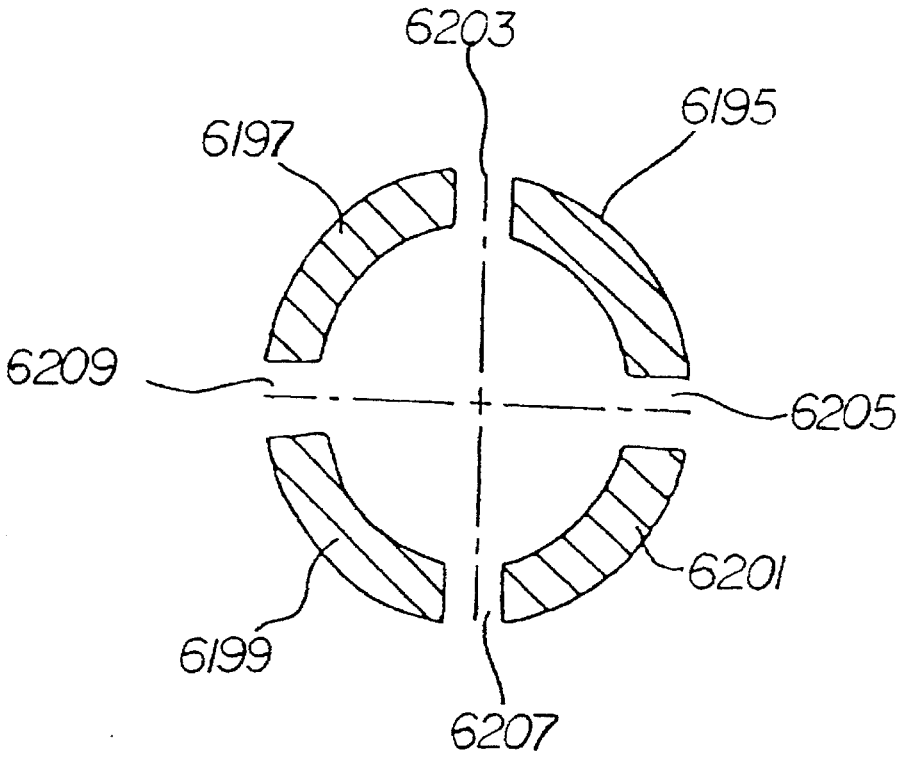
FIGS. 23D and 23E are cross-section views of the preferred valve stem of the preferred settable wellbore tool of the present invention, as seen along section lines D—D, and E—E, respectively, of Figure 23B.

FIG. 23B depicts movable valve stem 6193 detached from the remainder of valving subassembly 6135. As shown, movable valve stem 6193 includes external ratchet teeth 6191 which are disposed at thirty degrees from normal, as shown in FIG. 23A. External ratchet teeth 6191 are disposed on four "finger-like" collets 6195, 6197, 6199, 6201. Collets 6195, 6197 are shown in the view of FIG. 23B. FIG. 23D is a cross-section view of movable valve stem 6193 as seen along lines D-D of FIG. 23B. In this view, collets 6199, 6201 are also visible. As shown, the collets are semi-cylindrical in shape, and are separated by gaps 6203, 6205, 6207, 6209. Gaps 6203, 6205, 6207, 6209 allow collets 6195, 6197, 6199, 06201 to flex slightly radially inward in response to downward pressure exerted upon end 6211 of movable valve stem 6193.

Figure 22:
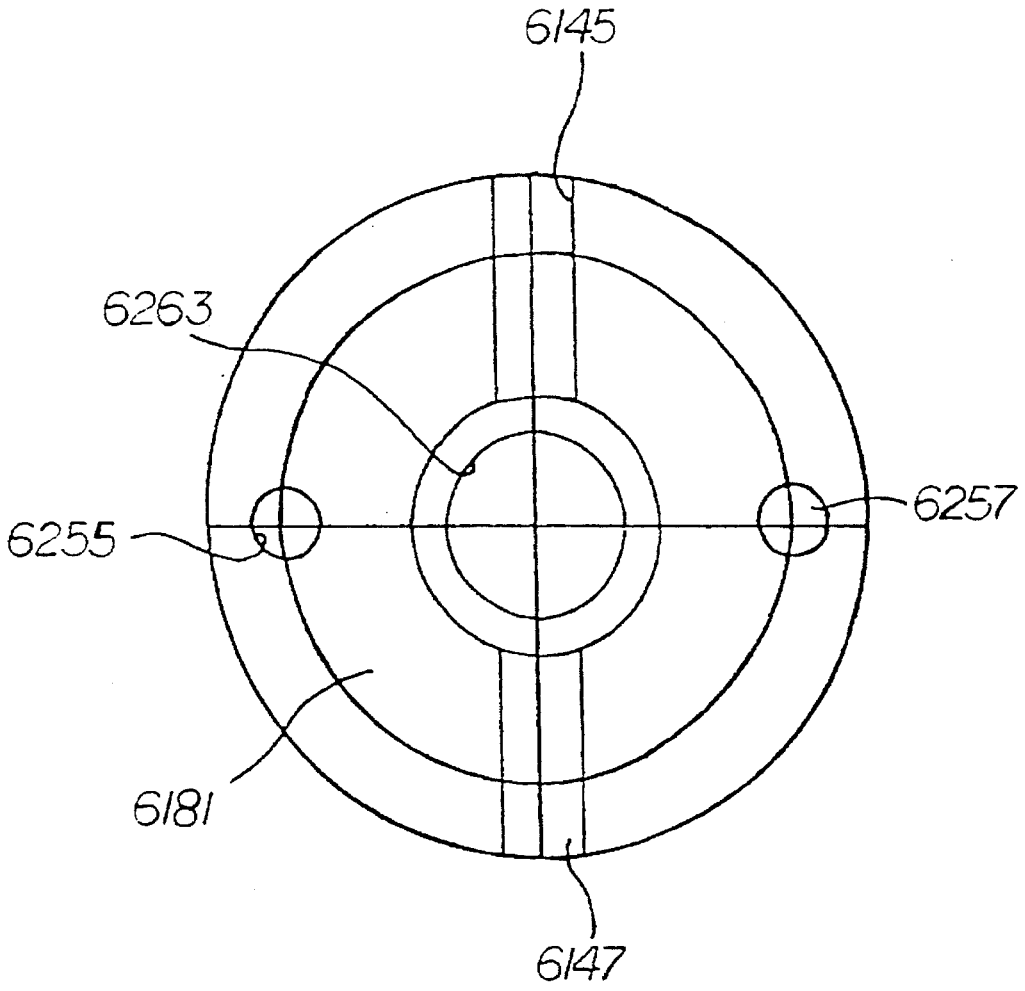
FIG. 22 is a cross-section view of the preferred valving subassembly of the preferred settable wellbore tool of the present invention, as seen along section lines B—B of FIG. 21B.
Figure 23E:
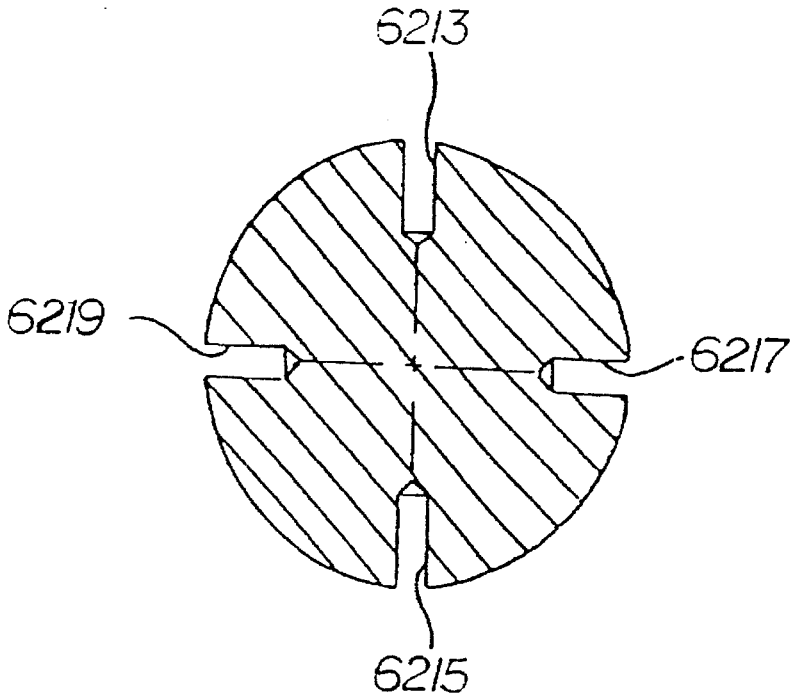

Movable valve stem 6193 includes shear pin cavities 6213, 6215, 6217, and 6219, which are adapted to receive shear pins 6221, 6223, 6225, and 6227. The longitudinal section view of FIG. 23B depicts only shear pin cavities 6213 and 6215. Shear pins 6221, 6223 are only depicted in FIG. 23B. FIG. 23E is a cross-section view as seen along lines E-E of FIG. 23B, and depicts all the shear pin cavities 6213, 6215, 6217, 6219. FIG. 22A shows movable valve stem 6193 in full longitudinal section, and thus only depicts shear cavities 6213, 6215 and shear pins 6221, 6223.

Returning now to FIG. 23B, movable valve stem 6193 further includes plug section 6229 which is equipped with radial O-ring seal cavities 6231, 6233, 6235, and 6237. FIG. 23B shows plug section 6229 without O-ring seals, but FIG. 2lB shows plug section 6229 equipped with O-ring seals 6239, 6241, 6243, 6245, disposed in O-ring seal cavities 6231, 6233, 6235, and respectively. FIG. 6006c shows the detail of O-ring seal cavity 6237.

Returning now to FIG. 2lB, it can be seen that movable valve stem 6193 is allowed to move only in the direction of arrow 6247, since the interior ratchet teeth 6189 and exterior ratchet 6191 are configured geometrically to allow such movement when collects 6195, 6197, 6199, 6201 are flexed slightly radially inward. Shear pins 6221, 6223, 6225, 6227 (only shear pins 6221, 6223 are shown in FIG. 21B) mechanically couple movable ratchet piece 6185 of movable valve stem 6193 to retaining ring 6249, which mates against shoulder 6251, which is disposed along the inner surface of central cavity 6277 of outer housing 6171. Shear pins 6221, 6223, 6225, 6227 cooperate with retaining ring to prevent movement of movable valve stem 6193 in the direction of arrow 6247, until a predetermined force level is exceeded which operates to shear shear pins 6221, 6223, 6225, 6227, and free movable valve stem 6293 from the stationary retaining ring 6249.

Retaining ring 6249 includes fluid flow passages 6251, 6253. High pressure fluid is directed downward through central bore 6173, through gaps 6203, 6205, 6207, 6209, and into central cavity 6177. Fluid flow passages 6251, 6253 receive the high pressure fluid from central cavity 6177, and direct it past retaining ring 6249. High pressure fluid is received by inflation passages 6255, 6257, which extend axially through valve nipple 6181.

Valve nipple 6181 includes external threads 6259 which are adapted for mating with lower internal threads 6179 of outer housing 6171. Valve nipple 6181 also includes stationary valve seat 6261 which includes central bore 6263 which is adapted in size and shape to receive plug section 6229 of movable valve seem 6193. Central bore 6263 is adapted for interfacing with O-ring seals 6239, 6241, 6243, and 6245, which are carried in O-ring seal cavities 6231, 6233, 6235, 6237 of plug section 6229 of movable valve stem 6193.

Ports 6145, 6147 (which are also seen in the perspective view of FIG. 6003) extend radially outward from central bore 6263 of valve nipple 6181. Ports 6145, 6147 and inflation passages 6255, 6257 do not intersect or communicate with one another, contrary to the depiction of FIG. 21B. FIG. 21B (incorrectly) shows ports 6145, 6147 intersecting with inflation passages 6155, 6157 for purposes of exposition only. FIG. 22 is a cross-section view as seen along lines B—B of FIG. 21B. As shown, inflation passages 6255, 6257 are aligned in a single plane which is ninety degrees apart from the plane which includes ports 6145, 6147. Central bore 6163 communicates only with ports 6145, 6147, and does not communicate with inflation passages 6255, 6257.

Returning now to FIG. 2lB, valve nipple 6181 further includes external threads 6267, and internal threads 6268 for mating with popper valve subassembly 6137. Popper valve subassembly 6137 includes popper housing 6269 and mandrel 6271, with annular inflation passage 6273 disposed therebetween, and in fluid communication with inflation passages 6255, 6257. O-ring seal cavity 6272 and O-ring seal 6275 are provided at the interface of valve nipple 6181 and popper housing 6269, to prevent leakage of high pressure inflation fluid from inflation passages 6255, 6257.

Figure 21C:
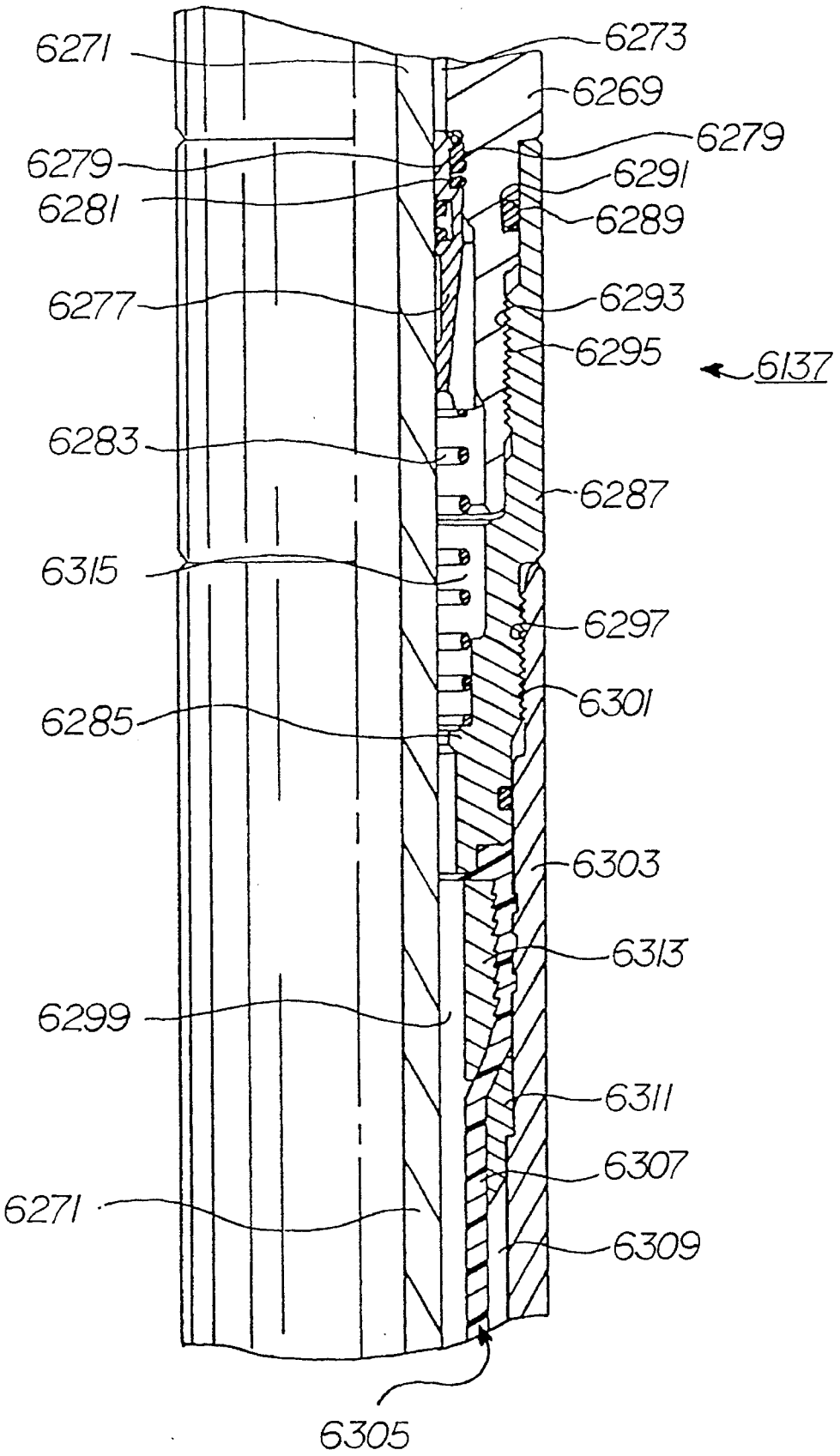
FIG. 21C is a one-quarter longitudinal section view of the preferred poppet valve subassembly of the preferred settable wellbore tool of the present invention.

FIG. 21C is a one-quarter longitudinal section view of popper valve subassembly 6137 with poppet valve 6277 disposed between mandrel 6271 and poppet housing 6269. Popper valve 6277 is biased to sealingly engage internal shoulder 6279 of poppet housing 6269 with elastomeric seal elements 6279, 6281 which are bonded to the body of popper valve 6277. Popper valve 6277 is biased upward by popper spring 6283 which is held in a fixed position by engagement with shoulder 6285 of connecting member 6287. O-ring seal 6289, which is disposed in O-ring seal cavity 6291, seals the interface cf connector member 6287 and popper housing 6269, which are threaded together at internal and external threads 6293, 6295. Connector member 6287 includes external threads 6297 which are adapted for mating with internal threads 6301 of upper bridge plug collar 6303.

Annular inflatable wall 6305 is disposed between mandrel 6271 and upper bridge plug collar 6303. Inflation chamber 6299 is disposed between annular inflatable wall 6305 and mandrel 6271. Annular inflatable wall 6305 comprises inner elastomeric sleeve 6307 and an array of flexible overlapping slats 6309. Slat ring 6311 is adapted for welding to the interior surface of upper bridge plug collar 6303, and operates to hold the array of flexible overlapping slats 6309 in a fixed position relative to upper bridge plug collar 6303. Inner elastomeric sleeve 6307 is disposed between sleeve ring 6313 and upper bridge collar 6303. Sleeve ring 6313 includes teeth which are in gripping engagement with inner elastomeric sleeve 6307 and holds it in a fixed position relative to upper bridge plug collar 6303.

Figure 24A:
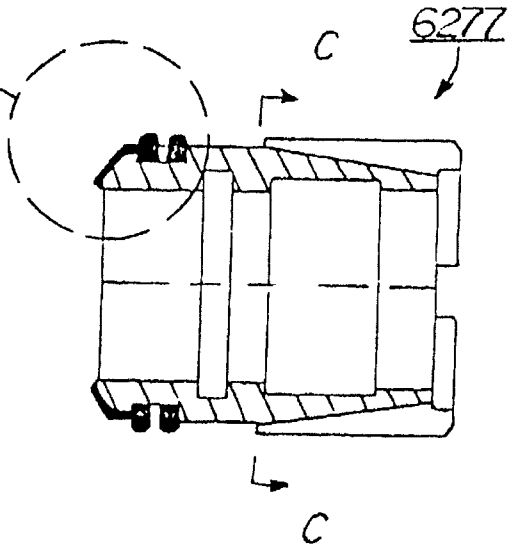
FIGS. 24A, 24B, and 24C are detailed longitudinal, fragmentary longitudinal, and cross-section views, respectively, of the preferred popper valve stem of the preferred settable wellbore tool of the present invention.
Figure 24B:
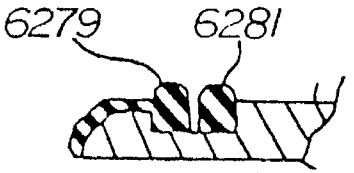
Figure 24C:
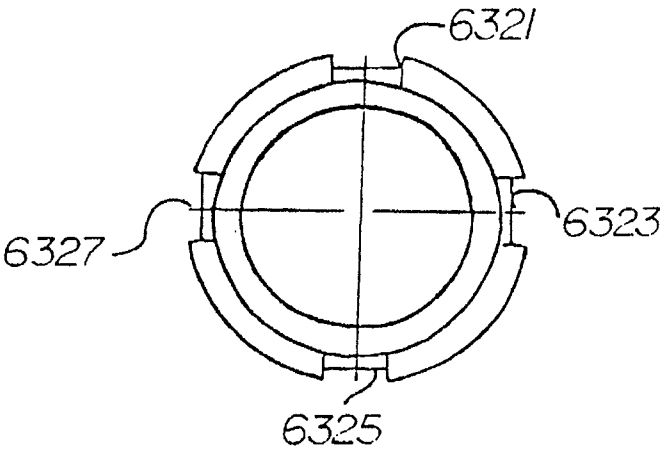

FIGS. 24A, 24B and 24C show more detail about poppet valve 6277. FIG. 24A shows popper valve 6277 in longitudinal section. FIG. 24B is an enlarged view of the sealing portion of popper valve 6277 and depicts how elastomeric elements 6279, 6281 are bonded to the exterior surface of the steel cylinder which forms popper valve 6277. FIG. 24C is a cross-section view as seen along lines C—C of FIG. 24A. As shown, popper valve 6277 includes a plurality of slots 6321, 6323, 6325, and 6327 which extend axially along the length of popper valve 6277, and facilitate the passage of fluid around poppet valve 6277 when high pressure fluid forces it downward relative to poppet housing 6269.

Figure 21D:
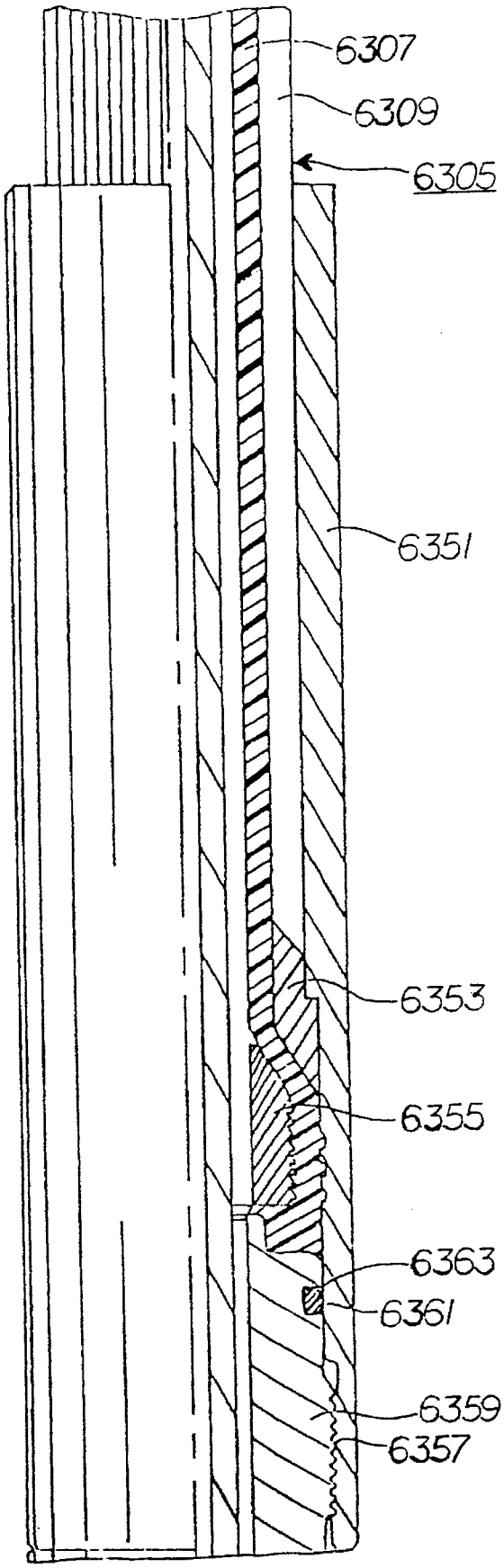
FIGS. 21D and 21E are one-quarter longitudinal section views of the guide subassembly of the preferred settable wellbore tool of the present invention, and are read together.
Figure 21E:
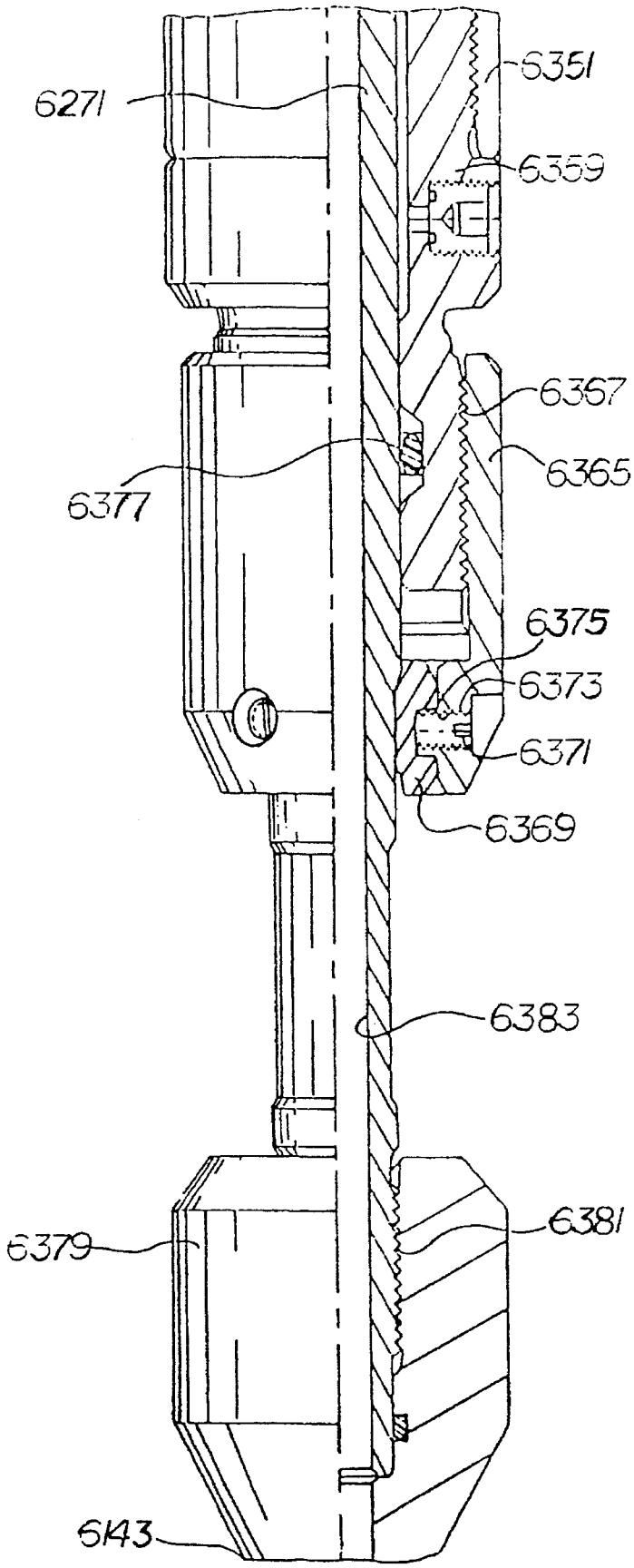

FIGS. 21D and 21E are one-quarter longitudinal section views, which are read together, which depict lower bridge plug collar 6351 and the guide assembly 6141. As shown, annular inflatable wall 6305, which includes inner elastomeric sleeve 6307 and an array of flexible overlapping slats 6309, is coupled to lower bridge plug collar 6351 in a manner similar to that of upper bridge plug collar 6303. Specifically, slat ring 6353 is welded in place relative to lower bridge plug collar 6351, and sleeve ring 6355 serves to grippingly engage inner elastomeric sleeve 6307 and hold it in position relative to lower bridge plug collar 6351.

Lower bridge plug collar 6351 is connected at threads 6357 co connector sleeve 6359, and is sealed at O-ring seal 6361, which resides in O-ring seal cavity 6363 of connector sleeve 6359. Connector sleeve 6359 serves to mechanically interconnect lower bridge plug collar 6351 and shear adapter sleeve 6365, which it is coupled to by threads 6367. Shear adapter sleeve 6365 is shearably connected to anchor ring 6369 by shearable screw 6371 which is coupled by threads 6373 in shearable screw cavity 6375. A plurality of similar shearable screws are provided circumferentially around shear adapter sleeve 6365. The number, cross-sectional area, and structural strength of each shear screw additively combine to determine a force threshold which must be exceeded to shear adapter sleeve 6365 loose from anchor ring 6369. This shearable connection is provided to allow annular inflatable wall 6305 to contract axially relative to mandrel 6271. Connector sleeve 6359 is sealed at its interface with mandrel 6271 by sealing ring 6377. At its lowermost end, guard subassembly 6141 includes guard 6379 which is connected by threads 6381 to mandrel 6271. Port 6143 is provided in guard 6379 to allow fluid communication inward along central bore 6383 which is in continuous fluid communication through the bridge plug and poppet valve subassembly 6137, with central bore 6261 of valving subassembly 6135.

Therefore, with reference now to FIG. 2lB, the fluid pressure at port 6143 of guard 6379 is at one side of movable valve stem 6193, while the pressure from the means of pressurizing fluid (which serves to inflate the bridge plug) is on the opposite side of movable valve stem 6193. Shear pins 6221, 6223, 6225, and 6227 provide a predetermined force threshold which must be exceeded by the fluid pressure differential across movable valve stem 6193 in order to move movable valve stem 6193 downward relative to valve nipple 6181 for closure of ports 6145, 6147. The pressure threshold which is selected for initiation of movable valve stem 6193 should be coordinated with the particular fluid-actuated wellbore tool which is selected for use. For example, when a bridge plug is selected, as shown in this embodiment, it is important to keep in mind that the typical bridge plug is in gripping engagement with the casing of the wellbore wall, and thus in a fixed position, in the range of inflation pressures between one 1,000 pounds per square inch and approximately 1,500 pounds per square inch. Therefore, by selecting shear pins 6221, 6223, 6225, 6227, of a predetermined strength, flow between ports 6143, 6145, 6147 (shown in FIG. 20) can continue until the bridge plug, or other settable wellbore tool, is in a fixed position relative to the wellbore. Therefore, in the embodiment shown it would be prudent to allow for closure of downward movement of movable valve stem 6193, and resulting closure of ports 6145, 6147 in the range of 1,000–1,500 pounds per square inch of pressure within inflation chamber 6299 of the bridge plug.

OPERATION

With reference to FIGS. 2 and 4, in operation, power supply 35 provides electrical energy through wireline 27 to wireline pump 2000, which includes electric motor 2003, pump 2005, and filter 2007. The electrical energy from power supply 35 energizes electric motor 2003, which actuates a pump 2005. Pump 2005 receives wellbore fluid from wellbore through filter 2007, and exhausts a high pressure fluid through a fluid flow-path passing through filter 2007 and to equalization valve 3000, which initially blocks the fluid flow-path for fluid communication between wireline pump 2000 and bridge plug 6000. The high pressure fluid then actuates equalizing valve 3000 to open a fluid flow-path for fluid communication between wireline pump 2000 and bridge plug 6000, and to sealingly close a fluid equalization flow-path between wellbore 13 and the interior of wireline tool string 11.

The pressurized fluid from pump 2000 then passes through pressure extender 4000, pull-release disconnect 5000, hydraulic disconnect 67, and into bridge plug 6000 to urge it from a deflated running position to an inflated setting position. Once bridge plug 6000 is expanded into the setting position, pressure extender 6000 provides a time delay to allow squaring off between bridge plug 6000 and casing 17.

Once a sufficient time delay has elapsed, and a sufficient pressure level is obtained within bridge plug 6000, hydraulic disconnect 67 is actuated to separate bridge plug 6000 from the remainder of wellbore tool string 11. If hydraulic disconnect 67 fails to operate properly, emergency pull-release disconnect 5000 may be actuated by applying an upward force to wellbore tool 11. If wireline 27 cannot be used to provide sufficient upward force to actuate emergency pull disconnect 5000, a workstring such as a coiled tubing string may be lowered to engage wellbore tool 11 and allow for actuation of pull-release disconnect 5OO0 by applying an upward force thereto.

With reference to FIG. 7, it is often desirable or necessary to pressure test lubricator 33 to determine if it is operating properly. Prior art devices which are not equipped with pressure equalizing valve 3000 are susceptible to inadvertent and undesirable actuation of the fluid-actuable wellbore tool, which is part of a wellbore tool string, such as cross flow bridge plug 6000 in tool string 11 of this preferred embodiment.

For example, in a pressure test of lubricator 33, gas from the test fluid may enter the interior of wireline setting tool string 11 by passing through the inlet of pump 2000, and becoming trapped within tool string 11 by fluid flow check valves within pump 2000. If pressure equalization valve 3000 is not in wireline tool string 11, pressurized test gas which is trapped within tool string 11 and in fluid communication with the interior of bridge plug 6000 will expand rapidly during bleed off of pressure from lubricator 33 at the end of pressure testing, causing inadvertent and undesirable actuation of cross flow bridge plug 6000. Also, if equalization valve 3000 is not in tool string 11 and a wellbore fluid is used to pressure test lubricator 33, the wellbore fluid may contain pressurized gas which can become trapped within wireline setting tool 11 in fluid communication with the interior of bridge plug 6000, and likewise expand rapidly during bleed off of the fluid from lubricator 33 an the end of pressure testing. This will also cause a rapid, unintentional, and undesirable expansion of the fluid-actuable wellbore tool, cross flow bridge plug 6000 of wellbore tool string 11.

In general terms, the equalizing apparatus of the present invention overcomes this problem, and prevents unintentional and undesirable actuation of fluid-pressure actuable wellbore tools while in lubricator during and after pressure testing. The equalizing apparatus of the present invention also prevents accidental or unintentional actuation of fluid-pressure actuable wellbore tools in other pressure testing or transient pressure differential conditions, both inside and outside of the lubricator.

Figure 5A:
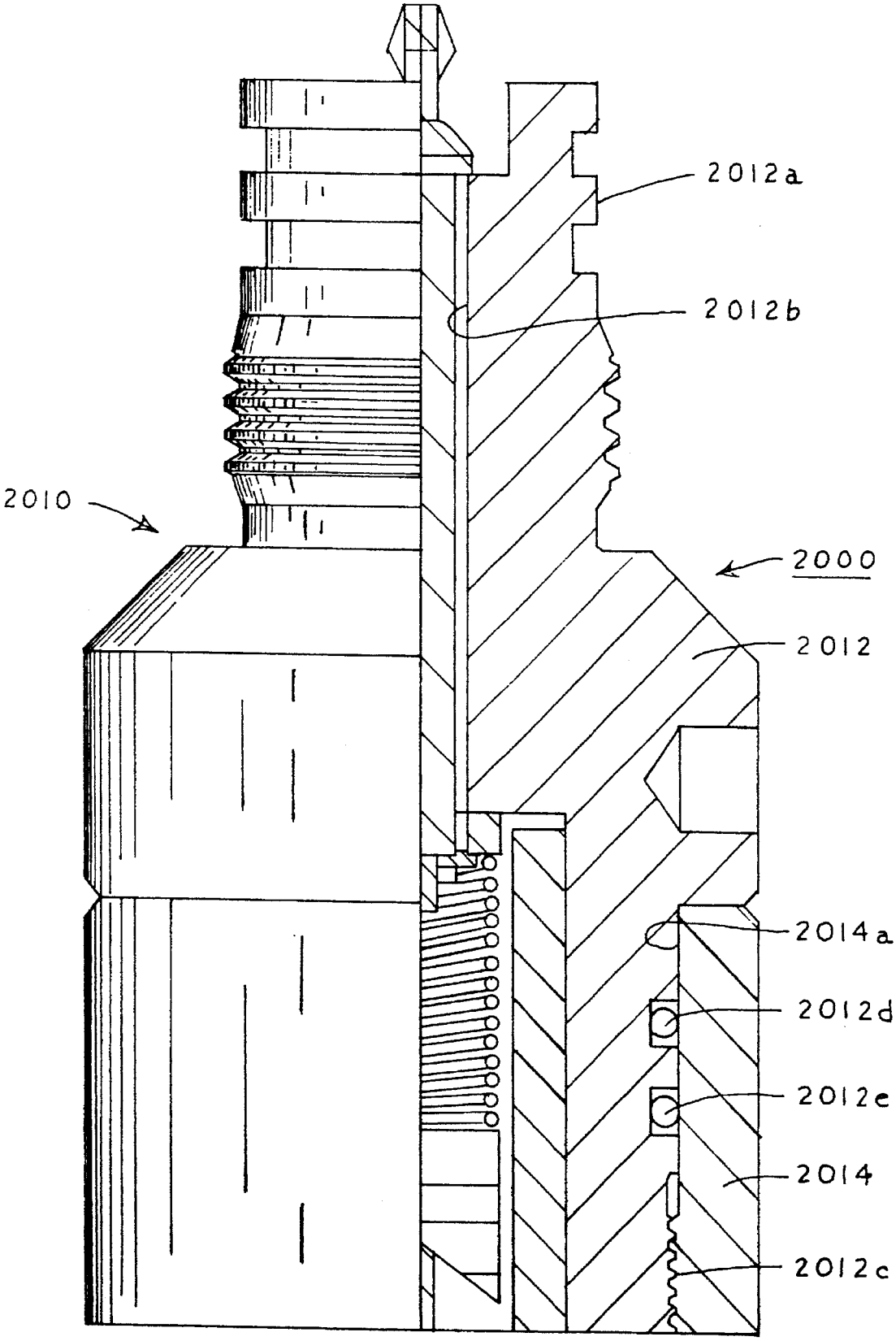
FIGS. 5A through 5M are one-quarter longitudinal section views, which when taken together, depict the preferred embodiment of the wireline conveyable fluid pressurization means.
Figure 5B:
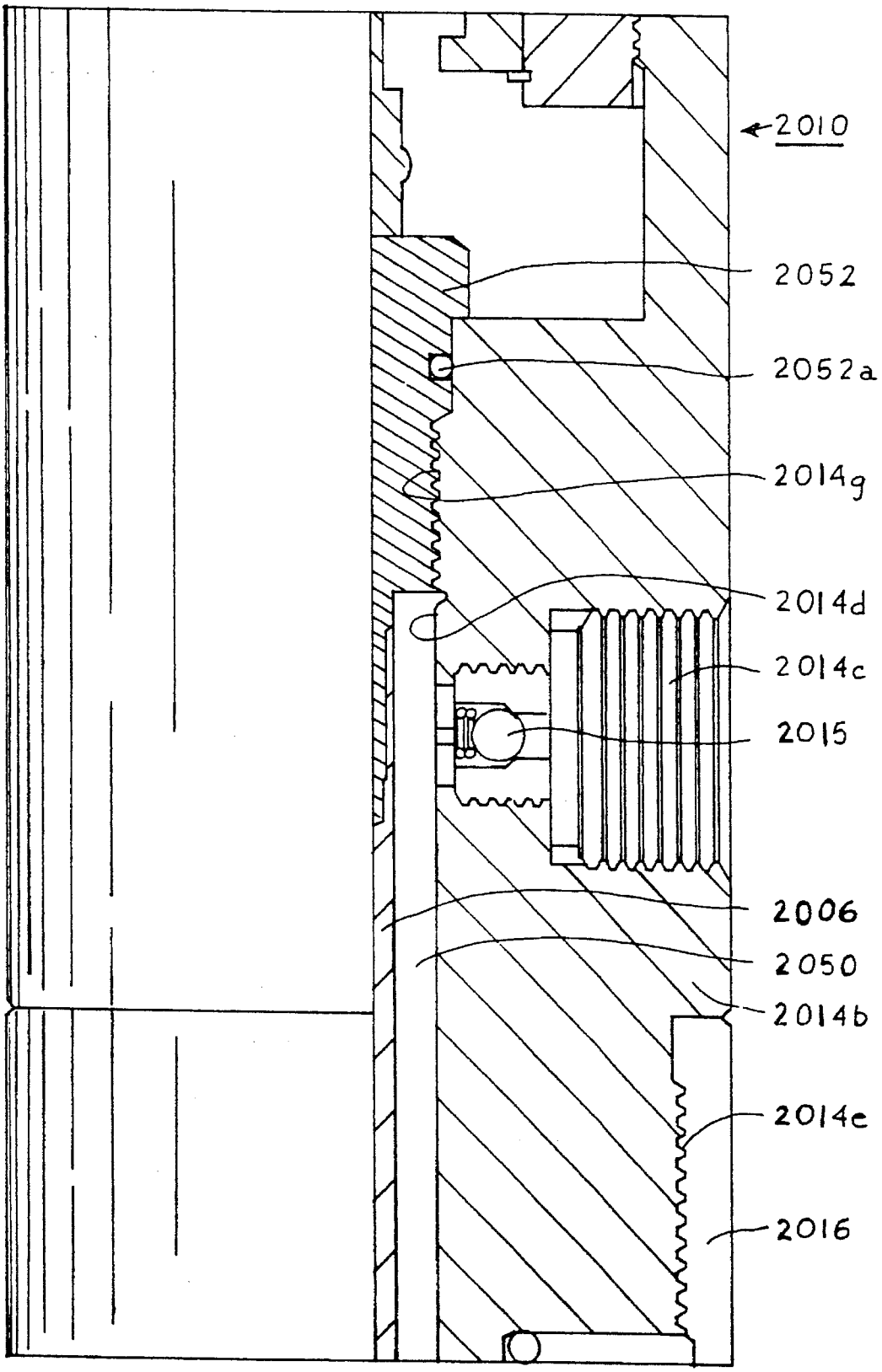
Figure 5C:
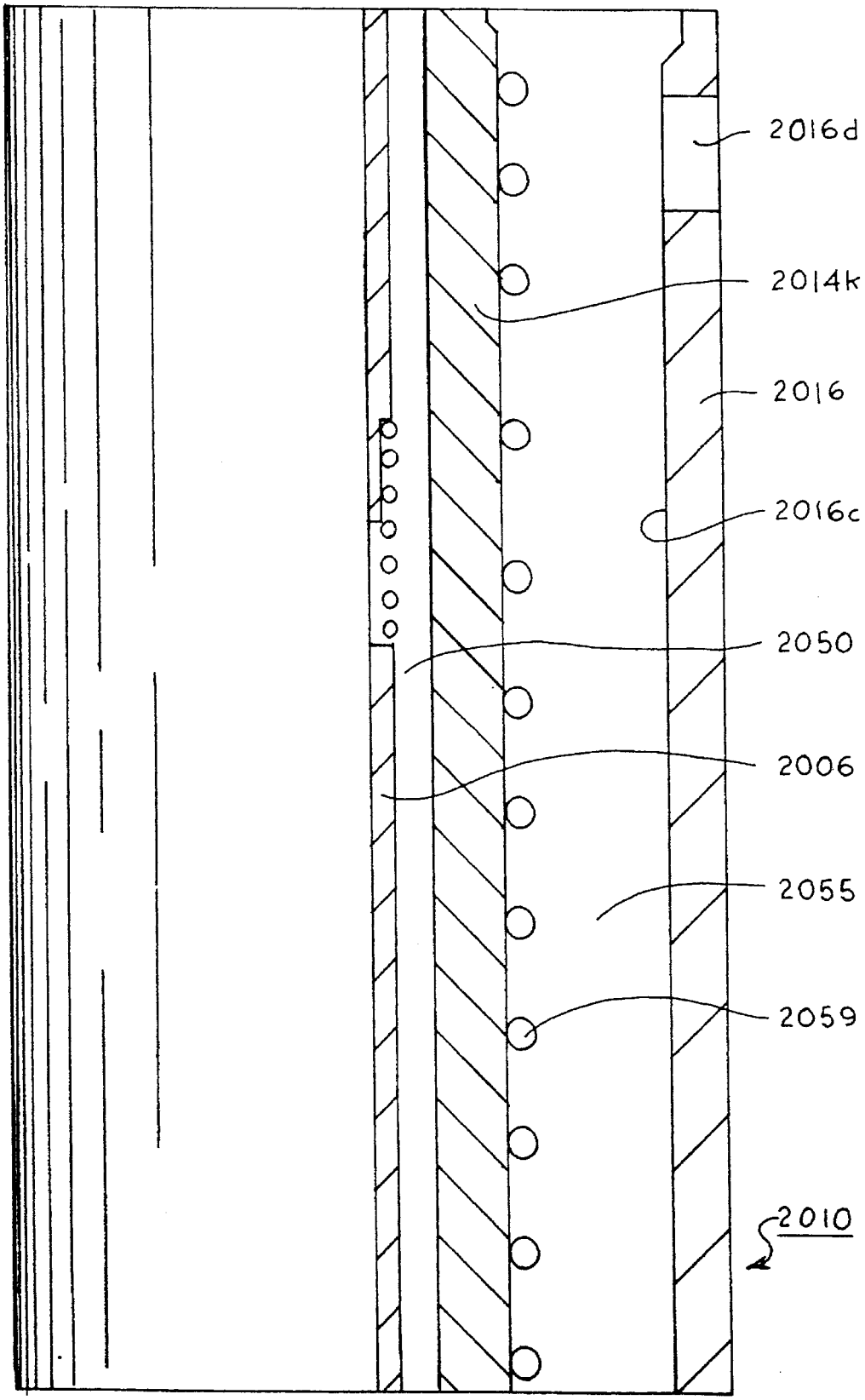
Figure 5D:
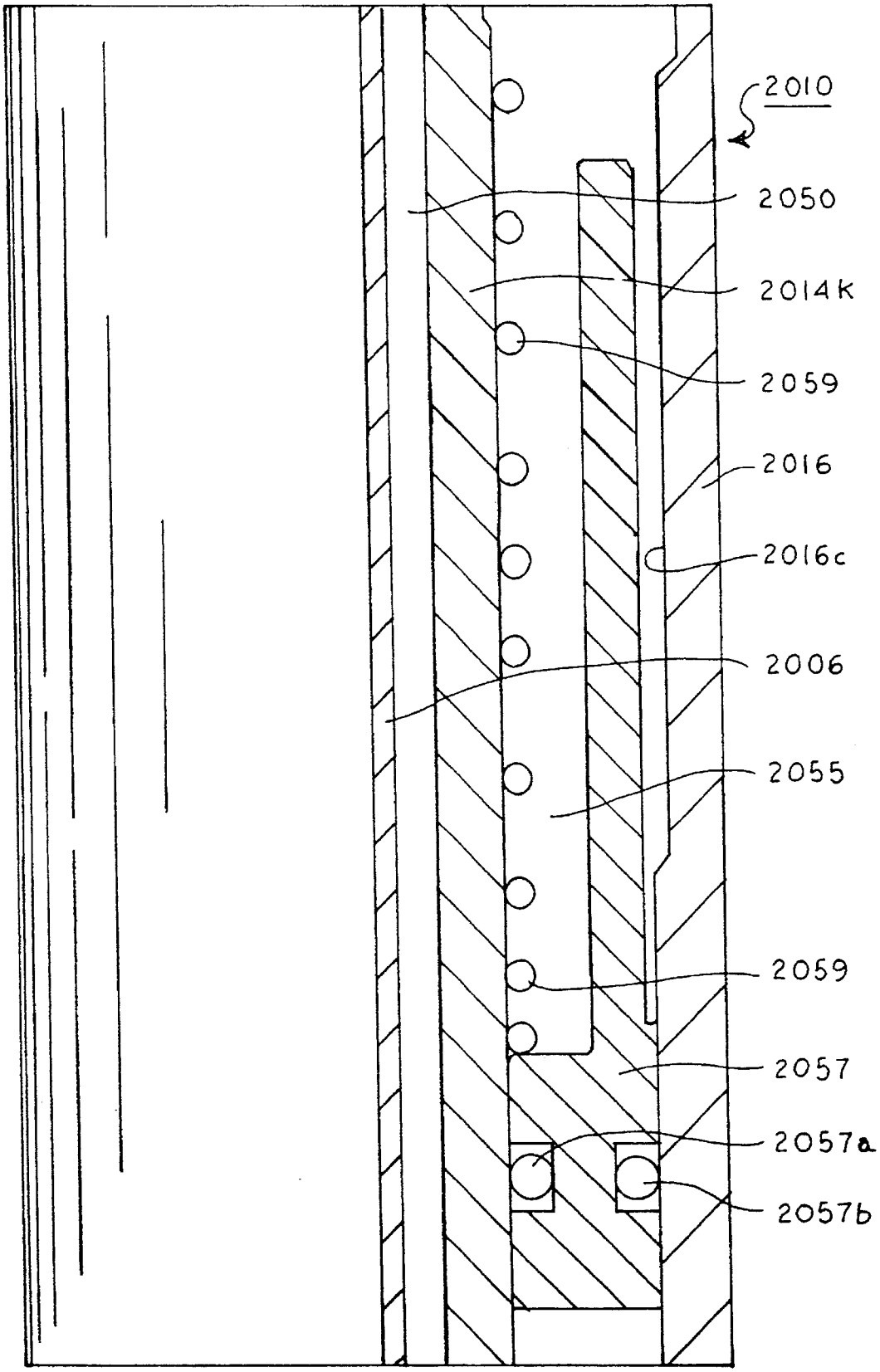
Figure 5E:
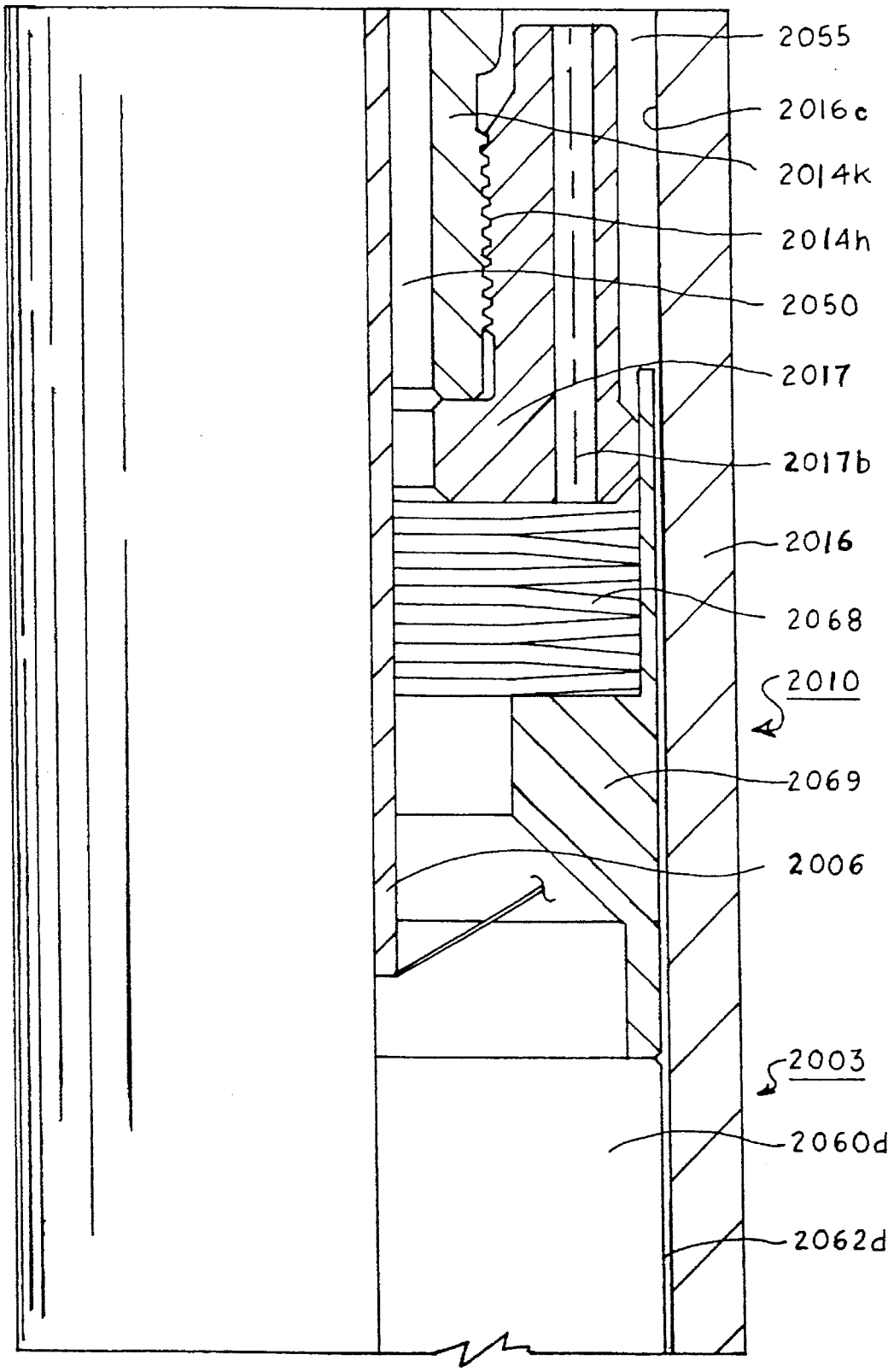
Figure 5F:
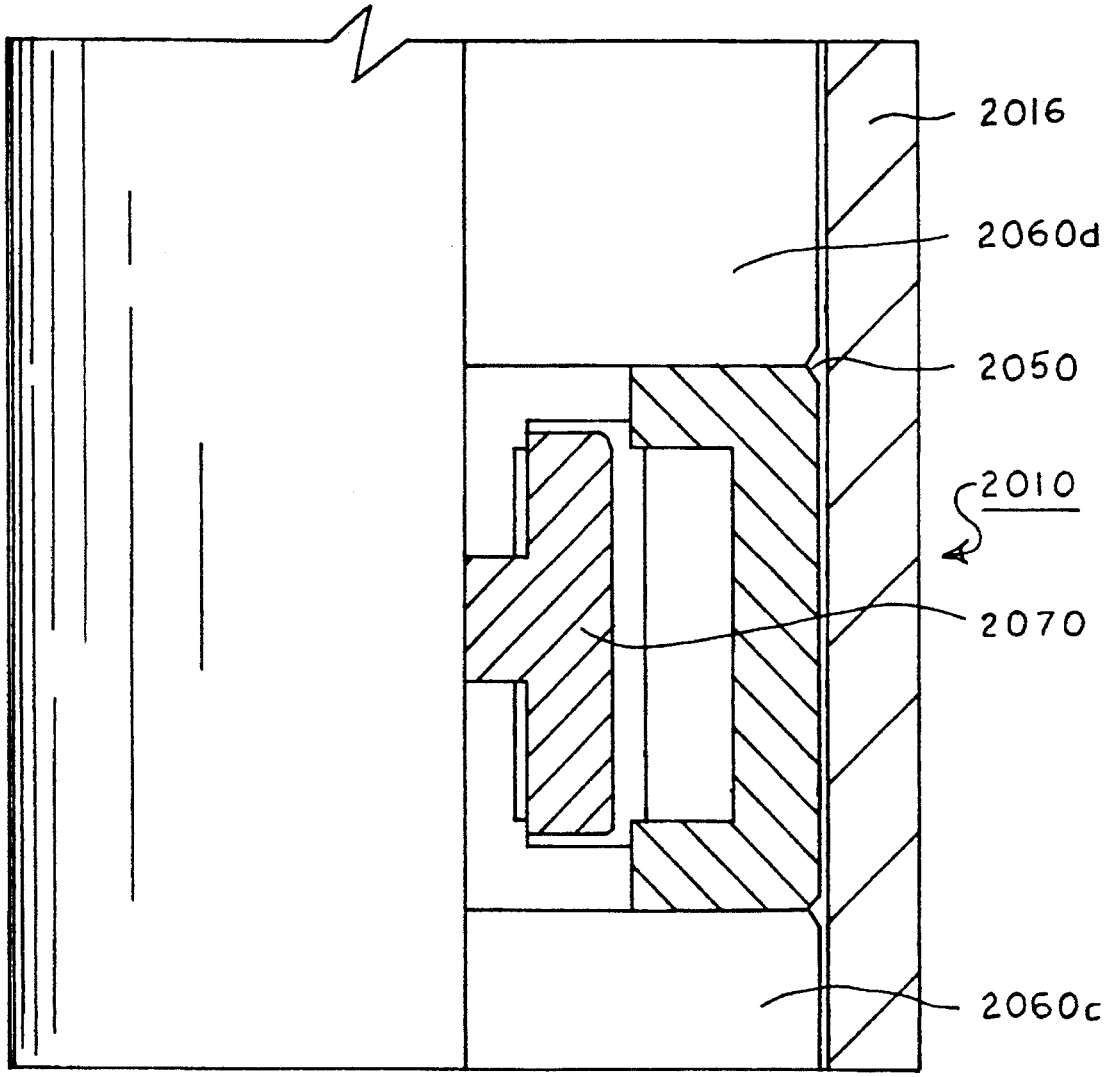
Figure 5G:
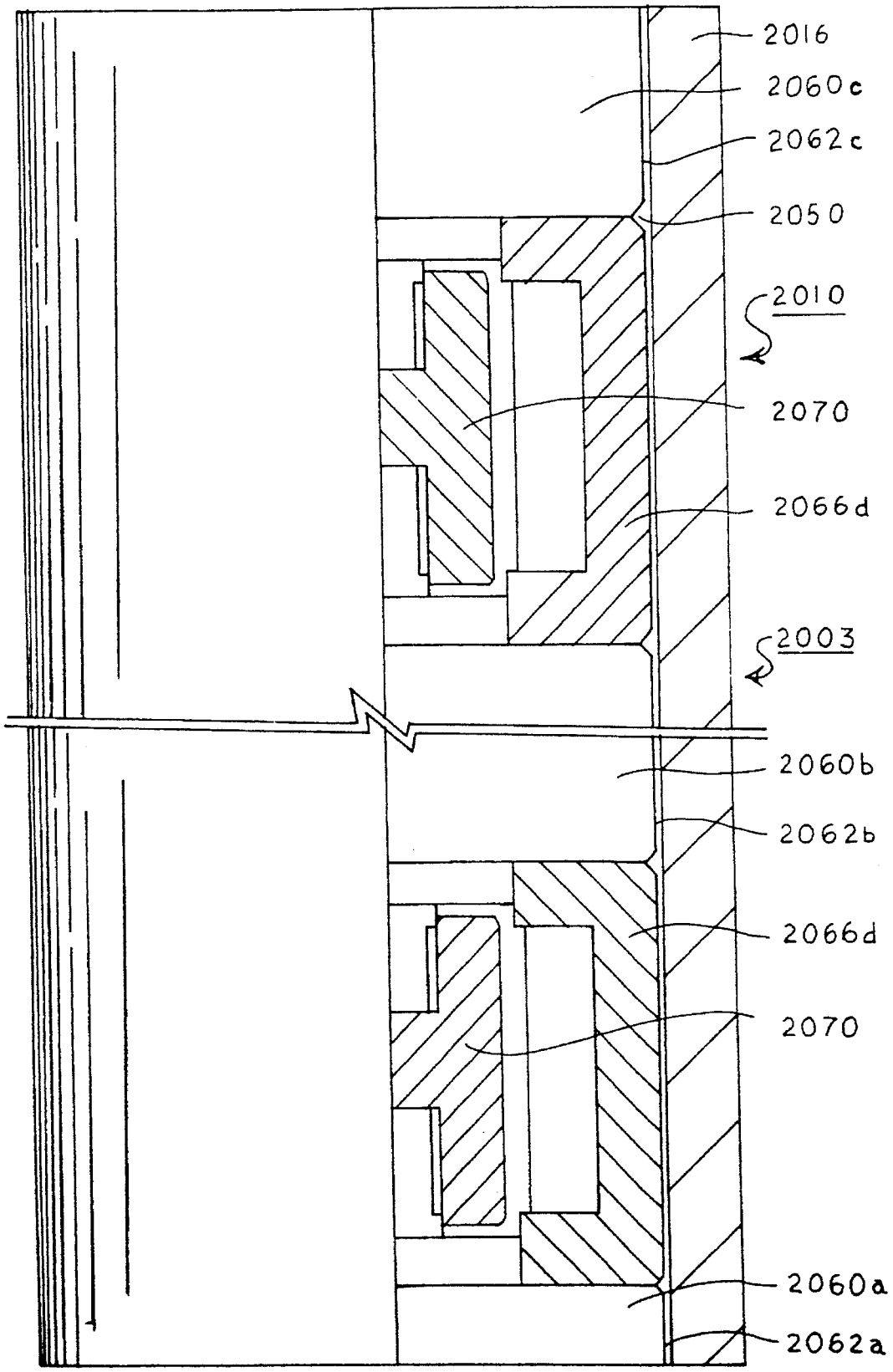
Figure 5H:
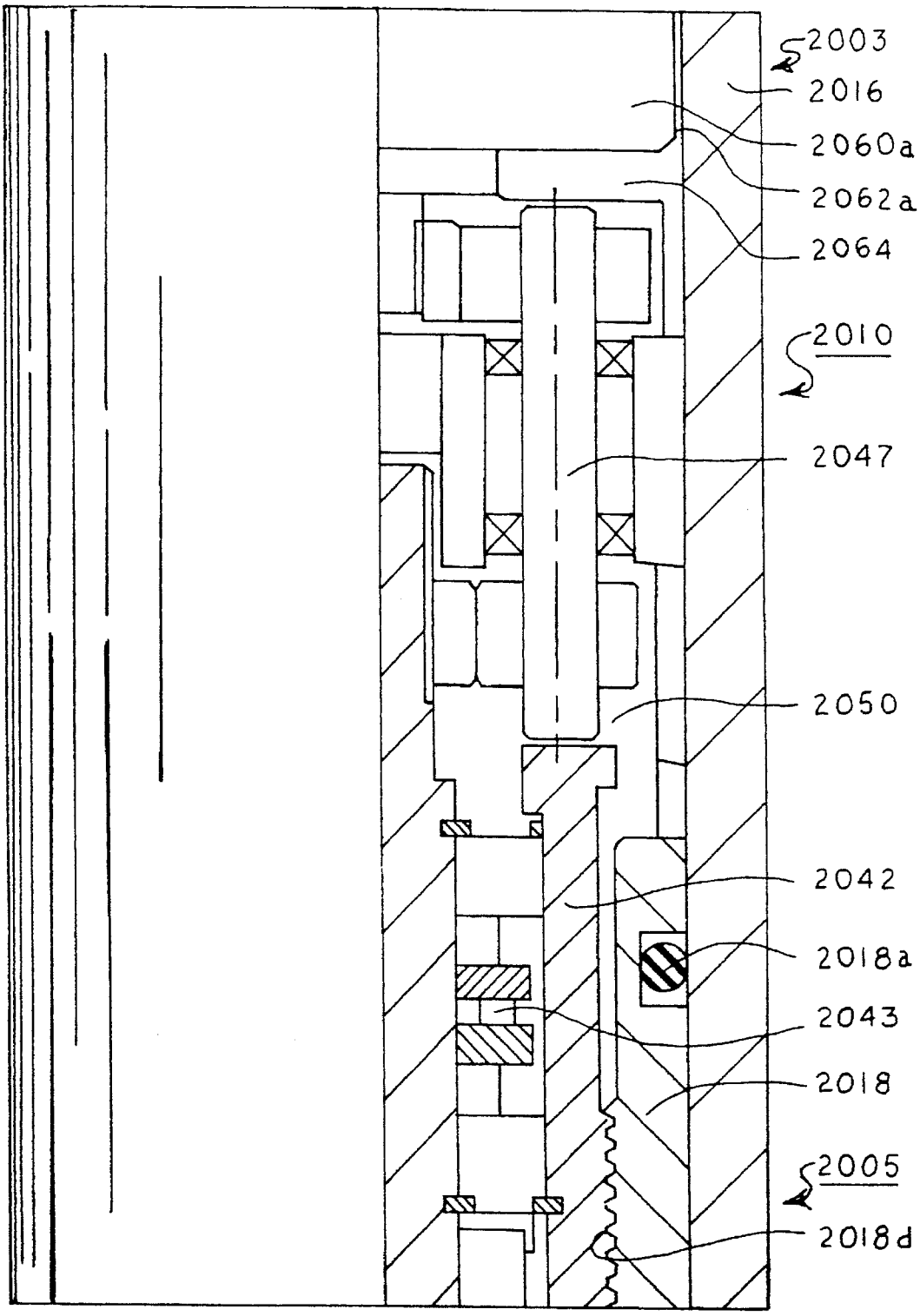
Figure 5I:
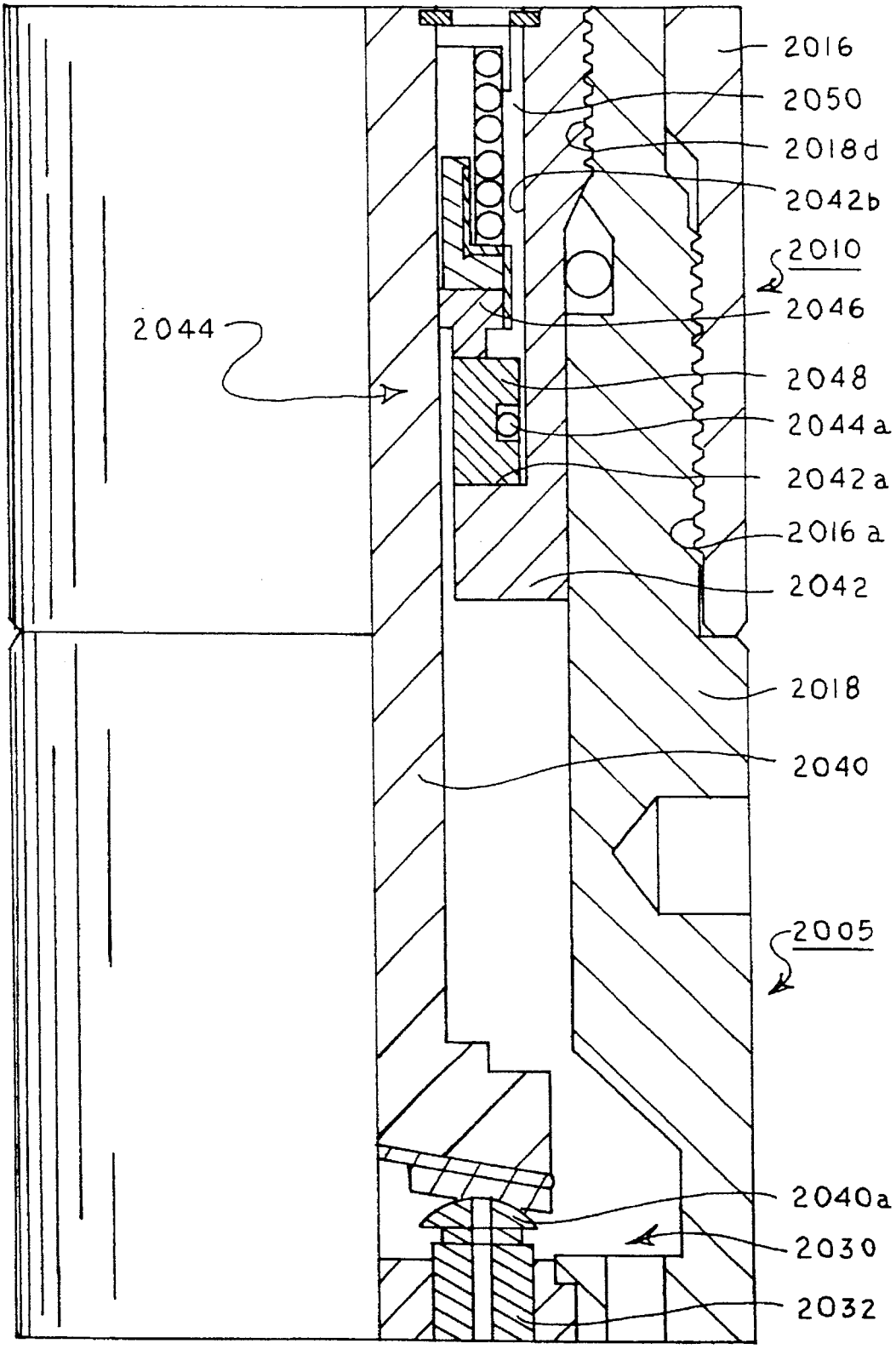
Figure 5J:
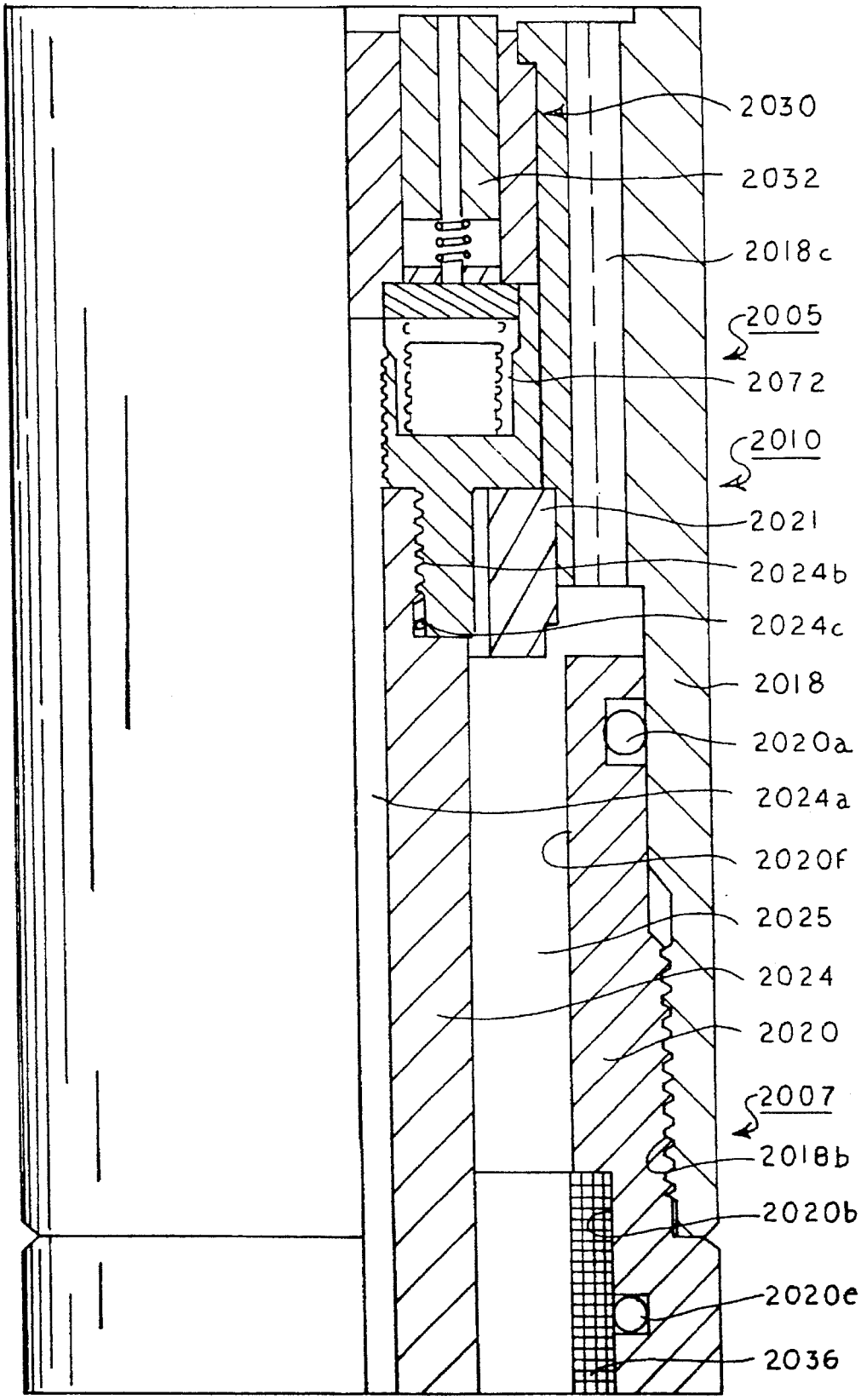
Figure 5K:
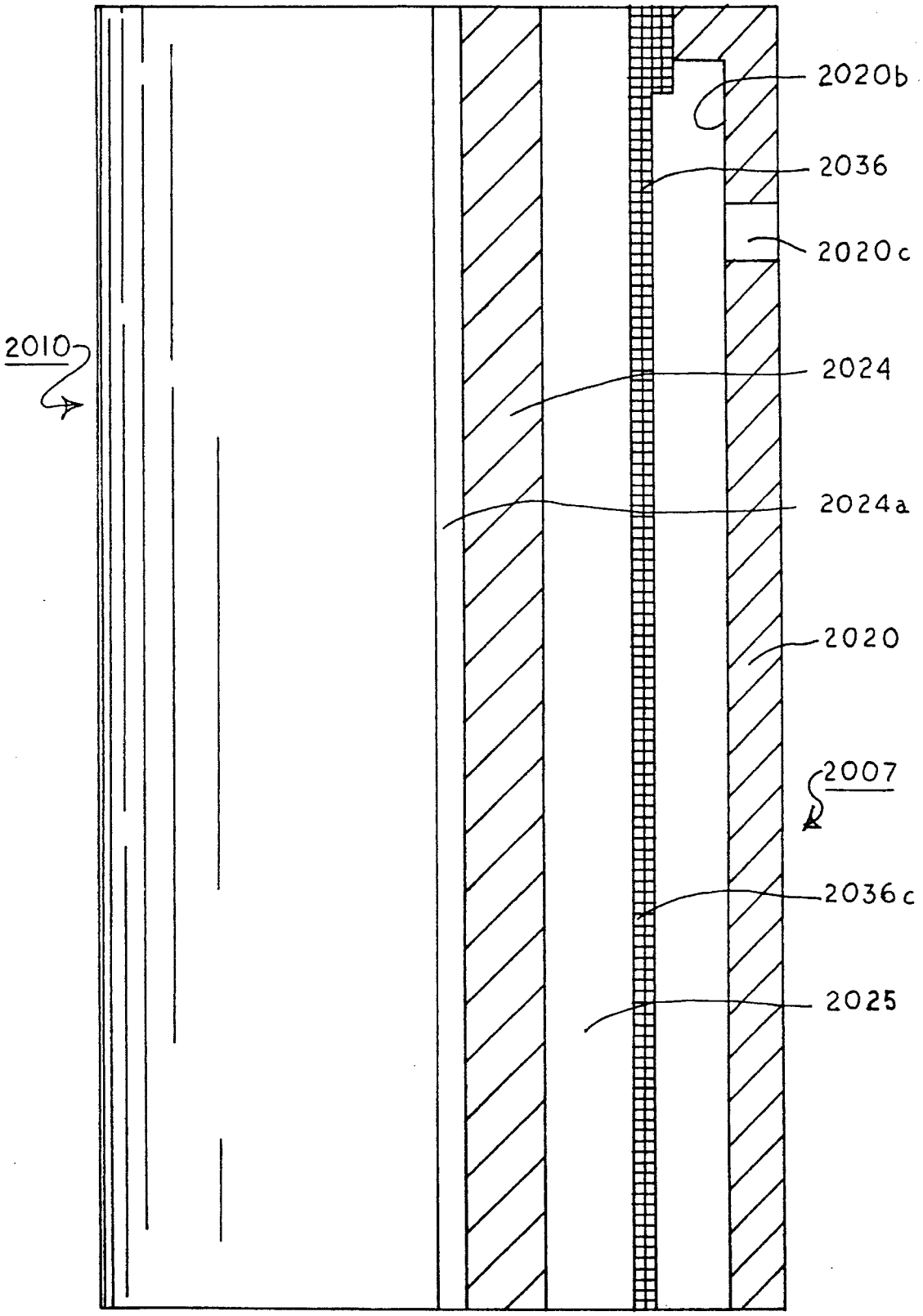
Figure 5L:
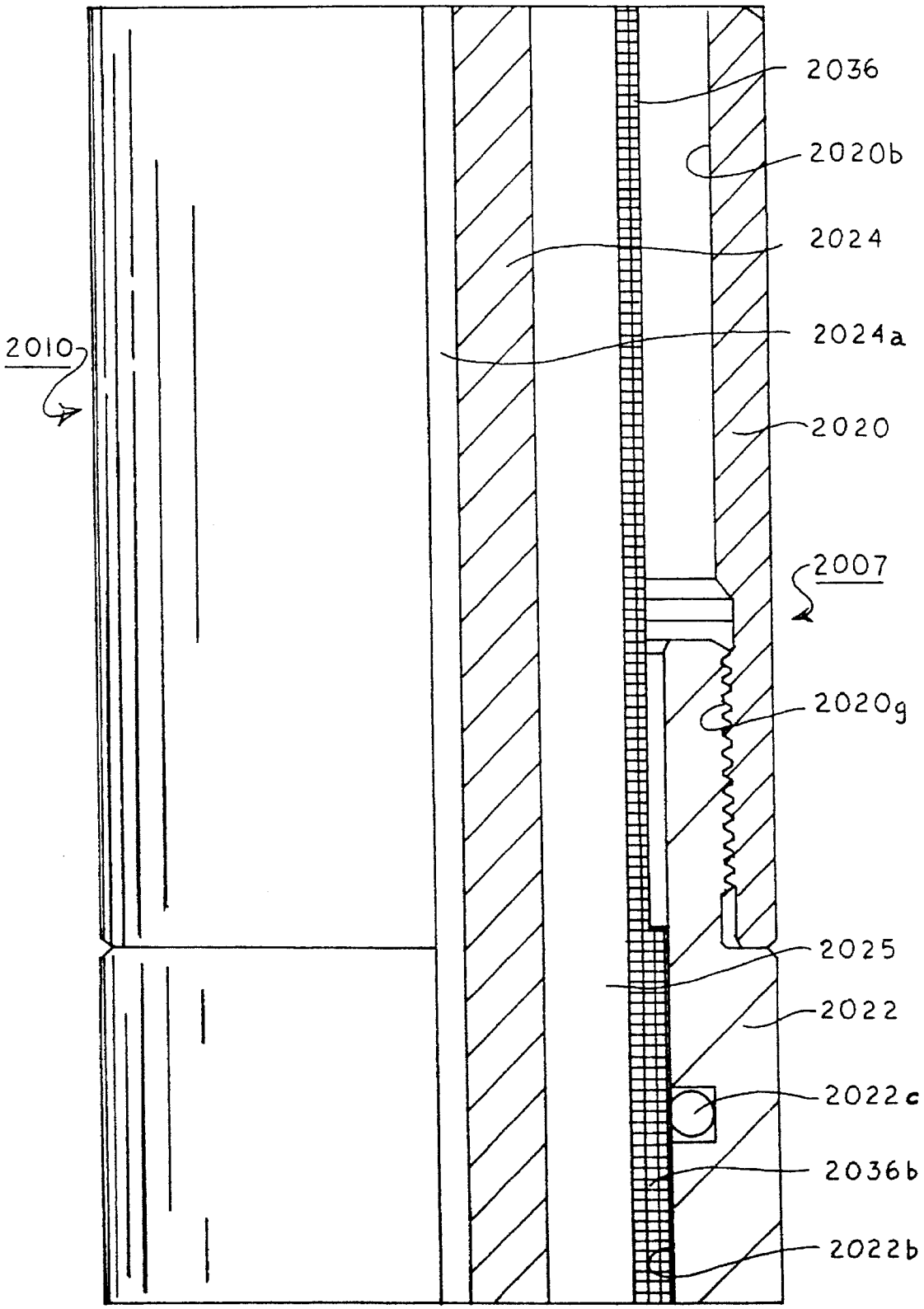
Figure 5M:
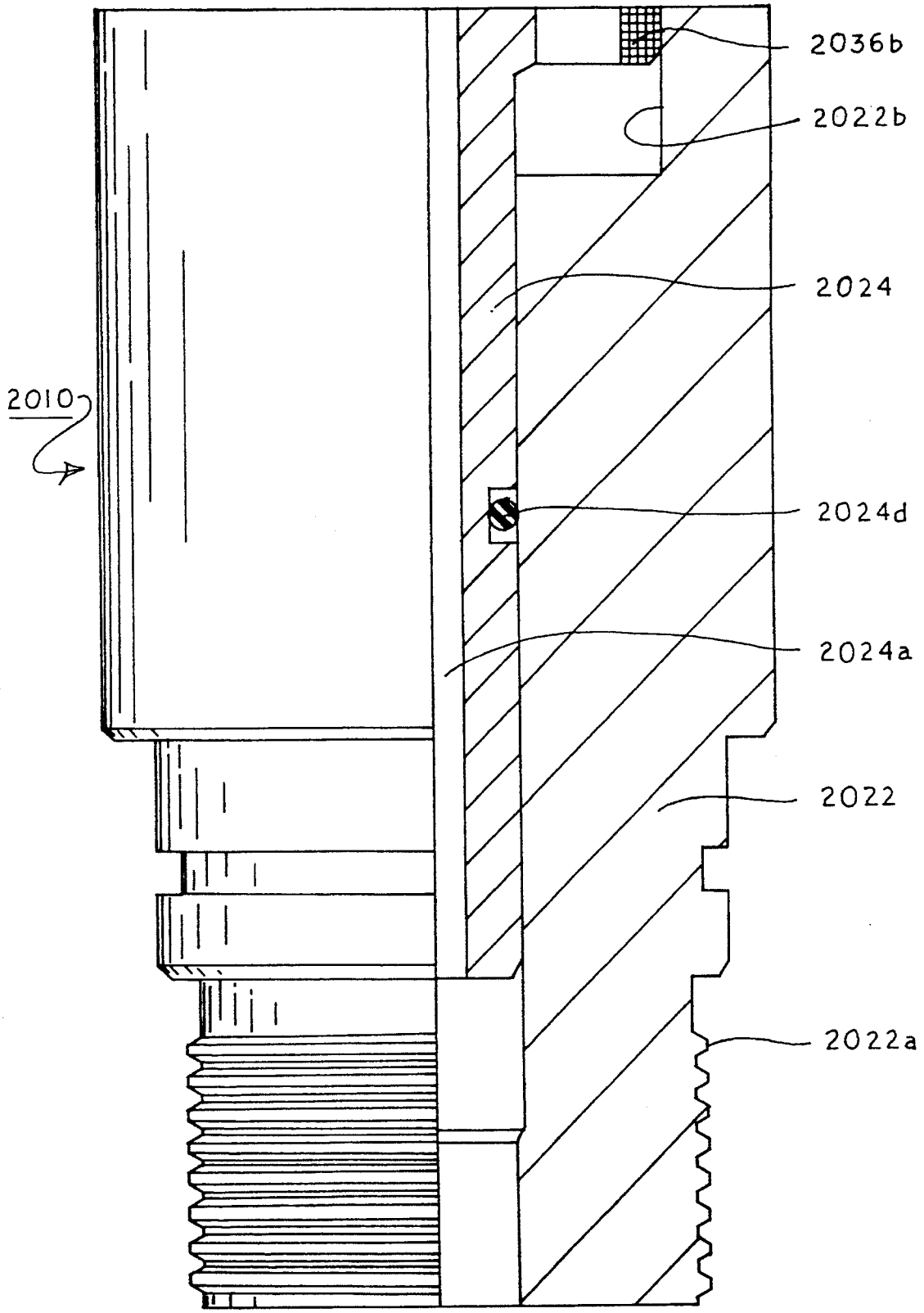
Figure 5N:
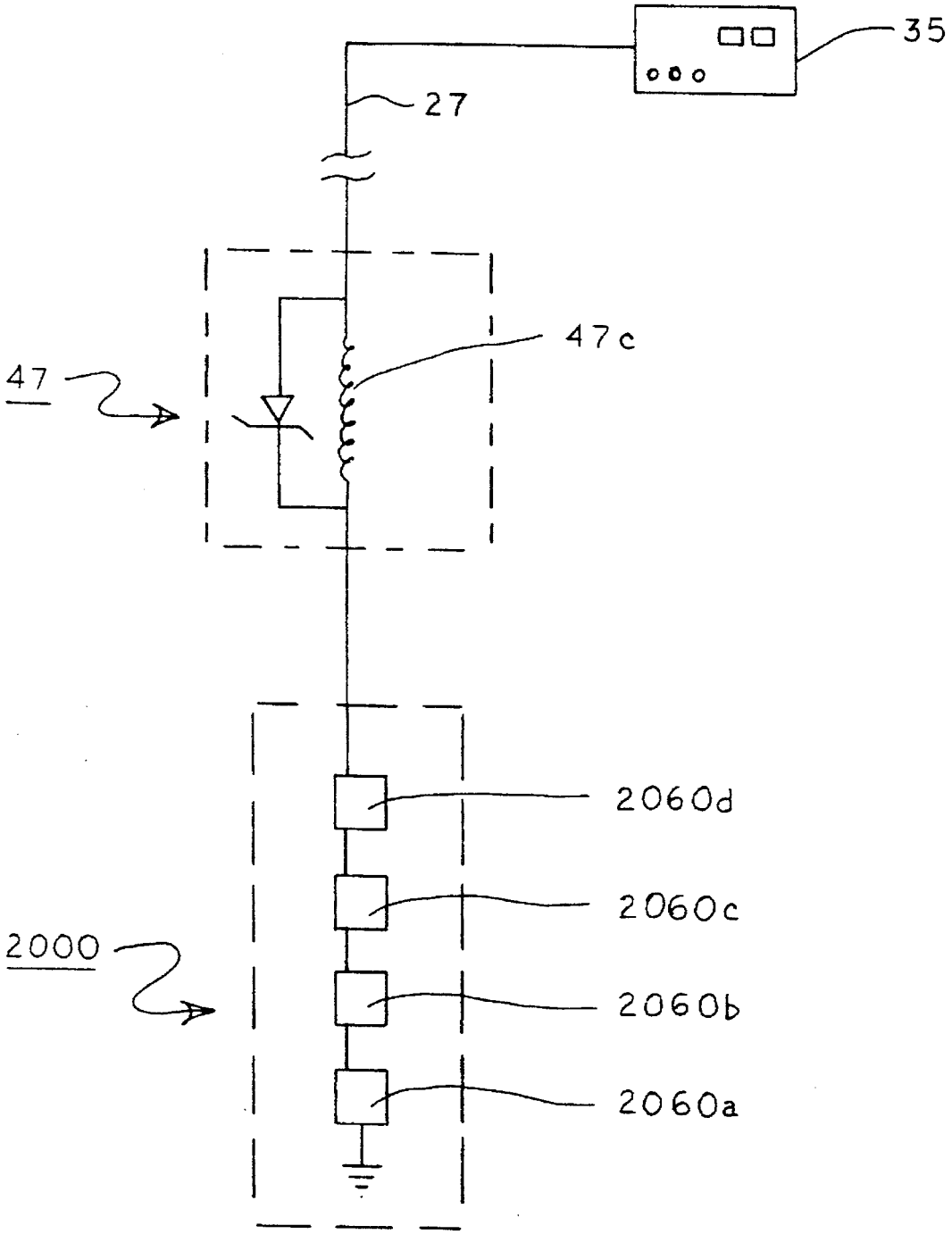
FIG. 5N is a schematic diagram of a casing collar locator utilized with wireline pump 2000 of the present invention to facilitate powering of the through tubing wireline pump.

Referring now to the preferred embodiment of the present invention, and in particular FIG. 7, if pressurized gas enters through pump 2000 and into interior portions of wireline conveyed tool string 11 during pressure testing in lubricator 33, the gas will be trapped by check valve 2072, shown in FIG. 5J, and O-rings 3177 and 3175 on valve closure member 3169, shown in FIG. 8D. Bleeding off of the test pressure will cause the trapped gas to expand. With reference to FIGS. 8A through 8E, gas trapped within equalizing valve 3000 will then apply pressure to the uppermost end of closure member 3169. If the pressure is great enough, the resulting force on closure member 3169 could cause an unintended closure of equalizing port 3183.

Still referring to FIGS. 8A through 8E, a safety feature is provided by pressure relief valve 3127, cavity 3017 and piston member 3103. Trapped gas which communicates with central bore 3089 will also act upon the lowermost end of piston member 3103 and, through the substantially incompressible fluid in cavity 3097, upon pressure relief valve 3127. Since pressure relief valve 3127 is set to move between a normally-closed position and open position at one hundred and fifty (150) pounds per square inch of force and threaded shear pin 3181 is adapted to shear at one thousand-five hundred (1,500) pounds per square inch of force, piston member 3103 will begin traveling upward before threaded shear pin 3181 is sheared, providing an additional volume (of cavity 3097) for receipt of the expanding gas causing a diminishment of the force upon the uppermost end of closure member 3169. If the volume of cavity 3097 is large enough, threaded shear pin 3181 will never be sheared accidentally during pressure testing. Therefore, during pressure testing, no pressure differential exists between the interior of lubricator 33 and the fluid-pressure actuable wellbore tool, which is cross flow bridge plug 6000 in the preferred embodiment of the present invention. Consequently, when pressure is bled-off of lubricator 33, no pressure differential will exist, and no inflation of cross flow bridge plug 6000 can occur.

Referring now to FIG. 2, after surface pressure testing, and once wellbore tool string 11 is lowered within wellbore 13 to a desired location, it becomes an operating objective to actuate the fluid-pressure actuable wellbore tool to expand it from a radially-reduced running in the hole mode of operation to a radially-expanded setting mode of operation for setting against a selected wellbore surface, such as casing 17. Of course, actuation of the fluid-pressure actuable wellbore tool cannot occur until the equalizing valve 3000 is urged between open and closed positions.

Closing of pressure equalizing valve 3000 can be accomplished by electrically actuating wireline conveyed pump 2000 to direct pressurized fluid downward to equalizing valve 3000. With reference to FIGS. 8A through 8E, pressurized fluid directed downward is urged through central bore 3089, and through closure port 3173 for application of fluid pressure to the uppermost end of closure member 3169. Once one hundred and fifty (150) pounds per square inch of pressure is obtained, pressure relief valve 3127 will move from the normally-closed position to the open position, and allow discharge of the substantially incompressible fluid disposed in cavity 3097, thus allowing piston member 3103 to travel upward from lower end 3151 to upper end 3153.

Pressurized fluid may be pumped downward through central bore 3089 from wireline conveyed pump 2000 (not shown in FIGS. 8A through 8E), through port 3157 into annular region 3163 which is disposed between the lowermost end of piston member 3103 and plug member 3155. When the output pressure from wireline conveyed pump 2000 (not shown in FIGS. 8A through 8E) within central bore 3089 exceeds the selected pressure threshold for pressure relief valve 3127, pressure relief valve 3127 will open, allowing discharge of the substantially incompressible fluid from cavity 3097, and corresponding upward movement of piston member 3103 from lower end 3151 to upper end 3153 of cavity 3097.

As stated above, in the preferred embodiment of the present invention, pressure release valve 3127 is actuated at one hundred and fifty (150) pounds per square inch of pressure. Once piston member 3103 traverses completely upward through cavity 3097 to upper end 3153, fluid pressure continues to build at the upper end of closure member 3169, until fluid pressure of one thousand-five hundred (1,500) pounds per square inch is obtained, upon which threaded shear pin 3181 shears, allowing downward displacement of closure member 3169 relative to plug member 3155 and equalizing port sleeve 3171. The exterior surface of plug member 3155 includes tapered region 3187 which allows O-ring seal 3175 to come out cf sealing engagement with the exterior surface of plug member 3155. As this occurs, O-ring seal 3189, which is carried on the exterior surface, and at the lowermost end, of closure member 3169 will come into sealing engagement with sealing region 3191 on the interior surface of equalizing port sleeve 3171. As a consequence, equalizing port 3183 is sealed from below by O-ring seal 3189, and from above by O-ring seal 3177, which together straddle equalizing port 3183. Another consequence is that flow path 3193 is established between central bore 3089, closure port 3173, tool port 3185, and tool conduit 3167, to allow pressurized wellbore fluid to be directed downward from wireline conveyed pump 2000 to cross flow bridge plug 6000, both of which are shown in FIG. 4.

Referring now to FIGS. 5A through 5M, which depict wireline pump 2000, prior to either pressure testing or running wellbore tool string 11 into wellbore 13, chamber 2050 of the housing 2010 is filled with a clean lubricious fluid, such as kerosene, through the check valve 2015 and the fill port 2014*c*. This insures that the motors disposed in chamber 2050 are completely isolated from contact with well fluids.

As wireline tool string 11 is lowered into wellbore 13, piston 2057 functions as a pressure compensating piston. The position of piston 2057 in chamber 2050 will vary with the external hydrostatic well pressure, to effectively transmit such well pressure to the trapped kerosene contained within chamber 2050. In addition, bias spring 2059 provides additional force to raise the pressure within annular chamber 2050 above the well pressure by a pressure bias to provide at least part of the sealing energization for face seal unit 2044.

Referring again to FIGS. 2 and 4, power supply 35, in wireline truck 21 transmits power to motor subassembly 2003 through wireline 27. With reference again to FIGS. 5A through 5M, a pump drive shaft 2040 extends downward from motor subassembly 2003 to pump subassembly 2005, and is energized by the electric motors disposed in motor subassembly 2003, for actuating one or more fluid pumps which are disposed within pump subassembly 2005. Filter subassembly 2007 is provided below pump subassembly 2005, and serves to receive wellbore fluids disposed in the vicinity of wellbore tool string 11, to filter the wellbore fluids to eliminate particulate matter suspended therein, and to direct the filtered wellbore fluid to an intake of the one or more pumps provided in pump subassembly 2005. The central bore 2024*a* is provided within filter subassembly 2007 for receiving pressurized wellbore fluids from the output of pump subassembly 2005.

Well fluids are supplied to the inlet side of the pumping plungers 2032 through a radial port 2020*c* provided in the lower end of the connecting sub 2020. Well fluids then pass through a cylindrical filtering sleeve or screen 2036. The filtered well fluids then pass upwardly through an annular passage 2025 defined between the exterior of a downwardly projecting mandrel 2024 and the internal bore surface 2020*f* of the connecting sub 2020. The well fluids then pass upwardly through a plurality of peripherally spaced, fluid passages 2018*c* provided in the medial portion of the intermediate housing sleeve element 2018 where the fluids then enter the pump unit 2030. Fluids discharged from pump unit 2030 pass downwardly through the bore 2024*a* of the depending mandrel 2024 and to a well tool connected therebelow (not shown). Check valve 2072 in pumping unit 2030 prevents backflow of pressurized well fluids.

Referring to the pressure extending device, pressure extender 4000, and to FIGS. 9A through 9D, a perspective view of bridge plug 4029, which does not include the cross flow feature at cross-flow bridge plug 6000 of the preferred embodiment, is shown disconnected from hydraulic disconnect 67, and in an inflated condition in gripping engagement with casing 17 of wellbore 13. Bridge plug 4029 includes an inflation chamber which is defined at least in-part by an inner elastomeric sleeve 4055 which is shown in the simplified and fragmentary cross-section view of FIG. 9D Inner elastomeric sleeve 4055 is covered and protected on its exterior surface by an array of flexible overlapping slats 4057. An outer elastomeric layer 4059 is disposed in a central position along the exterior surface of bridge plug 4029, and serves to sealingly and grippingly engage casing 17 on wellbore 13 as pressurized fluid 19 fills inflation chamber 4053 and urges inner elastomeric sleeve 4055, the array of flexible overlapping slats 4057, and outer elastomeric layer 4059 radially outward.

Figure 9A:
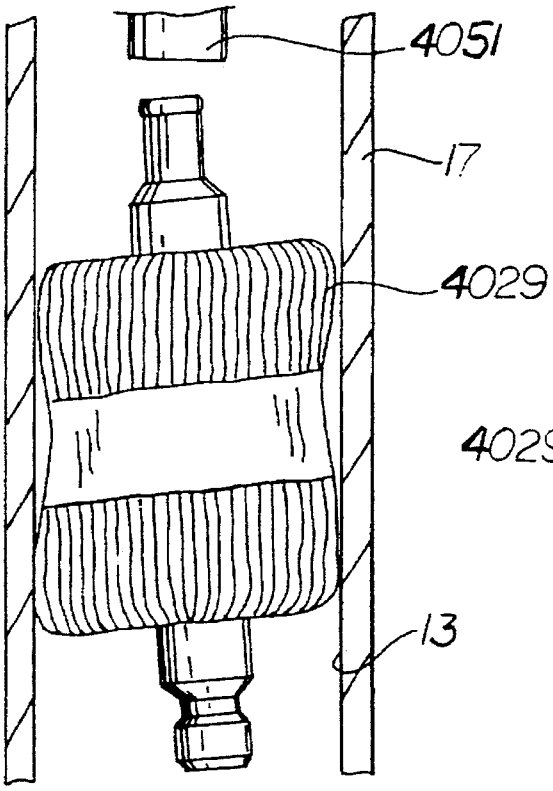
FIG. 9A is a perspective view of a fluid-actuable-inflatable bridge plug in a set position, but not yet "squared-off" relative to the wellbore casing.
Figure 9B:
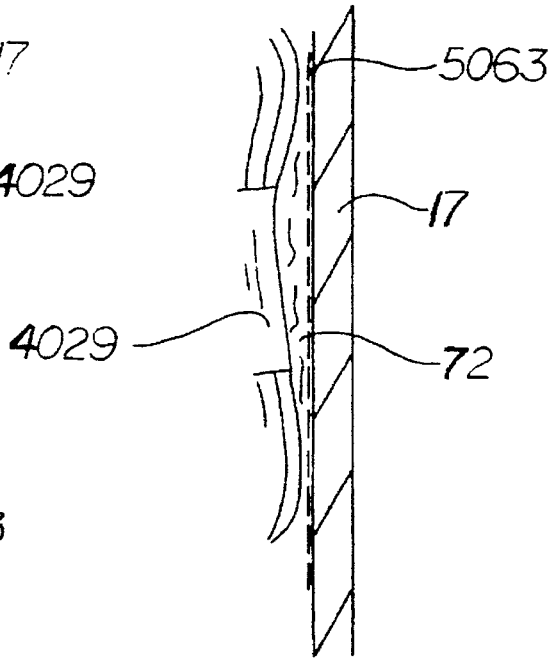
FIG. 9B is a detailed view of the interface of the inflatable bridge plug and wellbore casing of FIG. 9A, with a phantom depiction of the bridge plug squared-off against the wellbore casing.

FIG. 9B is a detailed view of the interface of inflatable bridge plug 4029 and wellbore casing 17 in a partially-set condition prior to squaring off, with fluid 19 trapped between bridge plug 4029 and casing 17. Additionally, bridge plug 4029 is depicted in phantom in a squared-off position against wellbore casing 17. Bridge plug 4029, like other fluid-actuated wellbore tools which include elastomeric components, such as cross flow bridge plug 6000, is susceptible to mechanical failure due to the mechanical characteristics of the elastomeric components, such as eiastomeric sleeves, which comprise such fluid-actuated wellbore tools. Specifically, inner elastomeric sleeve 4055, and outer elastomeric layer 4059, require some not-insignificant amount of time to make complete transitions between deflated running positions and inflated setting positions. It has been discovered that elastomeric sleeves, such as those found in bridge plugs, require several minutes at high inflation pressures to completely conform in shape to the wellbore surface against which it is urged. This process of settling of the shape of the elastomeric sleeve is known as "squaring-off" of the elastomeric element.

Figure 9C:
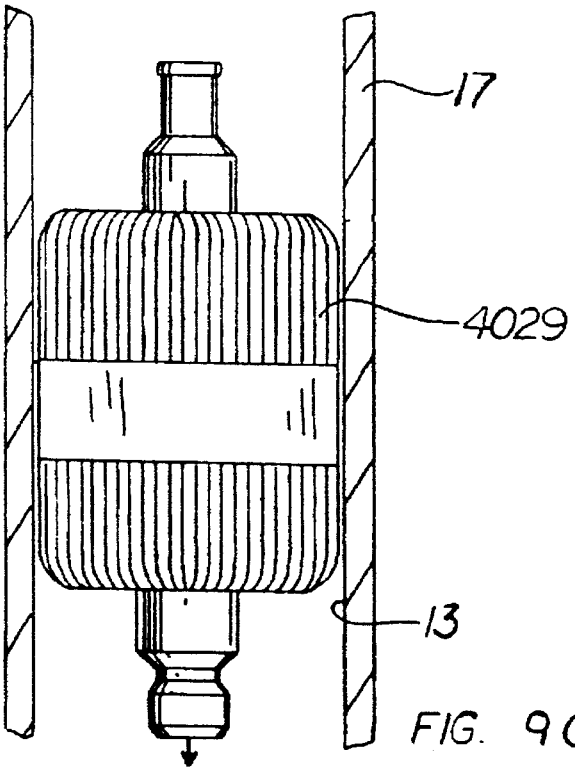
FIG. 9C is a view of the inflatable bridge plug of FIGS. 9A and 9B depicted sliding downward within the wellbore casing, as a result of inflation pressure being released prior to squaring-off of the inflatable bridge plug relative to the wellbore casing.
Figure 9D:
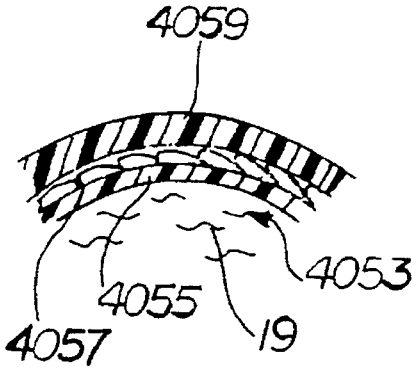
FIG. 9D is a simplified fragmentary cross-section view of the inflatable annular wall of the inflatable bridge plug of FIGS. 9A, 9B, and 9C.

As shown in FIG. 9B, in the inflated condition before squaring-off, fluid 72 is trapped between the annular inflatable wall of bridge plug 4029 and casing 17. This occurs because the elastomeric elements in bridge plug 4029 inherently resist the change in shape between a deflated running condition and an inflated setting condition. Eventually, however, the elastomeric elements will uniformly inflate to obtain a substantially cylindrical shape 5063 (represented by the dashed line in FIG. 9B) and maintain substantially uniform contact with casing 17. However, if inflation of bridge plug 4029 has ceased, the shifting in shape of bridge plug 4029 will result in a fixed amount of fluid 19 within bridge plug 4029 attempting to fill a slightly increased volume in the inflation chamber of bridge plug 4029, Consequently, the pressure of fluid 19 trapped within bridge plug 4029 will drop. Very tiny changes in the volume of bridge plug 4029 due to squaring-off can result in substantial drops in the fluid pressure (in pounds per square inch) which is applied by the fluid to the elastomeric elements of bridge plug 4029, and result in a less effective gripping engagement between bridge plug 4029 and casing 17. As a consequence, bridge plug 4029 may shift in position within wellbore 13 relative to casing 17. FIG. 9C shows bridge plug 4029 in a substantially cylindrical shape, after squaring-off. However, the bridge plug no longer maintains good gripping engagement with casing 17, and thus is free to shift within wellbore 13.

FIGS. 10A through 10E depict in simplified form the prior art current sensing devices which are used to monitor inflation of the inflatable packer, in time-sequence order. In prior art devices, conventional current meter devices are used to monitor the current supplied via wireline 27 to electric motor 2003. The type of pump employed in wireline pump 2000 is a wobble-plate type pump 2030 (shown in FIG. 5A through 5M) which receives wellbore fluid and discharges the wellbore fluid at a higher pressure. Due to the severe geometric constraints imposed upon through-tubing work over equipment, the wireline pump 2000 delivers very small quantities of fluid to bridge plug 4029. Therefore, it frequently takes between one hour to one and one-half hours to completely fill bridge plug 4029, in an ordinary case. In the preferred embodiment, wireline-suspended pump 2000 has an output of approximately 0.17 milliliters per minute. Typically, bridge plug 4029 will set, that is, engage casing 17, at about 50 pounds per square inch of pressure. Also, typically, hydraulic disconnect 5029 of FIG. 4 will disconnect at 1,500 pounds per square inch of pressure.

Typically, ammeter 4065 is monitored to determine the current delivered to electric motor 4043, from which the internal pressure of bridge plug 4029 can be inferred. Ammeter 4065 includes amperage indicator 4067, and graduated dial 4069. Usually, the dial indicates the RMS current flow delivered to electric motor 2003 through wireline 27. As shown, graduated dial 4069 is provided to indicate total amps of current delivered. For purposes of simplicity and exposition, graduated dial 4069 is shown only to depict the range of 0 through 0.8 amps of current. Also, the following amperage readings and time intervals discussed are illustrative only since they indicate relative readings and not exact values that will be encountered under varied conditions in the field.

Figure 10A:
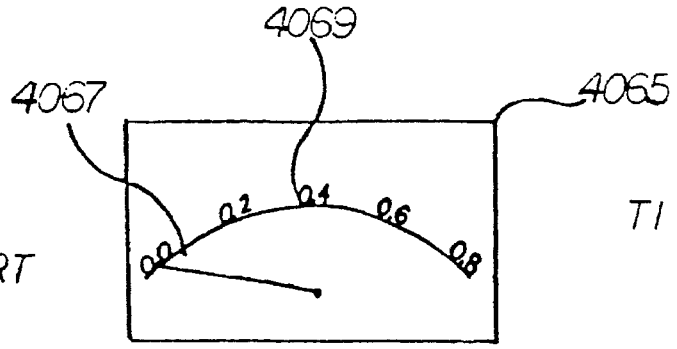
FIG. 10A PRIOR ART
FIGS. 10A, 10B, 10C, 10D and 10E are depictions of a prior art current sensing device which is used to monitor inflation of fluid-actuated wellbore tools, in time-sequence order.
Figure 10B:
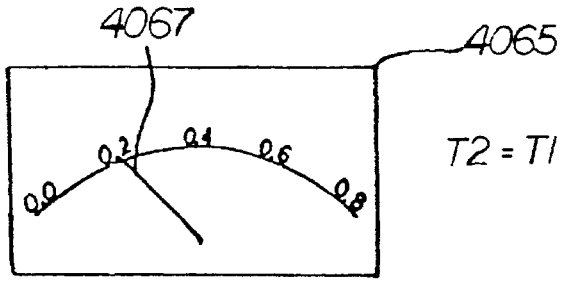
FIG. 10B PRIOR ART

FIG. 10A shows the amperage indicator at time T1, immediately prior to the wireline pump 2000 being started. As shown in FIG. 10B, after time T1 wireline pump 2000 is driven by electric motor 2003 to deliver fluid to bridge plug 4029 or substantial amounts of time, and approximately 200 milliamperes (that is, 0.23 amps) are delivered via wireline 27.

Amperage indicator 4067 remains in the range of 0.20 amps for approximately one hour to one and one-half hours, as shown in FIG. 10B at time T2. However, in a very short interval of time after T2, shown as approximately one minute in FIGS. 10C and 10D, amperage indicator 4067 will rise quickly to approximately 800 milliamps. This indicates to the observant operator that bridge plug 4029 is fully inflated. During this short time interval shown in FIGS. 10C and 10D as one minute, the pressure within bridge plug 4029 will rise rapidly up to 1,500 pounds per square inch of pressure. At 1,500 pounds per square inch of pressure, hydraulic disconnect 5029 operates to release bridge plug 4029. As a consequence, wireline pump 2000 no longer delivers fluid to bridge plug 4029, but continues pumping nonetheless, circulating well fluid 19 back into wellbore 13.

Preferably, to prolong the motor life, electric power to wireline pump 2000 unit should be discontinued, and the pump should be raised to the surface of the wellbore. FIG. 10E depicts ammeter 4065 at time T5 after actuation of hydraulic disconnect 5029. As shown, amperage indicator 4067 returns to a reading of approximately 0.2 amperes of current. If the operator is distracted, it is easy to miss the short time interval of elevated amperage readings depicted in FIGS. 10C and 10D.

Figure 10C:
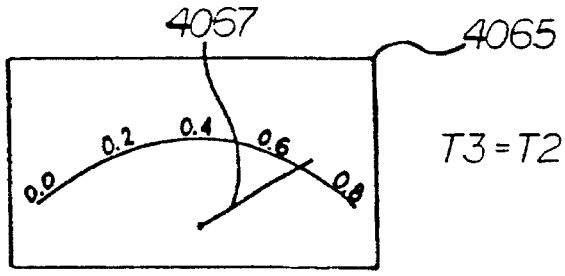
FIG. 10C PRIOR ART
Figure 10D:
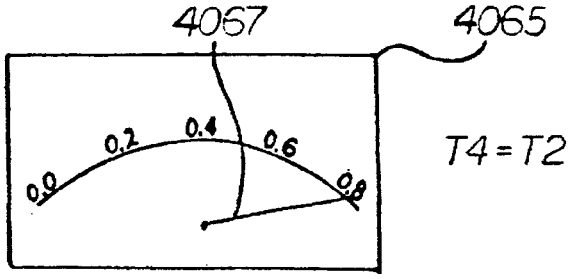
FIG. 10D PRIOR ART
Figure 10E:
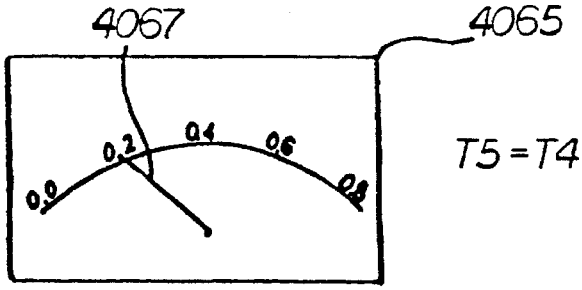
FIG. 10E PRIOR ART

The high amperage readings of FIGS. 10C and 10D are the sole indication to the operator that bridge plug 4029 is indeed fully inflated, and that hydraulic disconnect 5029 is actuated to disconnect bridge plug 4029 from the remainder of wellbore tool string 11. If this indication of pressurization of bridge plug 4029 is missed, the operator may remain at the location for substantial periods of time, with wireline pump 2000 operating for no useful purpose, shortening the life of he expensive pump. This can result in embarrassment to he operator, and a waste of valuable operating time.

with reference to FIGS. 11A through 11D, portions of pressure extender 2000 are shown in fragmentary longitudinal section view and in fragmentary one-quarter longitudinal section views. At the surface of the well, threaded plug 4107 is removed from fill port 4119 to fill annular cavity 4113 with a "clean" filler fluid 4111, such as a light oil or kerosene. The filler fluid 4111 passes from the fill pore 4119 through feed line 4115 to the annular cavity 4113.

Annular plug 4159 operates as a "piston", while inner annular member 4123 and outer annular member 4125 cooperate to define an annular region which operates as a "cylinder" for receipt of annular plug 4159. In operation, annular plug 4159 may be driven from .lower region 4074 to upper region 4073 of pressurization-extending device 4071 when a preselected pressure differential is developed between the fluid carried within central bore 4087 and the filler fluid 4111, which is disposed upward from annular plug 4159. Of course, filler fluid 4111 is considered as incompressible; therefore, in order for annular plug 4159 to be moved upward within annular cavity 4113, pressure-actuated release valve 4109 must be actuated to vent fluid from annular cavity 4113 to wellbore 4021. In the preferred embodiment, pressure-actuated release valve 4109 is selected to vent fluid to the exterior of pressurization-extending device 4071 when pressure within central bore 4087 exceeds 1,000 pounds per square inch. Of course, the force cf the fluid carried within central bore 4087 is transferred to pressure-actuated release valve 4109 through annular plug 4159 and filler fluid 4111.

Upon obtaining the preselected pressure level in central bore 4087, pressure-actuated release valve 4109 is moved from a normally-closed position to an open position to vent fluid to the exterior of pressurization-extending device 4071, and annular plug 4159 is urged to travel from lower region 4074 to upper region 4073 through annular cavity 4113. As annular plug 4159 is moved upward, wellbore fluid 4173 from the pump in housing 404B enters annular cavity 4113.

FIG. 11C is a one-quarter longitudinal section view of a middle region of the preferred pressurization-extending device 5000 of the present invention, in an intermediate operating condition, with wellbore fluid disposed beneath annular plug 4159, and filler fluid 4111 disposed above annular plug 4159. Once pressure-actuated release valve 4109 is moved from the normally-closed position to the open position, the pressure differential between the wellbore fluid 4173 and the filler fluid 4111 will drive annular plug 4159 upward toward upper region 4073 of pressurization-extending device 4071.

FIG. 11D is a fragmentary longitudinal section view of upper region 4073 of the preferred pressurization-extending device 5000 of the present invention. As shown, annular plug 4159 has operated to discharge substantially all filler fluid 4111 from annular cavity 4113 through pressure-actuated release valve 4109. Annular plug 4159 will continue its travel until it abuts lower end 4175 of valve member 4077. Annular plug 4159 serves to prevent wellbore fluid 4173 from exiting through pressure-actuated release valve 4109.

In the preferred embodiment, once 1,000 pounds per square inch of pressure is obtained within central bore 4087 to pressurization-extending device 4071, pressure-actuated release valve 4109 moves between a normally-closed position and an open position. This allows filler fluid 4111 to be discharged through pressure-actuated release valve 4109, and further allows annular plug 4159 to move from lower region 4074 to upper region 4073 within annular cavity 4113. As annular plug 4159 travels within annular cavity 4113, the level of pressure provided to bridge plug 4029 remains constant.

The five minute time interval provided by the travel of annular plug 4159 has been determined, through experimentation, to be a sufficient amount of time for the elastomeric elements contained in bridge plug 4029 to fully inflate. In other words, the five minute time interval has been determined to be a time interval sufficient in length to allow for "squaring-off" of the elastomeric elements of bridge plug 4029. When other inflatable wellbore tools are used, different time intervals may be needed to completely and fully move inflatable elements between deflated running positions and inflated setting positions.

Once annular plug 4159 has traveled the full distance within annular cavity 4113, pressure within central bore 4087, and consequently within bridge plug 4029, begins to build again from 1,000 pounds per square inch to approximately 1,500 pounds per square inch. Upon obtaining 1,500 pounds per square inch of pressure within wellbore tool 4013, hydraulic disconnect 5029 is actuated to separate bridge plug 4029 from the remainder of wellbore tool 11 (shown in FIG. 4). Therefore, it is clear that the timer means which is provided by the preferred pressurization-extending device 4071 of the present invention is sensitive to the actuating force of the pressurized fluid which is provided to the fluid-actuated wellbore tools, such as bridge plug 4029 or cross flow bridge plug 6000. Until pressure-actuated release valve 4109 is moved between normally-closed and open positions, filler fluid 4111 within annular cavity 4113 operates to bias annular plug 4159 to an initial position at lower region 4074 of pressurization-extending device 4000.

The time means provided in the preferred embodiment of pressurization-extending device 4000 is operable in a plurality of operating modes, including: an initial operating mode, a start-up operation mode, a timing operating mode, and a termination operation mode. During the initial operation mode, annular plug 4159 is urged into its initial position at lower region 4074 of pressurization-extending device 4071 by the biasing means, which preferably comprises filler fluid 111 in annular cavity 4113, which is substantially incompressible and held in position by pressure-actuated release valve 4109. During a start-up operating mode, the means for biasing is at least in-part overridden. Preferably, pressure-actuated release valve 4109 does not allow filler fluid 4111 to "gush" from annular cavity 4113. Rather, the venting ports are similar in size to port 4157.

In a timing mode of operation, annular plug 4159 is moved between lower region 4074 and upper region 4073, and thus between opposite ends of annular cavity 4113, in the duration of a preselected time interval, while at least a portion of the pressurized fluid within central bore 4087 is diverted into annular cavity 4113. During a termination mode of operation, annular plug 4159 is disposed at the upper region 4073 of pressurization-extending device 4071, and pressurized fluid is no longer diverted into annular cavity 4113, and is instead directed to the fluid-actuated wellbore tool, such as bridge plug 4029 or cross flow bridge plug 6000.

Figure 12A:
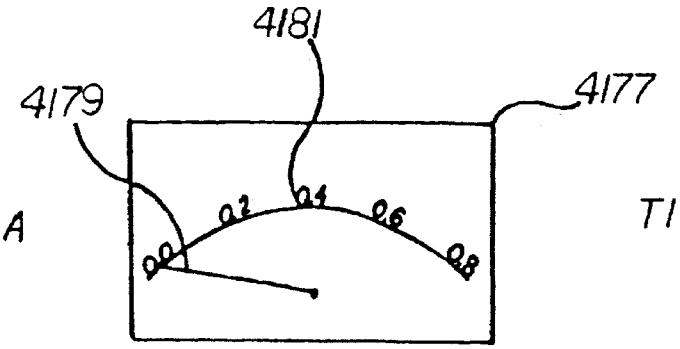
FIGS. 12A, 12B, 12C, 12D and 12E are depictions of a prior art current sensing device which is used to monitor inflation of fluid-actuated wellbore tools, in time-sequence order, which illustrate one advantage of the use of the pressurization-extending device of the present invention.
Figure 12B:
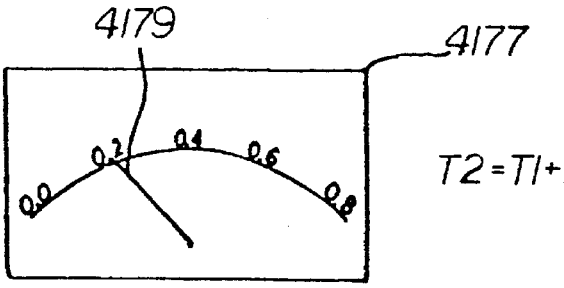

The preferred pressurization-extending device 4071 of the present invention is also advantageous over the prior art in that it provides a visual indication of the operation of the "timing" function of the present invention. FIGS. 12A, 12B, 12C, 12D, and 12E are simplified depictions of the prior art current sensing device which is used to monitor inflation of a fluid-actuated wellbore tool, in time-sequence order, which illustrate one advantage in using the pressurization-extending device 4000 of the present invention. The following amperage values and time increments are discussed for illustrative purposes only, and do not represent exact values that would be seen in the field under varied conditions. As shown, ammeter 4177 includes amperage indicator 4179 and graduated dial 4181. Prior to initiating operation of pressurization-extending device 4000, no current is indicated on amperage indicator 4179 as is shown in FIG. 12A immediately prior to time T1. As shown in FIG. 12B, from time T1 until time T2, amperage indicator 4179 reveals that the total current delivered to electric motor 5003 is in the range of 0.20 amperes. As in the prior art, it requires approximately one hour to one and one-half hours to fill bridge plug 4029.

Figure 12C:
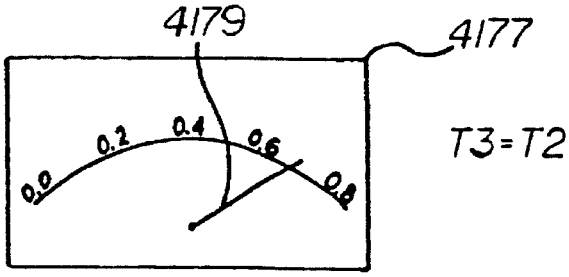
Figure 12D:
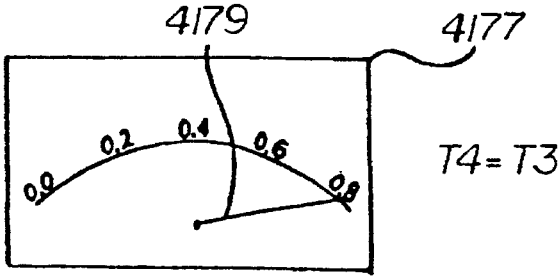
Figure 12E:
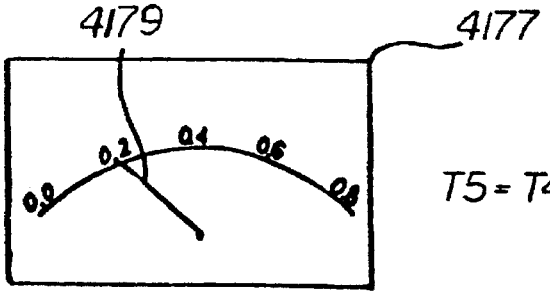

As shown in FIG. 12C, at time T3, time T2 plus five minutes, amperage indicator 4179 has increased to indicate that electric motor 5003 is drawing 0.60 amperes of current. This indicates to the operator that approximately 1,000 pounds per square inch of pressure has been obtained within bridge plug 4029. As stated above, this pressure level is sufficient to actuate pressure-actuated release valve 4109, and allow filler fluid 4111 to exit from annular cavity 4113. The pressure within bridge plug 4029 will be maintained at approximately 1,000 pounds per square inch for the duration of travel of annular plug 4159, which is about five minutes. Therefore, as shown in FIG. 12C, the current supplied to electric motor 5003 is maintained at 0.6 amps for approximately five minutes. This five minute interval of constant pressure within bridge plug 4029 serves to fully inflate bridge plug 4029 and allow "squaring-off" of the elastomeric elements therein. This five minute interval also alerts the operator to the fact that the pressurization-extending device 4000 of the present invention has been actuated. The five minute interval provides a significantly longer indication of full inflation of bridge plug 4029, and thus minimizes the chance of the operator failing to detect full pressurization of bridge plug 4029. As shown in FIG. 12D, after the expiration of the five minute time interval, pressure begins to increase rapidly, going from 1,000 p.s.i. to 1,500 p.s.i., until the hydraulic disconnect is actuated at time T4. This elevation in pressure is indicated by a rise in amperage to 0.8 amperes. Thereafter, as shown in FIG. 12E, the amperage backs down to approximately 0.2 amperes.

With reference to FIG. 2, when the inflatable wellbore tool of the preferred embodiment of the present invention, cross flow bridge plug 6000, is lowered within wellbore 13 on wireline tool string 11, through production tubing string 19, the well may be flowing between zones or to the surface. The well may also be flowing from formation 43 and into wellbore 13, such as in response to the pressure differential between formation 43 and wellbore 13. Consequently, a pressure differential may develop between upper region 57 and lower region 59 of wellbore 13 due to the obstruction to flow presented by the inflation of bridge plug 6000. As stated above, in an expansion mode of operation, inflatable wellbore tool 6000 is urged radially outward from a reduced radial dimension to an intermediate radial dimension which at least in-part obstructs the flow of wellbore fluid within the wellbore in the region of inflatable wellbore tool 6000.

This obstruction creates a pressure differential between upper region 57 and lower region 59. If greater pressure is present in upper region 57 than in lower region 59, a downward axial force is exerted on bridge plug 6000. In contrast, if a greater pressure exists at lower region 59 than at upper region 57, an upward axial force is applied to bridge plug 6000. The pressure differential across bridge plug 6000 can be great enough to physically displace bridge plug 6000 significant distances within wellbore 13, thus undermining engineering objectives, and perhaps impairing the performance of the oil and gas well. Alternately, the pressure differential across bridge plug 6000 can become so great as to accidentally disconnect connector 45 from electric cable 27, causing loss of fluid-actuated wireline tool string 11 within wellbore 16.

A similar problem is present in tubing-conveyed delivery systems, as shown in FIG. 1.

As bridge plug 6000 is inflated from a running in the hole mode of operation with a reduced radial dimension to a setting mode of operation in gripping engagement with casing 83, the passage of fluid upward or downward within wellbore 81 is at least in-part obstructed by bridge plug 6000. Consequently, a pressure differential may develop between upper region 107 and lower region 109. The pressure differential may operate to displace bridge plug 6000, and cause it to be set in a fixed position in an undesirable location, or it may cause hydraulic disconnect 5000 to fail, and prematurely release bridge plug 6000.

FIG. 21B depicts valving subassembly 6135 in a running and inflation mode of operation, in which high pressure inflation fluid is directed downward through central bore 6173 of stationary ratchet piece 6183, and through gaps 6203, 6205, 6207, 6209 between collets 6195, 6197, 6199, 6201 of movable valve stem 6193. Fluid is then directed through fluid flow passages 6251, 6253 of retaining ring 6249, and into inflation passages 6255, 6257 of valve nipple 6181. High pressure fluid is directed to fluid-actuated wellbore tool 6139, of FIG. 20, and urges it from a deflated running position to an inflated setting position.

With reference to FIG. 20, fluid-actuated wellbore tool 6000 is shown after actuation by high pressure wellbore fluid having filled fluid inflated packer to an inflated setting position. However, valving subassembly 6135 of (shown in FIG. 21B) communicates with port 6143 and allows high pressure wellbore fluid to be passed through fluid-inflatable packer 6139, without interfering with the inflation thereof, and into central bore 6263 of valve nipple 6181, for passage into the annular space between valving subassembly 6135 and casing 6125 of wellbore 6123. This allows the pressure differential developed across fluid-inflatable packer 6139 to be lessened. Of course, if the pressure in annular region surrounding valving subassembly 6135 exceeds the pressure beneath fluid-actuated wellbore tool 6139, fluid may flow downward through ports 6145, 6147 and exit port 6143 (shown in FIG. 3).

With reference to FIG. 21C, when the fluid pressure above popper valve 6277 exceeds the upward force of popper spring 6283, poppet valve 6277 is urged downward relative to mandrel 6271 and popper housing 6269, to allow high pressure fluid to pass along the inner surface of popper housing 6269, and flow downward through central passage 6315, in which popper spring 6283 resides, and into inflation chamber 6299. The high pressure fluid acts to outwardly radially expand annular inflatable wall 6305 and move it between a deflated running position and an inflated setting position.

Figure 25:
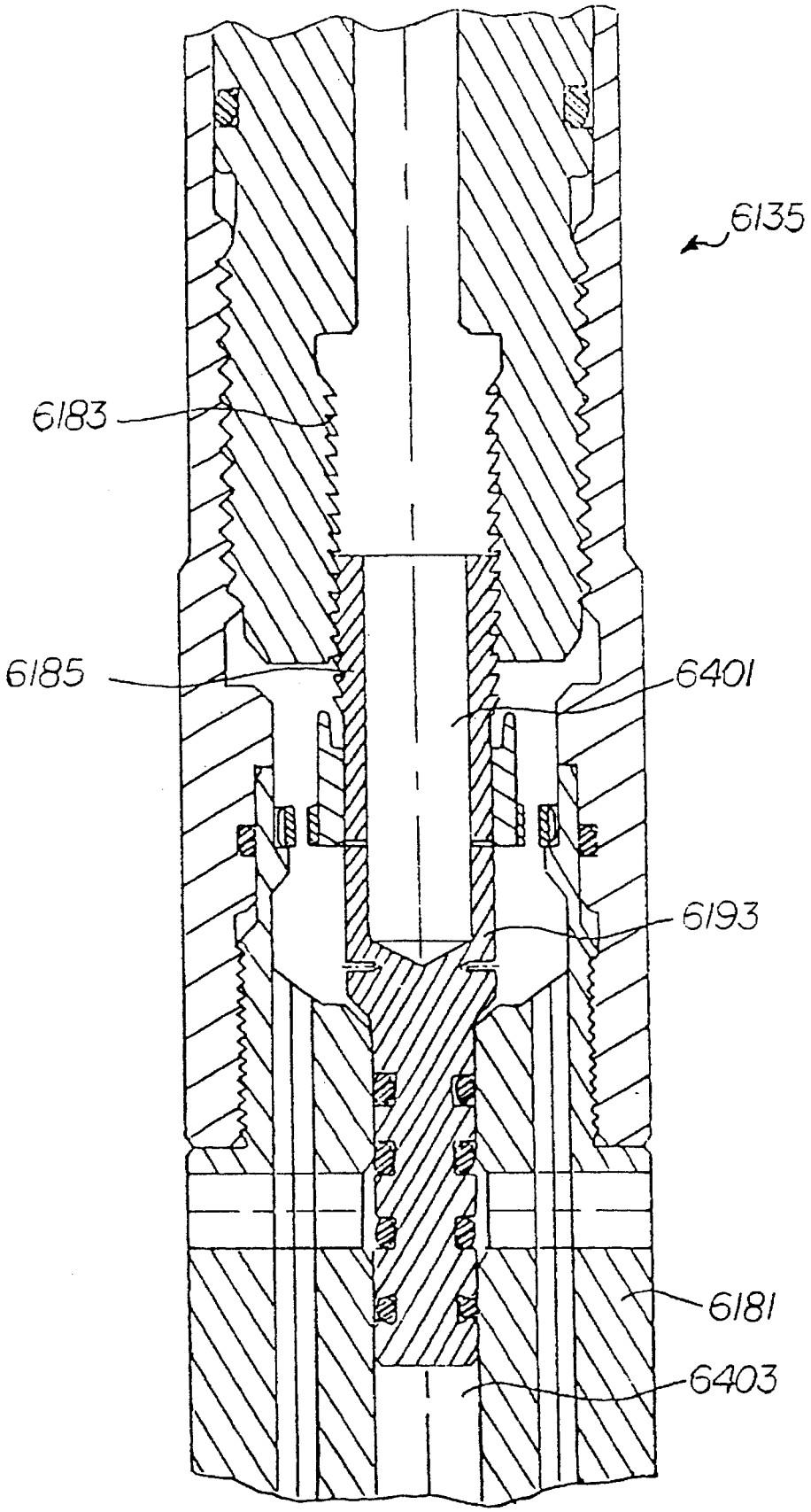
FIG. 25 is a longitudinal section view of the preferred valving subassembly of the preferred settable wellbore tool of the present invention, in a setting mode of operation.

FIG. 25 is a longitudinal section view of relying subassembly 6135 with movable valve stem 6193 moved into a "closed" position relative to valve nipple 6181. As shown, the fluid pressure in region 6401 has exceeded the fluid pressure in region 6403 by the amount of force required to shear pins 6221, 6223, 6225, and 6227, as well as the force required to move movable ratchet piece 6185, which comprise collets 6195, 6197, 6199, and 6201, relative to stationary ratchet piece 6183. The amount of force required to move movable ratchet piece 6185 relative to stationary ratchet piece may be designed to be a small value, so that the total force required to move movable valve stem 6193 into a "closed" position relative to valve nipple 6188 comprises the force required to shear shear pins 6221, 6223, 6225, 6227. In summary, with reference to FIGS. 20, 21B, and 25, the present invention allows for fluid flow between upper region 6149 and lower region 6151 of wellbore 6123. Specifically, fluid is allowed to flow between ports 6143, 6145, and 6147, until a predetermined inflation pressure is obtained within the inflation chamber of fluid-inflatable packer 6139. This pressure level corresponds with the pressure differential which must be developed across movable valve stem 6193 in order to shear shear pins 6221, 6223, 6225, 6227, and move movable ratchet piece 6185 relative to stationary ratchet piece 6183. Preferably, this pressure level is selected so that fluid-inflatable packer 6139 is completely set and fixed in position relative to casing 6125. At this point, it is safe to close off communication between ports 6143, 6145, and 6147 to prevent the flow of fluid across fluid-inflatable packer 6139.

Referring FIG. 4, hydraulic disconnect 67 is connected between bridge plug 6000 and pull-release disconnect 5000 and serves as a primary release device to disconnect bridge plug 6000 from the upper portion of wireline tool string 11. Hydraulic disconnect 67 is actuated when a predetermined pressure level is exceeded within wireline tool string 11, which is in excess of the pressure level required for setting of bridge plug 6000. In the event of an equipment failure that prevents hydraulic disconnect 67 from operating, pull-release disconnect 5000 may be utlized to seperate bridge plug 6000 from the upper retrievable portion 5025 of wireline setting tool string 11.

With reference to FIG. 13, pull-release disconnect 5000 is especially suited for use in setting tool strings, such as wireline setting tool string 11, which includes a lower delivered portion 5027 which includes a support means, bridge plug 6000, which operates to support lower delivered portion 5027 of setting tool string 11 within wellbore 13 independently of wireline 27, or similar suspension means such as a working string or coiled tubing string.

The preferred embodiment of pull-release disconnect 5000 of the present invention operates in a number of modes to take into account a variety of wellbore problems and conditions. In a running in the hole mode of operation, pull-release disconnect 5000 prevents unintended actuation of lower delivered portion 5027 of setting tool string 11. Also, in a running in the hole mode of operation, pull-release disconnect 5000 operates to prevent the unintended disconnection of upper retrievable portion 5025 from lower delivered portion 5027 of setting tool string 11. In a setting mode of operation, pull-release disconnect 5000 operates to allow actuation of lowered delivered portion 5027 of setting tool string 11 by upper retrievable portion 5025.

In a first release mode of operation, pull-release disconnect 5000 operates to disconnect upper retrievable portion 5025 of setting tool string 11 from lower delivered portion 5027 in the event the primary release device, hydraulic disconnect 67, fails to operate properly. In a second (emergency) release mode of operation, pull-release disconnect 5000 operates to disconnect upper retrievable portion 5025 of setting tool string 11 from lower delivered portion 5027 in the event that setting tool string 11 becomes stuck in wellbore 13, or more particularly, if setting tool string 11 becomes stuck in a string of tubular conduit, such as tubular conduit 19.

The pull-release disconnect 5000 of the present invention is especially adapted for use when setting tool string 11 is raised and lowered within wellbore 13 through the central bore of tubular conduit 19. In such through-tubing applications, clearances are tight and the risks of becoming stuck are great.

As is well known by one skilled in the art, bridge plug 6000 is adapted for receiving pressurized wellbore fluid from a means of pressurizing fluid, such as wireline pump 2000, and includes valving which directs pressurized fluid into an inflation chamber which outwardly radially expands flexible elements which serve to grippingly and sealingly engage a wellbore surface, such as string of tubular conduits 19 or casing 17 (shown in FIG. 2). Therefore, bridge plug 6000 is adapted to support itself within wellbore 19 without the assistance of wireline 27 or other suspension means.

Once bridge plug 6000 is fixedly positioned within wellbore 19, the remaining principal concern is that the expensive through-tubing wellbore pump 2000 be retrieved from wellbore 19 by wireline 27, or other suspension means. Pull-release disconnect 5000 provides multiple modes of release operation, to ensure that through-tubing wellbore pump 2000 is indeed separated or disconnected from bridge plug 6000. Should both pull-release disconnect 5000 and. hydraulic disconnect 67 fail to release, through-tubing wellbore pump 6000 may be irretrievably positioned within wellbore 19, at significant expense, since such specialized wellbore pumps frequently cost tens of thousands of dollars.

The different operating modes of pull-release disconnect 5000 of the present invention are more clearly set forth in FIGS. 16 through 19, which are partial longitudinal section views of the preferred pull-release disconnect 5000 of the present invention in a plurality of modes including: a running in the hole mode, a setting mode, an ordinary pull-release mode, and an emergency pull-release mode.

Figure 16:
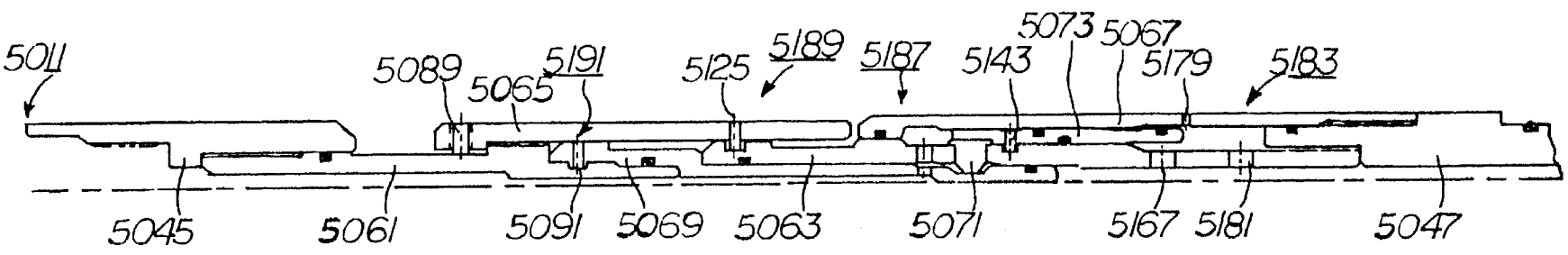
FIG. 16 is a partial longitudinal section view of the preferred pull-release disconnect of the present invention in a running in the hole mode of operation during run-in into the wellbore.

FIG. 16 is a partial longitudinal section view of the preferred pull-release disconnect 5000 of the present invention in a running in the hole mode of operation during run-in into wellbore 19. As shown in this figure, upper cylindrical collar 5045 is positioned to the left in the figure, and lower cylindrical collar 5047 is positioned to the right in the figure. As shown, upper cylindrical collar 5045 is coupled by threads to upper inner mandrel 5061. Upper outer body piece 5065 is coupled by set screw 5089 to upper inner mandrel 5061. For purposes of exposition, set screw 5089 is represented by a dashed line. Upper outer body piece 5065 is coupled to lower inner mandrel by first latch means 5189. For purposes of exposition, first latch means 5189 includes shearable connector 5125 which is represented by a dashed line. Upper inner mandrel 5061 is connected to lock piece at second latch means 5191. Second latch means 5191 includes shearable connector 5091 which is represented by a dashed line.

Lower inner mandrel 5063 and lock piece 5069 are held together by locking key 5071. Locking key 5071 is held in place by hydraulically-actuated slidable sleeve 5073. Hydraulically-actuated slidable sleeve 5073 is held in place relative to lower inner mandrel 5063 by shearable connector 5143, which is represented by a dashed line. Pull-release disconnect further includes conduit port 5167, and pressure equalization ports 5179, 5181, which cooperate together to equalize pressure within pull-release disconnect and fluid-actuated tools below.

During a running in the hole mode of operation, pull-release disconnect 5000 accomplishes two objectives. First, locking key 5071 is mechanically in parallel with first latch means 5189, and serves to prevent inadvertent opening of first latch means 5189 by accidental shearing of shearable connector 5125. Second, vent means 5183, which includes the coordinated operation of conduit port 7, and pressure equalization ports 5179, 5181, serves to prevent gas which is trapped within pull-release disconnect 5000 from accidentally actuating the fluid-actuated tool or tools which are carried in the string.

Each of these two problems deserves additional consideration. In the preferred embodiment, pull-release disconnect 5000 of the present invention is carried in a string of subassemblies, as shown in FIGS. 13 and 14, and described above. The string is raised and lowered within wellbore 13 by either a wireline 27, or a work string of tubular conduits. As the setting tool string 11 is raised and lowered within the wellbore, it is possible that axial force will be applied to pull-release disconnect 5000 in an amount which exceeds the force threshold for shearable connector 5125, or the plurality of connectors like shearable connector 5125.

In the preferred embodiment, first latch means 5189 is switched between latched and unlatched positions by application of an upward force in an amount which exceeds a first preselected force magnitude. As discussed above, the force is established by selection of one of more shearable connectors 5125 which are severed in the preferred embodiment by applying an upward force on pull-release disconnect 5000. However, in alternative embodiments, it is possible to have a first latch means 5189 which is moved between latched and unlatched positions by application of a upward force excess of a preselected force limit magnitude.

In the preferred embodiment, this force magnitude may be set in the range of eighteen hundred pounds of force. Preferably, lock means 5187, which includes locking key 5071 which releasably mates with lock piece 5069 through lower inner mandrel 5063, is adapted to withstand forces in excess of eighteen hundred pounds of force. Therefore, lock means 5187 operates to prevent the inadvertent shearing of shearable connector 5125 as setting tool string 11 is raised and lowered within wellbore 13.

The vent means 5183 is particularly useful to prevent the inadvertent actuation of hydraulically-actuated wellbore tools. The inadvertent actuation of wellbore tools, such as packers, liner hangers, and bridge plugs, is most acute when setting tool string 11 is raised within wellbore 13. Natural gas may become trapped within setting tool string 11 at a deep, high-pressure environment. When setting tool string 11 is raised within wellbore 13 to a shallower, lower-pressure environment, the natural gas trapped within setting tool string 11 may expand, and inadvertently actuate fluid-actuated tools.

Figure 17:
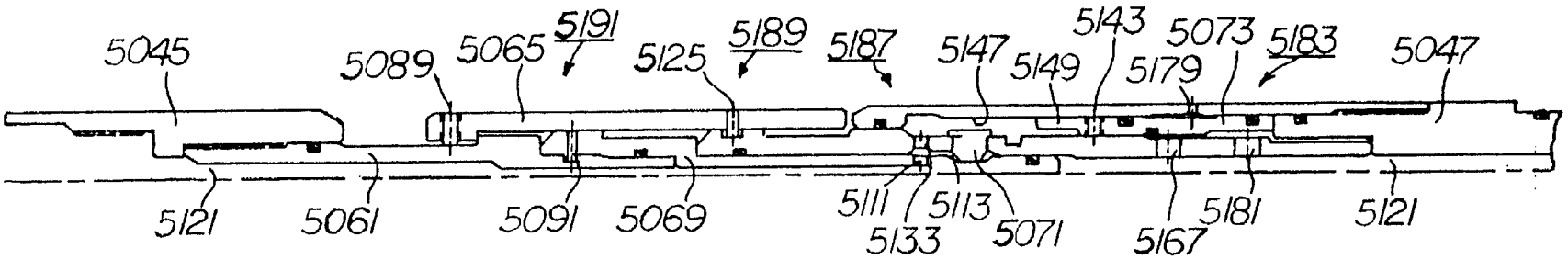
FIG. 17 is a partial longitudinal section view of the preferred pull-release disconnect of the present invention in a setting mode of operation.

This is a particular problem in through-tubing applications where the clearance is quite small between setting tool strings, such as wireline tool 11, and a string of tubular conduit, such as tubular conduit 19 (see FIG. 2). Setting tool string 11 may be raised within wellbore 13 for a number of reasons, including an inability to position setting tool string 11 at a desired location within wellbore 13. If a packer or bridge plug inadvertently inflates and sets within a string of tubular conduit, such as tubular condiut 19, as setting tool string 11 is raised within wellbore 13, this could present very serious problems, requiring that a special tool be lowered within the well to puncture the packer or bridge plug to allow setting tool string 11 to be removed from wellbore 13. FIG. 17 is a partial longitudinal section view of the preferred pull-release disconnect 5000 of the present invention in a setting mode of operation. During this mode of operation, high pressure wellbore fluid is directed downward through pull-release disconnect 5000. Specifically, pressurized fluid is directed downward through central fluid conduit 5121, then through bypass ports 5111, 5133, into bypass cavity 5147. The high pressure wellbore fluid exerts downward force on hydraulically-actuated shearable sleeve 5073, causing shearable connector 5143 to shear. In the preferred embodiment, hydraulically-actuated sleeve moves downward at 1,500 p.s.i. of pressure, as determined by the size and strength of shearable connector 5143. As a result, hydraulically-actuated slidable sleeve 5073 is urged downward within bypass cavity 5147. In the closed position the "vent means" 5183 which is defined by these components switches from an open to a closed position with hydraulically-actuated slidable sleeve 5073 closing off the communication of wellbore fluid through conduit port 5167, and pressure equalization ports 5171, 5181. Also, high pressure fluid is diverted through bypass cavity 5147 across the interface of hydraulically-actuated slidable sleeve 5073 and lower inner mandrel 5063. The high pressure fluid will be shunted back into central fluid conduit 5121 by conduit port 5167, and pressure equalization port 5181.

Another consequence of the downward movement of hydraulically-actuated slidable sleeve 5073 is that key retaining segment 5149 of fluid-actuated slidable sleeve 5073 is no longer maintaining locking key 5071 in locking groove 5113. Consequently, first latch means 5189 can be moved between latched and unlatched positions by application of axial force of the preselected magnitude.

FIG. 18 is a partial longitudinal section view of the preferred pull-release disconnect 5000 of the present invention in an ordinary pull-release mode of operation. As discussed above, pull-release disconnect 5000 is especially useful to supplement the primary release device, which is hydraulic disconnect 19 in setting tool string 11. Usually, a primary release device is a fluid-actuated device such as hydraulic disconnect 19. However, in other embodiments of the present invention, other types of primary release devices could be utilized, including pull-release disconnect 5000. Should the primary release device fail to operate properly, pull-release disconnect 5000 allows for release of an upper retrievable portion 5025 of setting tool string 5013 from a lower delivered portion 5027, by mechanical means.

The high pressure wellbore fluid which is directed downward through pull-release disconnect 5000 serves to set lowered delivered portion 5027 in a fixed position within wellbore 13. As a consequence of this setting, hydraulically-actuated slidable sleeve 5073 is urged downward within bypass cavity 5147. Consequently, key retaining segment 5149 of hydraulically-actuated slidable sleeve 5073 no longer maintains locking key 5071 in a locked position within lock groove 5113 of lock piece 5069. Consequently, locking key 5071 will move radially inward allowing shearable connector 5125 to be sheared by application of axial force to pull-release disconnect 5000. As stated above, preferably shearable connector 5125 sets a known axial force limit, such as eighteen hundred pounds of force, which can be selectively applied to setting tool string 11 by wireline 27 or similar suspension means.

FIG. 19 is a partial longitudinal section view cf the preferred pull-release disconnect 5000 in the present invention in an emergency pull-release mode of operation. This emergency pull-release mode of operation is responsive to a situation which arises from the failure of hydraulically-actuated slidable sleeve 5073 to slide downward within bypass cavity 5147 in response to nigh pressure fluid which is directed downward through central fluid conduit 5121. When this occurs, lock piece 5069 is fixed in position relative to lower cylindrical collar 5047, and cannot be removed from the wellbore. In this event, a greater axial force, preferably an upward axial force applied through wireline 27. or another similar suspension means, is applied to the setting tool string 11, causing shearable connector 5125 and shearable connector 5091 to shear.

In the preferred embodiment, shearable connector 5091 is set to shear at approximately four thousand pounds of axial force. Therefore, in the preferred embodiment, second latch means 5191 will move between open and closed positions simultaneous with first latch means 5189, when approximately fifty-eight hundred pounds of axial force is applied to pull-release disconnect 5000. The emergency release mode of operation shown in FIG. 19 is particularly useful when setting tool string 11 becomes lodged in an undesired position during the running in or running out of the wellbore.

While the invention has been shown in only one of its forms, it is not thus limited but is susceptible to various changes and modifications without departing from the spirit thereof.

What is claimed is:

1. A wellbore tool for use in a wellbore having a production tubing string disposed therein, comprising:

(a) a source of pressurized fluid which selectively discharges fluid, and which includes:

a housing insertable through said production tubing string in said wellbore;

(2) at least one electric motor disposed within said housing; and (3) a pump member driven by said at least one electric motor for receiving and discharging an actuation fluid;

(b) a fluid-pressure actuable wellbore tool which is operable in a plurality of modes of operation, including at least a running in the hole mode of operation with said fluid-pressure actuable wellbore tool in a running condition, and an actuated mode of operation with said fluid-actuable wellbore tool in an actuated condition, wherein during said running in the hole mode of operation said fluid-pressure actuable wellbore tool is insertable through said production tubing string in said wellbore;

(c) a delivery mechanism for selectively raising and lowering said source of pressurized fluid and said fluid-pressure actuable wellbore tool to selected locations within said wellbore through said production tubing string;

(d) means for selectively separating said fluid-pressure actuable wellbore tool from said source of pressurized fluid and allowing removal of said source of pressurized fluid from said wellbore while said fluid-pressure actuable wellbore tool remains in said wellbore; and (e) means for providing automatically and without surface intervention a predefined actuation force to said fluid-pressure actuable wellbore tool while switching between said running in the hole mode of operation and said actuated mode of operation.

2. A wellbore tool according to claim 1, further comprising:

(f) an equalizing member for maintaining said fluid-pressure actuable wellbore tool in said running condition and insensitive to unintentional and transient pressure differentials between an interior portion of said fluid-pressure actuable wellbore tool and a region exterior of said fluid-pressure actuable wellbore tool.

3. A wellbore tool according to claim 2, wherein said equalizing member comprises:

(a) a housing insertable through said production tubing string;

(b) a flow path in said housing for maintaining fluid communication with at least said fluid-pressure actuable wellbore tool;

(c) an equalizing port for establishing fluid communication between an interior portion of said fluid-pressure actuable wellbore tool and a region exterior of said fluid-pressure actuable wellbore tool during said running in the hole mode of operation and for maintaining said fluid-pressure actuable wellbore tool in a running condition and insensitive to unintentional and transient pressure differentials between said interior portion of said fluid-pressure actuable wellbore tool and said region exterior of said fluid-pressure actuable wellbore tool; and (d) a selectively-actuable closure member for obstructing said equalizing port to discontinue fluid communication between said interior portion of said fluid-pressure actuable wellbore tool and said region exterior of said fluid-pressure actuable wellbore tool to allow build up of pressure within said fluid-pressure actuable wellbore tool.

4. A wellbore tool according to claim 3 wherein said equalizing apparatus further includes:

(e) a means for diminishing force transfer from gas trapped within said source of pressurized fluid to said equalizing member.

5. A wellbore tool according to claim 3 wherein said equalizing member further includes:

(e) a volume expander member which provides a cavity which diminishes force transfer from gas trapped within said source of pressurized fluid to maintain said selectively-actuable closure member in a fixed and non-obstructing position to prevent unintentional closure of said equalizing port.

6. A wellbore tool according claim 3 wherein said equalizing member further includes:

(e) a latch member for maintaining said selectively-actuable closure member in a fixed and non-obstructing position relative to said equalizing port until said source of pressurized fluid is actuated to initiate switching of said fluid-pressure actuable wellbore tool between said running condition and said actuated condition.

7. A wellbore tool according to claim 3, wherein during said running in the hole mode of operation said selectively-actuable closure member blocks fluid communication between said fluid-pressure actuable wellbore tool and said source of pressurized fluid.

8. A wellbore tool according to claim 3, wherein said selectively-actuable closure member comprises a sleeve which blocks a fluid flow path between said source of pressurized fluid and said fluid-pressure actuable wellbore tool.

9. A wellbore tool according to claim 6, wherein said latch member comprises a shearable fastener which holds a sleeve in a fluid blocking position until a preselected pressure level is applied to said selectively-actuable closure member.

10. A wellbore tool according to claim 5, wherein said volume expander member includes:

(a) a cavity having first and second ends;

(b) a piston member disposed in said cavity at said first end;

(c) a substantially incompressible fluid for filling said cavity between said piston member and said second end of said cavity;

(d) a normally-closed pressure relief valve in communication with said substantially incompressible fluid in said cavity, which is urgable to an open position when said substantially incompressible fluid obtains a preselected pressure level;

(e) conduit means for providing fluid communication between said source of pressurized fluid and said first end of said cavity for applying force from said gas to said piston member; and (f) wherein said substantially incompressible fluid and said normally-closed pressure relief valve together prevent movement of said piston member within said cavity until said force from said gas which is applied to said piston member exceeds said preselected pressure level of said normally-closed pressure relief valve to urge said normally-closed pressure relief valve to said open position to allow venting of said substantially incompressible fluid and movement of said piston member relative to said cavity thus allowing said cavity to receive said gas.

11. A wellbore tool according to claim 1, wherein said means for providing comprises:

a pressurization-extending member for automatically maintaining an actuating force of said actuation fluid from said source of pressurized fluid at a preselected force level for a preselected time interval.

12. A wellbore tool according to claim 11, wherein said pressurization-extending member includes:

input means for receiving a pressurized actuation fluid from said source of pressurized fluid;

output means for directing said pressurized actuation fluid to said fluid-actuated wellbore tool to supply an actuating force to said fluid-actuated wellbore tool; and timer means, responsive to said actuating force of said pressurized actuation fluid, for automatically maintaining said actuating force of said pressurized fluid within said fluid-actuated wellbore tool at a preselected force level for a preselected time interval.

13. A wellbore tool according to claim 12, wherein said timer means include a fluid cavity which communicates with said input means through a bypass channel, and which is adapted in volume to receive a predetermined amount of fluid over said preselected time interval.

14. A wellbore tool according to claim 12, wherein said timer means includes at least one moveable piece and at least one stationary piece, and wherein said at least one moveable piece is advanced relative to said at least one stationary piece by said pressurized fluid from an initial condition to a final condition, and wherein passage of said at least one moveable piece from said initial condition to said final condition defines said preselected time interval of said timer means.

15. A wellbore tool according to claim 12, wherein said timer means includes:

a piston member disposed in a first condition during an initial operating mode, blocking passage of pressurized fluid to said fluid-actuated wellbore tool;

means for biasing said piston member toward said first condition until a preselected pressure level is obtained in said pressurized fluid;

wherein said timer means is operable in a plurality of operating modes, including:

an initial operating mode, wherein said piston member is urged into said first condition, by said means for biasing;

a start-up operating mode, wherein said means for biasing is at least in-part overridden;

a timing operating mode, wherein said piston member is moved between said first condition and a second condition in the duration of said preselected time interval while at least a portion of said pressurized fluid is diverted; and a termination operating mode, wherein said piston member is disposed in said second condition, said pressurized fluid is no longer diverted and is instead directed to said fluid-actuated wellbore tool through said output means.

16. A wellbore tool according to claim 12, wherein said timer means comprises:

a cavity having first and second ends which at least in-part define a preselected volume;

a bypass channel for communicating said pressurized fluid to said first end of said cavity;

a piston member moveable within said cavity and disposed at said first end during an initial operating mode, blocking passage of pressurized fluid from said bypass channel into said chamber;

means for biasing said piston member toward said first end until a preselected pressure level is obtained in said pressurized fluid;

wherein said timer means is operable in a plurality of operating modes, including:

an initial operating mode, wherein said piston member is urged into an initial position at said first end, by said means for biasing;

a start-up operating mode, wherein said means for biasing is at least in-part overridden;

a timing operating mode,/wherein said piston member is moved between said first and second ends of said cavity in the duration of said preselected time interval while at least a portion of said pressurized fluid is diverted to said cavity; and a termination operating mode, wherein said piston member is disposed at said second end of said cavity, said pressurized fluid is no longer diverted to said cavity and is instead directed to said fluid-actuated wellbore tool through said output means.

17. A wellbore tool according to claim 11, further including:

(e) a monitoring means for providing an indication of operation of said pressurization-extending member which comprises a visual indicator which provides a signal corresponding to operation of said source of pressurized fluid.

18. A wellbore tool according to claim 17, wherein said monitoring means comprises a visual indicator which provides a signal corresponding in amplitude and duration with said actuating force of said pressurized fluid within said fluid-actuated wellbore tool.

19. A wellbore tool according to claim 1, wherein said fluid-pressure actuable wellbore tool includes:

a housing insertable through said production tubing string;

a bypass fluid flow path extending through said housing for directing wellbore fluid through said fluid-pressure actuable wellbore tool in response to a pressure differential developed across said wellbore tool during application of pressure;

a means for selectively maintaining said bypass fluid flow path in an open condition during at least periods of application of pressure to diminish said pressure differential developed across said fluid-pressure actuable wellbore tool; and a means for selectively closing said bypass fluid flow path once said actuated mode of operation is obtained to prevent fluid flow therethrough.

20. The wellbore tool according to claim 19, wherein said fluid-pressure actuable wellbore tool is lowered into position and suspended in said wellbore for an expansion mode of operation by a suspension member which comprises a flexible suspension means and wherein said bypass fluid flow path prevents displacement of said fluid-pressure actuable wellbore tool during said expansion mode of operation as a consequence of said pressure differential.

21. The wellbore tool of claim 20, wherein said means for selectively closing comprises:

a valving subassembly with a moveable valve stem, wherein said moveable valve stem is selectively moveable at least once from an open state to a closed state by application of a predetermined force to said fluid-pressure actuable wellbore tool through a control fluid.

22. A wellbore tool according to claim 1, wherein said delivery mechanism comprises:

a wireline which extends through said production tubing string for suspending said source of pressurized fluid and said fluid-pressure actuable wellbore tool in a selected position within said wellbore.

23. A wellbore tool according to claim 22, wherein said wireline selectively supplies electrical power to said at least one electric motor of said source of pressurized fluid.

24. A method of operating a wellbore tool in a wellbore having a production tubing string disposed therein, comprising the steps of:

(a) providing a source of pressurized fluid which selectively discharges fluid, and which includes:

(1) a housing insertable through said production tubing string in said wellbore;

(2) at least one electric motor disposed within said housing; and (3) a pump member driven by said at least one electric motor for receiving and discharging an actuation fluid;

(b) providing a fluid-pressure actuable wellbore tool which is operable in a plurality of modes of operation, including at least a running in the hole mode of operation with said fluid-pressure actuable wellbore tool in a running condition, and an actuated mode of operation with said fluid-actuable wellbore tool in an actuated condition, wherein during said running in the hole mode of operation said fluid-pressure actuable wellbore tool is insertable through said production tubing string in said wellbore;

(c) providing a delivery mechanism for selectively raising and lowering said source of pressurized fluid and said fluid-pressure actuable wellbore tool to selected locations within said wellbore through said production tubing string;

(d) lowering said source of pressurized fluid and said fluid-pressure actuable wellbore tool through said production tubing string on said delivery mechanism to a desired location; and (e) selectively energizing said at least one electric motor of said source of pressurized fluid to drive said pump member to apply a predefined force automatically and without surface intervention for a predefined interval to switch said fluid-pressure actuable wellbore tool from said running in the hole mode of operation to said actuated mode of operation.

25. A method of operating a wellbore tool according to claim 24, further comprising:

(f) providing an equalizing member for maintaining said fluid-pressure actuable wellbore tool in said running condition and insensitive to unintentional and transient pressure differentials between an interior portion of said fluid-pressure actuable wellbore tool and a region exterior of said fluid-pressure actuable wellbore tool; and (g) utilizing said equalizing member during said running in the hole mode of operation to maintain said fluid-pressure actuable wellbore tool in said running condition despite unintentional and transient pressure differentials between an interior portion of said fluid pressure actuable wellbore tool and a region exterior of said fluid-pressure actuable wellbore tool.

26. A method of operating a wellbore tool according to claim 24, further including:

(f) providing a pressurization-extending member for automatically maintaining an actuating force of said actuation fluid from said source of pressurized fluid at a preselected force level for a preselected time interval; and (g) utilizing said pressurization-extending member for automatically maintaining an actuating force of said actuation fluid from said source of pressurized fluid at a preselected force level for a preselected time interval.

27. A method of operating a wellbore tool according to claim 24, further including:

(f) providing a pressurization-extending member for automatically maintaining an actuating force of said actuation fluid from said source of pressurized fluid at a preselected force level for a preselected time interval; and (g) utilizing said pressurization-extending member for maintaining said actuation force of said actuation fluid at a preselected level for a preselected time interval during application of said pressurized fluid from said source of pressurized fluid to said fluid-pressure actable wellbore tool.

* * * * *